US008134546B2

(12) United States Patent
Yamazaki et al.

(10) Patent No.: US 8,134,546 B2
(45) Date of Patent: Mar. 13, 2012

(54) DISPLAY DEVICE AND DRIVING METHOD THEREOF

(75) Inventors: Shunpei Yamazaki, Tokyo (JP); Jun Koyama, Kanagawa (JP); Satoshi Seo, Kanagawa (JP); Hiroko Abe, Tokyo (JP); Mitsuaki Osame, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1127 days.

(21) Appl. No.: 11/570,196

(22) PCT Filed: Jul. 20, 2005

(86) PCT No.: PCT/JP2005/013682
§ 371 (c)(1),
(2), (4) Date: Dec. 7, 2006

(87) PCT Pub. No.: WO2006/009294
PCT Pub. Date: Jan. 26, 2006

(65) Prior Publication Data

US 2007/0182675 A1 Aug. 9, 2007

(30) Foreign Application Priority Data

Jul. 23, 2004 (JP) ..... 2004-216653

(51) Int. Cl.
*G09G 5/00* (2006.01)
*G09G 3/30* (2006.01)

(52) U.S. Cl. ..... 345/207; 345/81

(58) Field of Classification Search ..... 345/45, 345/76–78, 82–84, 207, 211–214; 315/169.1–169.4
See application file for complete search history.

(56) References Cited

U.S. PATENT DOCUMENTS 5,594,463 A 1/1997 Sakamoto
(Continued)

FOREIGN PATENT DOCUMENTS

EP 1 148 466 A2 10/2001
(Continued)

OTHER PUBLICATIONS

Search Report (European Patent Application No. 05767748.6) mailed Jun. 17, 2009.

(Continued)

*Primary Examiner* — Kevin M Nguyen
(74) *Attorney, Agent, or Firm* — Fish & Richardson P.C.

(57) ABSTRACT

In order to keep the luminance of a light emitting element constant, the correction is performed by an external device such as a computer, in which case a display device is inevitably complicated and increased in size. Even when degradation characteristics of the light emitting element are previously stored in a computer, the degradation characteristics vary at random depending on hysteresis of the light emitting element; therefore, changes in luminance cannot be corrected. According to the invention, a display device includes a displaying light emitting element provided in a display portion and a plurality of monitoring light emitting elements having the similar characteristics as the displaying light emitting element. At least one of the monitoring light emitting elements is operated under a condition different from the displaying light emitting element, and the ratio of the total amount of charge flowing through the displaying light emitting element to that flowing through the monitoring light emitting element is controlled to satisfy a certain relation in view of luminance degradation. When the one monitoring light emitting element reaches a predetermined voltage or time, the connection is switched from the one monitoring light emitting element to another monitoring light emitting element that has been operated under the same condition as the displaying light emitting element.

24 Claims, 35 Drawing Sheets

U.S. PATENT DOCUMENTS

| | | | |
|---|---|---|---|
| 6,069,676 | A | 5/2000 | Yuyama |
| 6,473,065 | B1 | 10/2002 | Fan |
| 6,479,940 | B1 | 11/2002 | Ishizuka |
| 6,501,230 | B1 | 12/2002 | Feldman |
| 6,528,951 | B2 | 3/2003 | Yamazaki et al. |
| 6,661,180 | B2 | 12/2003 | Koyama |
| 6,753,856 | B1 | 6/2004 | Krah et al. |
| 6,774,578 | B2 | 8/2004 | Tanada |
| 6,806,871 | B1 | 10/2004 | Yasue |
| 6,828,950 | B2 | 12/2004 | Koyama |
| 6,870,192 | B2 | 3/2005 | Yamazaki et al. |
| 6,911,781 | B2 | 6/2005 | Yamazaki et al. |
| 6,963,321 | B2 | 11/2005 | Everitt |
| 6,995,737 | B2 | 2/2006 | LeChevalier |
| 7,023,141 | B2 | 4/2006 | Anzai et al. |
| 7,053,874 | B2 | 5/2006 | Koyama |
| 7,158,157 | B2 | 1/2007 | Yamazaki et al. |
| 7,180,515 | B2 | 2/2007 | Miyagawa et al. |
| 7,199,771 | B2 | 4/2007 | Yamazaki et al. |
| 7,245,297 | B2 | 7/2007 | Kimura et al. |
| 7,248,255 | B2 | 7/2007 | Yoshida |
| 7,298,347 | B2 | 11/2007 | Yamazaki et al. |
| 7,307,607 | B2 | 12/2007 | Osame et al. |
| 7,446,743 | B2 | 11/2008 | Kwasnick |
| 7,482,629 | B2 | 1/2009 | Hayakawa et al. |
| 2001/0013758 | A1 | 8/2001 | Tsuruoka et al. |
| 2001/0020922 | A1 | 9/2001 | Yamazaki et al. |
| 2001/0030511 | A1 | 10/2001 | Yamazaki et al. |
| 2001/0033252 | A1 | 10/2001 | Yamazaki et al. |
| 2002/0005696 | A1 | 1/2002 | Yamazaki et al. |
| 2002/0017643 | A1 * | 2/2002 | Koyama ..... 257/59 |
| 2002/0125831 | A1 * | 9/2002 | Inukai et al. ..... 315/169.3 |
| 2003/0071821 | A1 | 4/2003 | Sundahl et al. |
| 2003/0132716 | A1 | 7/2003 | Yamazaki et al. |
| 2003/0214467 | A1 | 11/2003 | Koyama et al. |
| 2004/0027320 | A1 | 2/2004 | Ochi et al. |
| 2004/0150594 | A1 | 8/2004 | Koyama et al. |
| 2004/0160395 | A1 | 8/2004 | Yoshida |
| 2004/0212573 | A1 | 10/2004 | Sundahl et al. |
| 2005/0012731 | A1 | 1/2005 | Yamazaki et al. |
| 2005/0017933 | A1 | 1/2005 | Koyama |
| 2005/0017963 | A1 | 1/2005 | Yamazaki et al. |
| 2005/0017964 | A1 | 1/2005 | Yamazaki et al. |
| 2005/0280766 | A1 | 12/2005 | Johnson et al. |
| 2005/0285823 | A1 | 12/2005 | Kimura et al. |
| 2006/0022206 | A1 | 2/2006 | Hayakawa et al. |
| 2008/0012801 | A1 | 1/2008 | Kimura et al. |

FOREIGN PATENT DOCUMENTS

| | | | |
|---|---|---|---|
| EP | 1 168 291 | A2 | 1/2002 |
| EP | 1 355 289 | A2 | 10/2003 |
| EP | 1 450 345 | A2 | 8/2004 |
| EP | 1 598 804 | A2 | 11/2005 |
| JP | 61-261921 | A | 11/1986 |
| JP | 11-272223 | A | 10/1999 |
| JP | 11-305722 | A | 11/1999 |
| JP | 2000-347622 | | 12/2000 |
| JP | 2000-347622 | A | 12/2000 |
| JP | 2001-035655 | A | 2/2001 |
| JP | 2001-134197 | A | 5/2001 |
| JP | 2001-331144 | A | 11/2001 |
| JP | 2002-072964 | | 3/2002 |
| JP | 2002-123217 | A | 4/2002 |
| JP | 2002-123219 | | 4/2002 |
| JP | 2002-175046 | A | 6/2002 |
| JP | 2002-278514 | A | 9/2002 |
| JP | 2002-333861 | | 11/2002 |
| JP | 2002-351403 | | 12/2002 |
| JP | 2004-004759 | | 1/2004 |
| JP | 2004-070349 | | 3/2004 |
| JP | 3390214 | | 3/2004 |
| WO | 03/032286 | A2 | 4/2003 |
| WO | 2004/025615 | A1 | 3/2004 |

OTHER PUBLICATIONS

International Search Report (Application No. PCT/JP2005/013682) mailed Oct. 25, 2005; 3 pages.

Written Opinion (Application No. PCT/JP2005/013682) mailed Oct. 25, 2005; 3 pages.

Shimoda et al., "Current Status and Future of Light-Emitting Polymer Display Driven by Poly-Si TFT", SID Digest '99 : SID International Symposium Digest of Technical Papers, May 18, 1999, vol. 30, pp. 372-375.

Han et al., "3.8inch Green OLED With Low Temperature Poly Si TFT", Eurodisplay '99 : The 19th International Display Research Conference, Sep. 6, 1999, pp. 27-30.

Shimoda et al., "High Resolution Light Emitting Polymer Display Driven by Low Temperature Polysilicon Thin Film Transistor With Integrated Driver", Asia Display '98 : Proceedings of the 18th IDRC (International Display Research Conference), 1998, pp. 217-220.

* cited by examiner

DISPLAY DEVICE AND DRIVING METHOD THEREOF

TECHNICAL FIELD

The present invention relates to a display device and a driving method thereof, and more particularly relates to a display device using a light emitting element.

BACKGROUND ART

A display device including a display screen formed by a light emitting element using an electro luminescence (hereinafter also referred to as EL) material has been developed. There are known a plurality of driving methods and panel configurations for such a display device. For example, known is a technology where a light emitting element for monitoring temperature is provided in a panel so that a constant current is supplied to a light emitting element of a pixel even when the ambient temperature varies (see Patent Document 1, for example).

Another display device is also disclosed, which includes a display panel formed by a plurality of light emitting portions, a driving means for supplying a constant current driving signal in accordance with an inputted signal, a detecting means for detecting a voltage generated in the light emitting portions, and a control means for controlling the constant current driving signal in accordance with changes in the voltage (see Patent Document 2, for example). In this display device, even when luminance is reduced due to degradation of a light emitting element, the voltage of a signal electrode connected to the light emitting element is detected by the driving means and a current from the driving means is increased so as to keep the luminance constant.

Patent Document 1: Japanese Patent Laid-Open No. 2002-333861

Patent Document 2: Japanese Patent Laid-Open No. 3390214

DISCLOSURE OF INVENTION

It is known that the lighting intensity (luminance) of a light emitting element varies not only by temperature but also by, for example, degradation of the light emitting element. This degradation is a phenomenon where luminance is reduced with time in the case of supplying a constant current to the light emitting element. The phenomenon shows that the lighting intensity (luminance) of the light emitting element cannot be kept constant only by controlling a constant current to be supplied to the light emitting element.

In conventional technologies, however, a corrected current value is determined by an external device such as a computer in order to keep the luminance of a light emitting element constant, in which case a display device is inevitably complicated and increased in size. Further, even when degradation characteristics of a light emitting element are previously stored in a computer, there are variations in characteristics of the light emitting element and the degradation characteristics vary at random depending on hysteresis of the light emitting element such as driving conditions. Accordingly, it is not possible to correct changes in luminance accurately.

In view of the foregoing, the invention compensates variations in luminance characteristics of a light emitting element.

One mode of the invention includes a light emitting element provided in a display portion and a monitoring light emitting element having the similar characteristics as the light emitting element. These two light emitting elements are operated under different driving conditions, and the ratio of the total amount of charge flowing through the light emitting element in the display portion to that flowing through the monitoring light emitting element is controlled to satisfy a certain relation in view of luminance degradation. Note that the light emitting element and the monitoring light emitting element having the similar characteristics means that the monitoring light emitting element and the displaying light emitting element are formed in the same manufacturing steps, that the elements are formed by using the same structure, or that the elements are formed by using the same material.

One mode of the invention includes a displaying light emitting element provided in a display portion and a plurality of monitoring light emitting elements having the similar characteristics as the displaying light emitting element. At least one of the plurality of monitoring light emitting elements is operated under a different driving condition than the displaying light emitting element. The ratio of the total amount of charge flowing through the displaying light emitting element to that flowing through the monitoring light emitting element is controlled to satisfy a certain relation in view of luminance degradation. At this time, the other monitoring light emitting elements may be operated under the same condition as the displaying light emitting element. When the one of the monitoring light emitting elements reaches a predetermined voltage or time, another monitoring light emitting element is selected from the plurality of monitoring light emitting elements that have been operated under the same condition as the displaying light emitting element. Then, the newly selected monitoring light emitting element is operated under a driving condition where the ratio of the total amount of charge flowing through the displaying light emitting element to that flowing through the monitoring light emitting element satisfies a certain relation in view of luminance degradation. In this manner, according to the invention, the plurality of monitoring light emitting elements are used.

The luminance degradation of a light emitting element is determined considering initial degradation and medium and long-term degradation. The initial degradation means drastic changes in luminance for several to several tens of hours after the light emitting element is conducted. Meanwhile, the medium and long-term degradation means luminance degradation after the initial degradation, which may be caused regardless of current density.

The invention focuses on the fact that degradation of a light emitting element depends on the total amount of charge flowing through the light emitting element. In order to correct changes in luminance of a light emitting element provided in a display portion, the amount of charge flowing through the light emitting element in the display portion is compared to that flowing through a monitoring light emitting element not only by monitoring the total amount of charge flowing through the monitoring light emitting element but by taking into consideration internal degradation of the light emitting element.

According to the invention, a displaying light emitting element and a monitoring light emitting element are operated under different driving conditions. In particular, the driving conditions are determined so that the monitoring light emitting element is more overloaded than the displaying light emitting element.

Under the different driving conditions, the monitoring light emitting element may be driven with a constant current while the displaying light emitting element may be driven with a constant voltage. Also, the different driving condition includes a condition in which a lighting period of the monitoring light emitting element is different from that of the displaying light emitting element. Note that in this specification, the driving conditions of the light emitting element and the monitoring light emitting element are represented by a ratio of a lighting period in a certain period having one or both of a lighting period and a non-lighting period (hereinafter referred to as a duty ratio). As an example of a certain period, one frame period may be used. A ratio of a lighting period in a certain period of 100% means that the light emitting element emits light continuously (duty ratio is 100%), and a ratio of a lighting period in a certain period of 50% means that the light emitting element emits light during half the certain period (duty ratio is 50%). In addition, as other different driving conditions, a duty ratio of the monitoring light emitting element is 100% whereas a duty ratio of the displaying light emitting element is 10 to 35%. Alternatively, a duty ratio of the monitoring light emitting element is 50 to 100% whereas a duty ratio of the displaying light emitting element is 10 to 35%. Further alternatively, the monitoring light emitting element is driven with 50 to 100% of current value while the displaying light emitting element is driven with 10 to 35% of current value.

As described above, driving conditions are determined so that a monitoring light emitting element is more overloaded than a displaying light emitting element; thereby the luminance of the displaying light emitting element can be corrected to be constant.

According to one mode of the invention, a display device includes a monitoring light emitting element connected to a current source, a voltage generating circuit connected to the current source and the monitoring light emitting element, to which the same potential as the monitoring light emitting element is inputted, and a displaying light emitting element to which an output voltage of the voltage generating circuit is applied.

According to one mode of the invention, a display device includes a monitoring light emitting element connected to a current source, a voltage generating circuit connected to the current source and the monitoring light emitting element, to which the same potential as the monitoring light emitting element is inputted, and a displaying light emitting element applied with an output voltage of the voltage generating circuit, a ratio of a lighting period in a certain period having one or both of a lighting period and a non-lighting period is 50 to 100% in the monitoring light emitting element, and a ratio of a lighting period in the certain period having one or both of a lighting period and a non-lighting period is 5 to 45% in the displaying light emitting element.

According to one mode of the invention, a display device includes a plurality of monitoring light emitting elements connected in parallel to a current source, a first connection switching means for controlling a connection between the current source and the monitoring light emitting elements, a voltage generating circuit connected to the current source and the monitoring light emitting elements, to which the same potential as one of the plurality of monitoring light emitting elements is inputted, a second connection switching means for controlling a connection between the plurality of monitoring light emitting elements and the voltage generating circuit, a controller for detecting a voltage applied to the one monitoring light emitting element and instructing the second connection switching means to change the connection with the voltage generating circuit from the one monitoring light emitting element to another monitoring light emitting element, and a displaying light emitting element to which an output voltage of the voltage generating circuit is applied.

According to one mode of the invention, a display device includes a plurality of monitoring light emitting elements driven with different ratios of a lighting period to a non-lighting period, a voltage generating circuit connected to a current source and the monitoring light emitting elements, to which the same potential as one of the plurality of monitoring light emitting elements is inputted, and a displaying light emitting element to which an output voltage of the voltage generating circuit is applied.

According to one mode of the invention, a display device includes a plurality of monitoring light emitting elements driven with different ratios of a lighting period to a non-lighting period, a voltage generating circuit connected to a current source and the monitoring light emitting elements, to which the same potential as one of the plurality of monitoring light emitting elements is inputted, a connection switching means for controlling a connection between the plurality of monitoring light emitting elements and the voltage generating circuit, a controller for detecting a voltage applied to the one monitoring light emitting element and instructing the connection switching means to change the connection with the voltage generating circuit from the one monitoring light emitting element to another monitoring light emitting element, and a displaying light emitting element to which an output voltage of the voltage generating circuit is applied.

According to one mode of the invention, a display device includes a displaying light emitting element, one monitoring light emitting element connected to a current source, another monitoring light emitting element connected to the current source and driven with the same ratio of a lighting period to a non-lighting period as the displaying light emitting element, a voltage generating circuit connected to the current source and the one monitoring light emitting element, to which the same potential as the monitoring light emitting element is inputted, and a controller for detecting a voltage applied to the one monitoring light emitting element and instructing a connection switching means to change the connection with the voltage generating circuit from the one monitoring light emitting element to the other monitoring light emitting element, wherein an output voltage of the voltage generating circuit is applied to the displaying light emitting element, a ratio of a lighting period in a certain period having one or both of a lighting period and a non-lighting period is 5 to 45% in the displaying light emitting element, and a ratio of a lighting period in the certain period having one or both of a lighting period and a non-lighting period is 50 to 100% in the monitoring light emitting element.

Instead of the controller in this display device, it is also possible to use a controller for detecting an accumulated driving time of one monitoring light emitting element and instructing the connection switching means to change the connection with the voltage generating circuit from the one monitoring light emitting element to another monitoring light emitting element. Alternatively, the controller may select whether a voltage applied to the one monitoring light emitting element is detected to instruct the second connection switching means to change the connection with the voltage generating circuit from the one monitoring light emitting element to another monitoring light emitting element, or an accumulated driving time of the one monitoring light emitting element is detected to instruct the connection switching means to change the connection with the voltage generating circuit from the one monitoring light emitting element to another monitoring light emitting element.

According to one mode of the invention, a driving method of a display device including a monitoring light emitting element, a current source for supplying a current to the monitoring light emitting element, a voltage generating circuit, and a displaying light emitting element, includes the steps of setting one terminal of each of the monitoring light emitting element and the displaying light emitting element to have a fixed potential, and detecting the potential of the other terminal of the monitoring light emitting element by the voltage generating circuit, so that the detected potential is used as a driving voltage of the displaying light emitting element.

According to one mode of the invention, a driving method of a display device includes the steps of driving a monitoring light emitting element so that a ratio of a lighting period in a certain period having one or both of a lighting period and a non-lighting period is 50 to 100%, driving a displaying light emitting element so that a ratio of a lighting period in the certain period having one or both of a lighting period and a non-lighting period is 5 to 45%, and detecting a voltage applied to the monitoring light emitting element by a voltage generating circuit, so that the detected potential is used as a driving voltage of the displaying light emitting element.

According to one mode of the invention, a driving method of a display device including a monitoring light emitting element, a current source for supplying a current to the monitoring light emitting element, a voltage generating circuit, and a displaying light emitting element, includes the steps of setting one terminal of each of the monitoring light emitting element and the displaying light emitting element to have a fixed potential, and driving the monitoring light emitting element with a constant current by the current source to detect the potential of the other terminal of the monitoring light emitting element by the voltage generating circuit, so that the detected potential is used as a driving voltage of the displaying light emitting element.

According to one mode of the invention, a driving method of a display device including a plurality of monitoring light emitting elements, a current source for supplying a current to the plurality of monitoring light emitting elements, a voltage generating circuit, and a displaying light emitting element, includes the steps of driving the plurality of monitoring light emitting elements with different ratios of a lighting period to a non-lighting period, and detecting a voltage applied to one of the plurality of monitoring light emitting elements by the voltage generating circuit, so that the detected potential is used as a driving voltage of the displaying light emitting element.

According to one mode of the invention, a driving method of a display device including a plurality of monitoring light emitting elements, a current source for supplying a current to the plurality of monitoring light emitting elements, a voltage generating circuit, and a displaying light emitting element, includes the steps of driving the plurality of monitoring light emitting elements with different ratios of a lighting period to a non-lighting period, detecting a voltage applied to one of the plurality of monitoring light emitting elements by the voltage generating circuit, so that the detected potential is used as a driving voltage of the displaying light emitting element, and detecting a voltage applied to the one monitoring light emitting element, so that when the detected voltage reaches a predetermined value, the connection with the voltage generating circuit is switched from the one monitoring light emitting element to another monitoring light emitting element.

According to one mode of the invention, a driving method of a display device includes the steps of driving a displaying light emitting element so that a ratio of a lighting period in a certain period having one or both of a lighting period and a non-lighting period is 5 to 45%, driving one of a plurality of monitoring light emitting elements so that a ratio of a lighting period in the certain period having one or both of a lighting period and a non-lighting period is 50 to 100%, driving the other monitoring light emitting elements with the same ratio of a lighting period to a non-lighting period as that of the displaying light emitting element, detecting a voltage applied to the one monitoring light emitting element by a voltage generating circuit, so that the detected voltage is used as a driving voltage of the displaying light emitting element, and detecting a voltage applied to the one monitoring light emitting element, so that when the detected voltage reaches a predetermined value, the connection with the voltage generating circuit is switched from the one monitoring light emitting element to another monitoring light emitting element and the other monitoring light emitting element is driven with a ratio of a lighting period to a non-lighting period of 50 to 100%.

In this driving method of a display device, the connection may be switched from one monitoring light emitting element to another monitoring light emitting element not by detecting a voltage applied to the one monitoring light emitting element but by detecting an accumulated driving time of the one monitoring light emitting element. Alternatively, the connection with the voltage generating circuit may be switched from one monitoring light emitting element to another monitoring light emitting element by detecting either a voltage applied to the one monitoring light emitting element or an accumulated driving time of the one monitoring light emitting element.

In the display device and the driving method thereof according to the invention, driving conditions are determined so that the monitoring light emitting element is more overloaded than the displaying light emitting element; thereby the luminance of the displaying light emitting element is controlled to be kept constant. This method of keeping the luminance of the displaying light emitting element constant is called a constant luminescent drive (hereinafter referred to as a CL drive), or a constant brightness drive.

It should be noted that in this specification, a light emitting element is classified into a monitoring light emitting element and a displaying light emitting element to be distinguished from each other for convenience. However, these light emitting elements are used not only for monitoring or displaying. For example, a part or all of a monitoring light emitting element may be used as a displaying light emitting element, or a part or all of a displaying light emitting element may be used as a monitoring light emitting element.

According to the invention, a circuit for compensating changes in temperature and changes with time is provided in a display device; thereby the luminance of a displaying light emitting element can be kept constant. This compensation circuit can be easily configured by a current source, a monitoring light emitting element and a voltage generating circuit. Further, changes in luminance can be corrected while driving the displaying light emitting element without previously obtaining degradation characteristics of the light emitting element.

According to the invention, the amount of charge flowing through the displaying light emitting element is compared to that flowing through the monitoring light emitting element by taking luminance degradation into consideration based on the amount of charge flowing through the light emitting element; thereby the CL drive can be performed where the luminance of the displaying light emitting element can be corrected to be constant. Since the invention uses a constant voltage drive, the light emitting element can be driven at a lower voltage as compared to the case of using a constant current drive, leading to reduced power consumption.

BEST MODE FOR CARRYING OUT THE INVENTION

Figure 1:
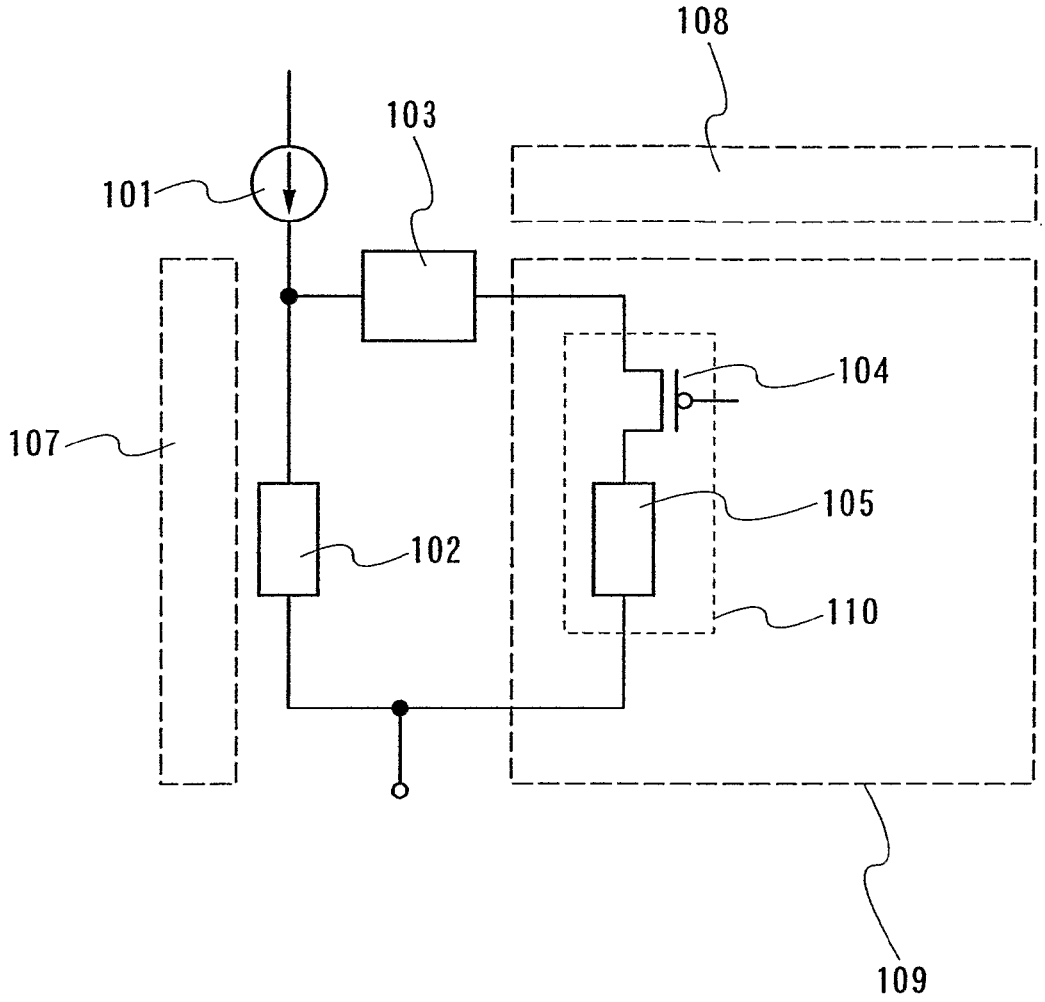
FIG. 1 is a diagram showing a configuration of a display device according to the invention, which is provided with a displaying light emitting element and a monitoring light emitting element.

Although the invention will be described by way of Embodiment Modes with reference to the accompanying drawings, it is to be understood that various changes and modifications will be apparent to those skilled in the art. Therefore, unless such changes and modifications depart from the scope of the invention, they should be construed as being included therein.

One mode of a display device according to the invention is described with reference to FIG. 1. A display device shown in FIG. 1 includes a display portion 109. The display portion 109 includes a displaying light emitting element 105 connected to a driving transistor 104. The displaying light emitting element 105 and the driving transistor 104 constitute a pixel 110. The pixel 110 may require a switching transistor for controlling light emission of the displaying light emitting element 105 based on a video signal inputted externally, though it is omitted in FIG. 1. In the display portion 109, the pixels 110 may be arranged in matrix.

The display device shown in FIG. 1 includes a monitoring light emitting element 102 as well as the displaying light emitting element 105 provided in the display portion 109. The display device may include one or more monitoring light emitting elements 102. The monitoring light emitting element 102 may be provided adjacent to the outside of the display portion 109, or provided in the display portion 109. Alternatively, the monitoring light emitting element 102 may be provided in the other portion of a substrate over which the display portion 109 is formed. The display device may additionally include a scan line driver circuit 107 and a data line driver circuit 108. These driver circuits control light emission or non-light emission of the displaying light emitting element 105 depending on a signal externally inputted.

In this display device, the monitoring light emitting element 102 and the displaying light emitting element 105 are desirably formed in the same manufacturing step. When adopting the same structure and material, the light emitting elements can have similar characteristics, leading to increased accuracy of correction. The displaying light emitting element 105 and the monitoring light emitting element 102 typically have a structure where a layer containing a material generating EL (hereinafter also referred to as an EL layer) is sandwiched between a pair of electrodes.

The EL layer may include a hole injection layer, a hole transporting layer, a light emitting layer, an electron transporting layer, and an electron injection layer in view of the carrier transporting properties. There is no clear distinction between the hole injection layer and the hole transporting layer, and both of them inevitably have a hole transporting property (hole mobility). The hole injection layer is in contact with the anode, and a layer in contact with the hole injection layer is distinguished as a hole transporting layer for convenience. The same applies to the electron transporting layer and the electron injection layer. A layer in contact with the cathode is called an electron injection layer while a layer in contact with the electron injection layer is called an electron transporting layer. In some cases, the light emitting layer may also function as the electron transporting layer, and it is therefore called a light emitting electron transporting layer. The EL layer is not necessarily formed of an organic material, and a composite of an organic material and an inorganic material, an organic material added with a metal complex, and the like may be used for the EL layer if the same function can be achieved.

It is needless to say that the structure of the EL layer may change. The EL layer is not necessarily provided with a specific electron injection region or light emitting region, and it may be provided with an electrode for the purpose of the same or a dispersed light emitting material unless such changes depart from the scope of the invention.

In some cases, the electrode material is classified into an anode and a cathode for convenience. The anode is an electrode from which a hole is injected into an EL layer whereas the cathode is an electrode from which an electron is injected into the EL layer. The anode is formed of a material with a work function of 4 eV or more (preferably, 4.5 eV or more), and typically using indium tin oxide (also called ITO), indium tin oxide added with silicon oxide, indium zinc oxide, zinc oxide doped with gallium, titanium nitride, or the like. The cathode is formed of a material with a work function of 4 eV or less, and typically using a material containing alkaline metal or alkaline earth metal.

When a color display is performed, EL layers having different emission wavelength bands may be provided in each pixel. Typically, an EL layer corresponding to each color of red (R), green (G) and blue (B) is provided. In such a case, a monitoring light emitting element corresponding to each color of red, green and blue may be provided to correct a power supply potential for each color. When providing a filter (colored layer) that transmits light of a specific wavelength band on the light emitting side of a light emitting element at this time, color purity can be increased and a display portion can be prevented from having a mirror surface (glare). Providing a filter can omit a circular polarizer or the like that is required in conventional technologies and can eliminate the loss of light emitted from the EL layer. Further, a change in hue that occurs when a display portion is obliquely seen can be reduced. The EL layer can be structured to emit monochrome or white light. If a white light emitting material is used, a color display can be performed by providing a filter that transmits light having a specific wavelength on the light emitting side of a light emitting element.

An EL layer is formed of a material that emits light from a singlet excited state (hereinafter referred to as a singlet excited light emitting material) or a material that emits light from a triplet excited state (hereinafter referred to as a triplet excited light emitting material). For example, among light emitting elements that emit red, green and blue light, a red light emitting element whose luminance is reduced by half in a relatively short time is formed of the triplet excited light emitting material and the rest are formed using the singlet excited light emitting material. The triplet excited light emitting material has good luminous efficiency and has the advantage that less power is consumed to obtain the same luminance.

Alternatively, a red light emitting element and a green light emitting element may be formed of the triplet excited light emitting material and a blue light emitting element may be formed of the singlet excited light emitting material. Much lower power consumption can be achieved when a green light emitting element having high visibility is formed of the triplet excited light emitting material. As an example of the triplet excited light emitting material, there is a material using as a guest material a metal complex such as a metal complex having platinum that is a third transition series element as a central metal, and a metal complex having iridium as a central metal. Further, the electro luminescent layer may be formed of any of a low molecular weight material, a medium molecular weight material and a high molecular weight material.

The monitoring light emitting element 102 is connected to a current source 101. One terminal of the monitoring light emitting element 102, which is connected to the current source 101, is also connected to an input terminal of a voltage generating circuit 103. An output terminal of the voltage generating circuit 103 is connected to a terminal of the driving transistor 104, which is not connected to the displaying light emitting element 105.

When the displaying light emitting element 105 is driven in the display portion 109, a constant current is supplied from the current source 101 to the monitoring light emitting element 102. When the temperature of the display device changes in the case where the monitoring light emitting element 102 is driven with a constant current, the resistance value of the monitoring light emitting element 102 varies. The temperature of the display device specifically means the temperature of the display portion or the periphery of the display portion, which is the temperature of a portion that influences I-V characteristics of the monitoring light emitting element and the displaying light emitting element.

When the resistance value of the monitoring light emitting element 102 varies, a potential difference between the two ends of the monitoring light emitting element 102 changes since a constant current is supplied to the monitoring light emitting element 102. The other terminal of the monitoring light emitting element 102, which is not connected to the current source 101, is supplied with a fixed potential. Accordingly, when the potential of the one terminal of the monitoring light emitting element 102, which is connected to the current source 101, is inputted to the voltage generating circuit 103, a driving voltage according to changes in temperature can be applied to the displaying light emitting element 105.

The resistance value of the monitoring light emitting element 102 changes also in the case where light emitting properties of the monitoring light emitting element 102 driven with a constant current vary as time passes. That is to say, current efficiency is reduced with the increase in the accumulated lighting period of the monitoring light emitting element 102; thus, the luminance of the monitoring light emitting element 102 is reduced even when a constant current is supplied thereto. At the same time, the resistance value of the monitoring light emitting element 102 is increased. Similarly in this case, the driving conditions of the displaying light emitting element 105 can be determined in accordance with the potential difference between the two ends of the monitoring light emitting element 102, which is detected by the voltage generating circuit 103. In other words, a driving voltage can be determined depending on the degradation rate of luminance.

The voltage generating circuit 103 detects the potential of the terminal of the monitoring light emitting element 102, which is connected to the current source 101. The same potential as the detected potential of the monitoring light emitting element 102 is outputted from the voltage generating circuit 103, and supplied to the displaying light emitting element 105 through the driving transistor 104 as a driving voltage. The voltage generating circuit 103 allows the driving voltage of the displaying light emitting element 105 to be determined in accordance with luminance degradation of the monitoring light emitting element 102 due to changes in temperature and changes with time.

The voltage generating circuit 103 can be configured by, for example, a voltage follower circuit using an operational amplifier. A non-inverting input terminal of the voltage follower circuit has high input impedance while an output terminal thereof has low output impedance. Accordingly, the same potential as the input terminal can be outputted from the output terminal, and a current can be supplied from the output terminal with no current flowing from the current source 101 to the voltage follower circuit. It is needless to say that any circuit configuration may be adopted if it can output the same potential as the input terminal like the voltage follower circuit.

As set forth above, the display device shown in FIG. 1 has a compensation circuit for changes in temperature and changes with time (hereinafter simply referred to as a compensation circuit) configured by the current source 101, the monitoring light emitting element 102 and the voltage generating circuit 103. According to the invention, the displaying light emitting element provided in the display portion and the monitoring light emitting element having the similar characteristics are operated under different driving conditions, and controlled so that the ratio of the total amount of charge flowing through the displaying light emitting element to that flowing through the monitoring light emitting element satisfies a certain relation in view of luminance degradation with time. In this case, the total amount of charge flowing through the monitoring light emitting element is set to be larger than that flowing though the displaying light emitting element in order to correct the luminance of the displaying light emitting element to be constant by the monitoring light emitting element. As such a driving method, the lighting period of the light emitting element may be controlled. For example, the monitoring light emitting element emits light continuously (100% of lighting), while the displaying light emitting element emits light at the duty ratio of 10 to 35%. Alternatively, the monitoring light emitting element emits light at the duty ratio of 50 to 100% whereas the displaying light emitting element emits light at the duty ratio of 10 to 35%. Further alternatively, the monitoring light emitting element is driven with 50 to 100% of current value while the displaying light emitting element is driven with 10 to 35% of current value.

Figure 2:
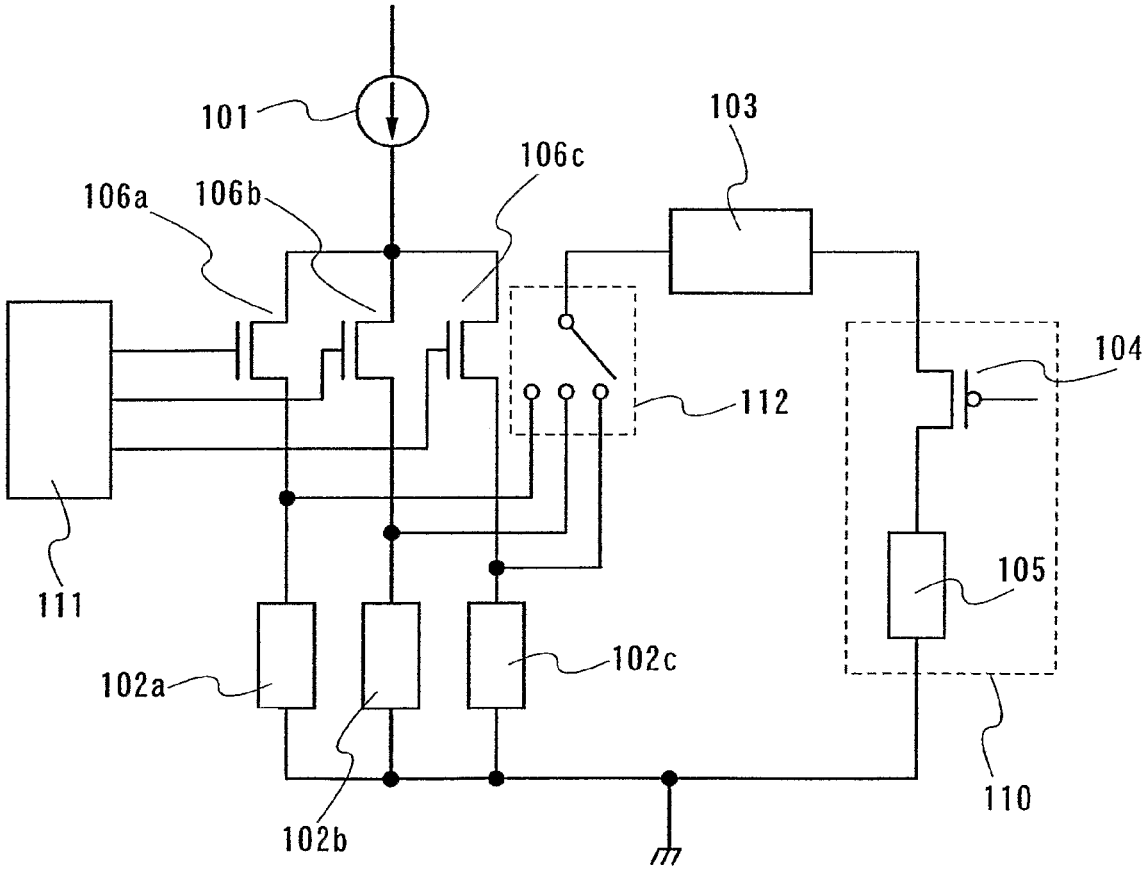
FIG. 2 is a diagram showing a configuration of a display device according to the invention, which is provided with a displaying light emitting element and a monitoring light emitting element.

When the total amount of charge flowing through the monitoring light emitting element is set to be larger than that flowing through the displaying light emitting element, the monitoring light emitting element is more overloaded than the displaying light emitting element. Thus, a plurality of monitoring light emitting elements may be provided in a compensation circuit to reliably operate the monitoring light emitting elements for a long time. The plurality of monitoring light emitting elements allow changes in temperature and degradation with time of the displaying light emitting element to be reliably corrected for a long time. FIG. 2 shows a configuration example where a plurality of monitoring light emitting elements are provided in a compensation circuit.

A monitoring light emitting element 102*a*, a monitoring light emitting element 102*b* and a monitoring light emitting element 102*c* are connected in parallel to the current source 101. A switching transistor 106*a* is provided between the monitoring light emitting element 102*a* and the current source 101, a switching transistor 106*b* is provided between the monitoring light emitting element 102*b* and the current source 101, and a switching transistor 106*c* is provided between the monitoring light emitting element 102*c* and the current source 101.

A signal is inputted from a controller 111 to gate electrodes of the switching transistors 106*a* to 106*c* so as to turn on/off the switching transistors 106*a* to 106*c* at a predetermined timing. The lighting period of the monitoring light emitting elements is controlled by turning on/off the switching transistors. That is to say, the switching transistors 106*a* to 106*c* function as connection switching means between the current source 101 and the monitoring light emitting elements 102*a* to 102*c*, respectively.

By selecting the switching transistors 106*a* to 106*c*, it is possible to simultaneously drive the monitoring light emitting element 102*a* driven with a ratio of a lighting period to a non-lighting period (hereinafter also referred to as a duty ratio) of 100%, the monitoring light emitting element 102*b* driven with a duty ratio of 60%, and the monitoring light emitting element 102*c* driven with a duty ratio of 30%. The duty ratio of 100% means that the light emitting element emits light continuously and does not have a non-lighting period. The duty ratio of 60% means that 60% of all the period is a lighting period and the rest 40% is a non-lighting period.

A connection switching means 112 is provided between the monitoring light emitting elements 102*a* to 102*c* and the voltage generating circuit 103. The connection switching means 112 can be configured by a switching element typified by a transistor The connection switching means 112 selects the connection between the voltage generating circuit 103 and one of the monitoring light emitting elements 102*a* to 102*c*. As a result, a potential difference of the monitoring light emitting element driven with a predetermined duty ratio as described above can be inputted to the voltage generating circuit 103; thereby the driving voltage of the displaying light emitting element 105 can be controlled.

According to the configuration shown in FIG. 2, the CL drive can be performed by switching the monitoring light emitting element as needed. For example, the monitoring light emitting element 102*a* driven with a duty ratio of 100%, the monitoring light emitting element 102*b* driven with a duty ratio of 30%, and the monitoring light emitting element 102*c* driven with a duty ratio of 30% are driven at the same time. Then, the monitoring light emitting element 102*a* driven with a duty ratio of 100% is selected by the connection switching means 112 during a predetermined period, and the voltage thereof is inputted to the voltage generating circuit 103 to correct the displaying light emitting element 105.

When the controller 111 detects that the voltage of the monitoring light emitting element 102*a* reaches a predetermined value, the connection switching means 112 switches the connection from the monitoring light emitting element 102*a* to the monitoring light emitting element 102*b*. At the same time, a gate signal of the switching transistor 106*b* is varied to change the driving conditions so as to have a duty ratio of 100%.

The monitoring light emitting element 102*b* that has been driven with a duty ratio of 30% degrades at substantially the same rate as the displaying light emitting element 105. Therefore, by changing the driving conditions for correction, the CL drive of the displaying light emitting element 105 can be continuously performed.

When it is detected that the voltage of the monitoring light emitting element 102*b* reaches a predetermined value, the connection is switched from the monitoring light emitting element 102*b* to the monitoring light emitting element 102*c* in the same manner; thereby the CL drive can be continuously performed.

The connection is not necessarily switched depending on the voltage of the monitoring light emitting element. Instead, the period during which the monitoring light emitting element is driven with a duty ratio of 100% may be measured by a counter provided in the controller, so that the monitoring light emitting element to be selected is switched when a predetermined time passes. Alternatively, both the voltage and the driving time of the monitoring light emitting element may be monitored, and one of them which reaches a predetermined value more quickly may be used as criteria.

According to the invention, the amount of charge flowing through the displaying light emitting element 105 is compared to that flowing through the monitoring light emitting element 102 by taking into consideration internal degradation of the light emitting element; thereby the luminance of the displaying light emitting element 105 is corrected to be constant. Thus, the CL drive for keeping the luminance of the displaying light emitting element 105 constant can be performed.

The principle of the CL drive adopted in the invention is described below. A light emitting element used for the description has, similarly to the light emitting element in this embodiment mode, a structure where a thin film containing an organic material generating EL is sandwiched between a pair of electrodes.

A current flowing through an EL layer is called as a trap charge limited current (TCLC) and represented by the following formula where J is current density, V is voltage, S is a value determined by the material and structure of the light emitting element, and n is a natural number not less than 2.

$$J=S\cdot V^n \tag{1}$$

The following formula can be obtained by modifying the formula (1).

$$\log J=n\cdot\log V+\log S \tag{2}$$

The formula (2) represents I-V characteristics indicated on a logarithmic scale, which is represented by a straight line with a slop of n. The smaller the value of log S becomes, the higher voltage side the straight line is shifted to.

Figure 3:
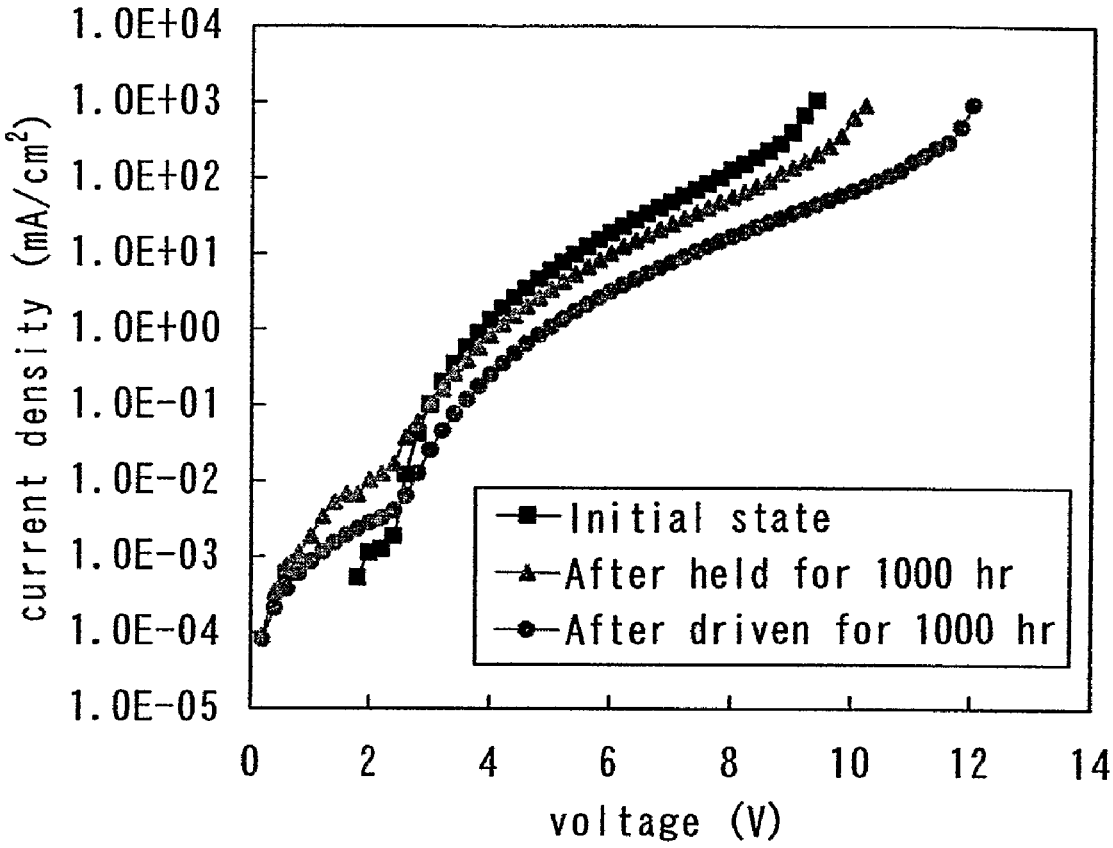
FIG. 3 is a graph showing typical current density-voltage characteristics of a light emitting element.

FIG. 3 is a graph showing typical current density-voltage characteristics of the light emitting element. The element has a structure where an anode, DNTPD, NPB, Alq:C6, Alq, CaF2, and Al are stacked in this order. The graph shows characteristics in the initial state, characteristics after being held for 1000 hours at room temperature, and characteristics after being driven with a constant current for 1000 hours at room temperature.

As shown in FIG. 3, the current density-voltage characteristics of the light emitting element that has been driven with a constant current for 1000 hours at room temperature are shifted to a higher voltage side than the initial characteristics. Similarly, the current density-voltage characteristics of the light emitting element that has been held for 1000 hours at room temperature without flowing current are shifted to a higher voltage side.

Figure 4:
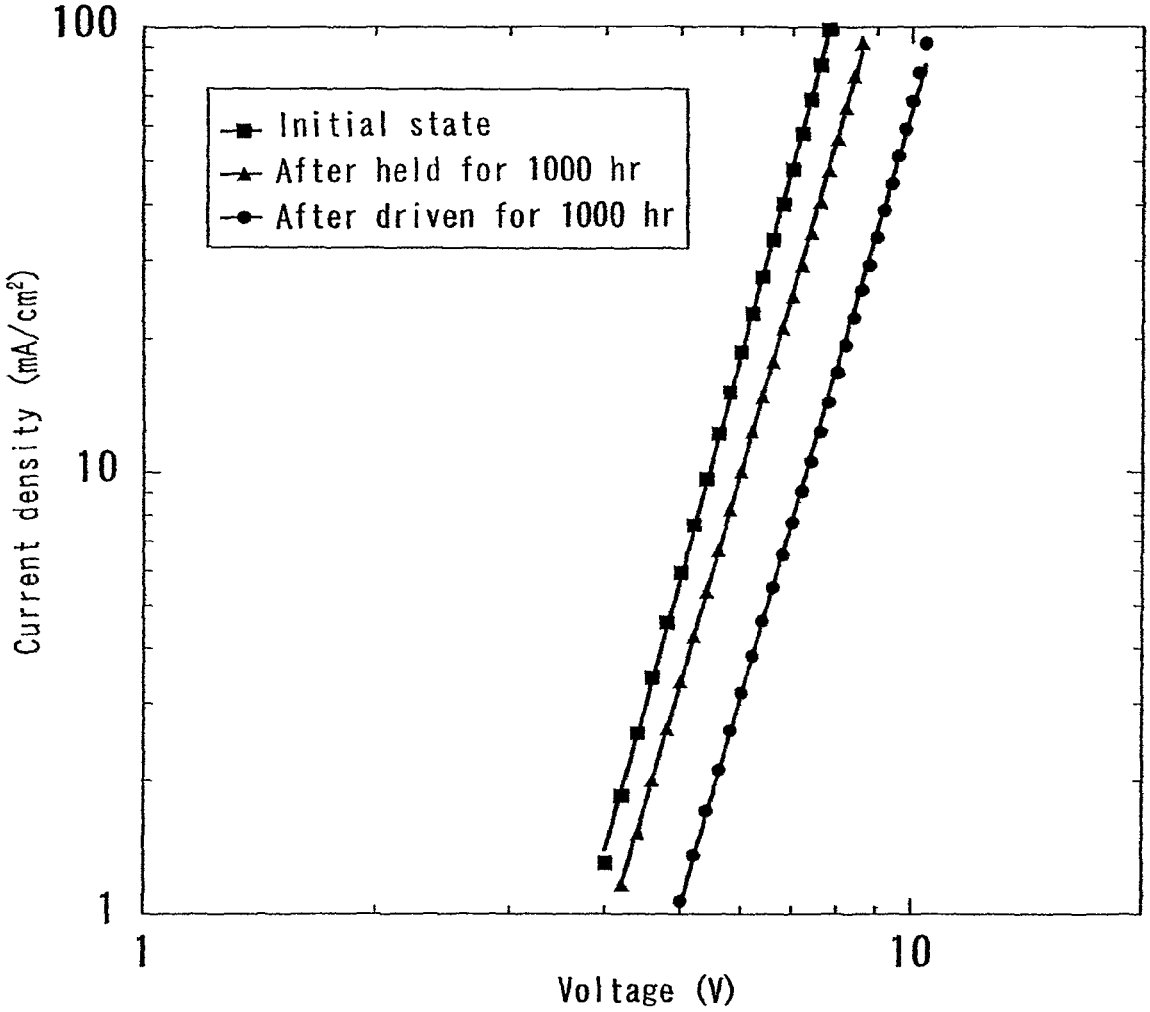
FIG. 4 is a graph showing current density-voltage characteristics in a current density region where a light emitting element can have actual luminance.

FIG. 4 is a double logarithmic graph obtained by plotting the aforementioned three types of current density-voltage characteristics based on the formula (2) in a current density region where actual luminance can be obtained. In the graph of FIG. 4, the current density-voltage characteristics are plotted against a current density of 1 to 100 mA/cm2 where a luminance of 100 to 10000 cd/m2 can be obtained. In the graph of FIG. 4, the current density-voltage characteristics are represented by straight lines with a slop of n.

Figure 5:
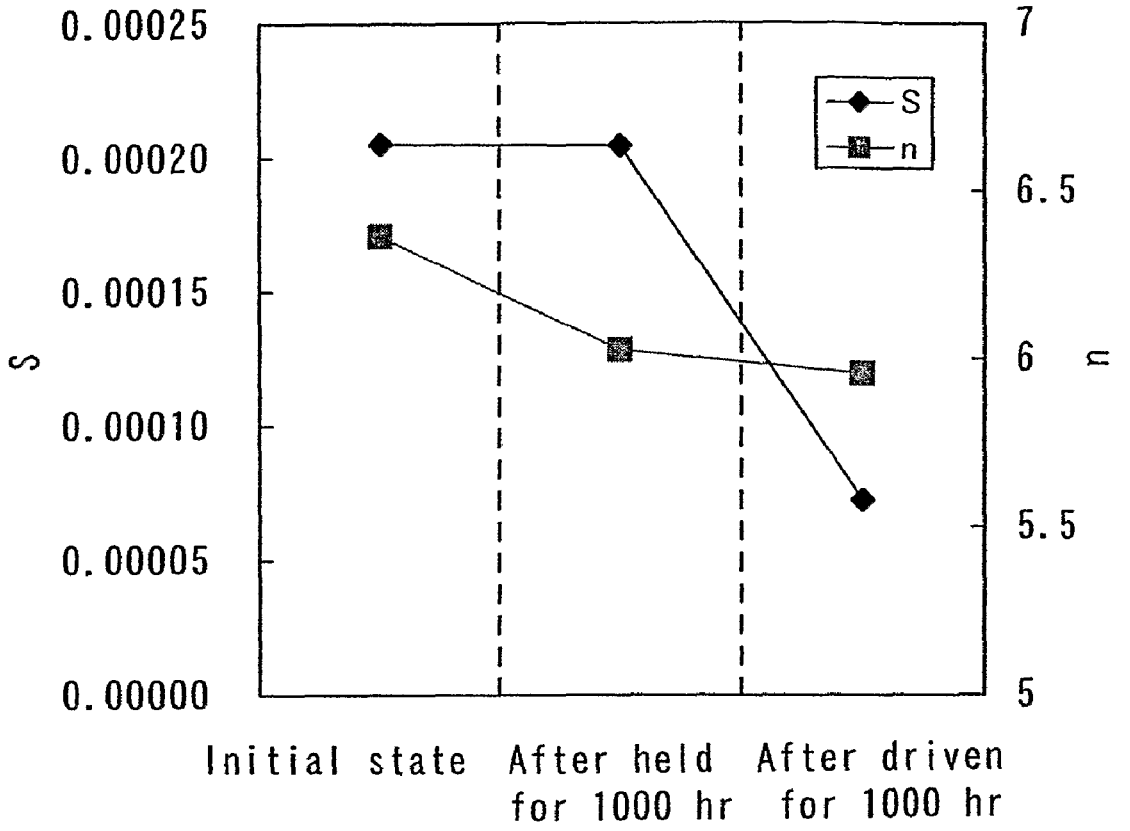
FIG. 5 is a graph showing changes in parameters n and S based on the formula (2).

FIG. 5 shows changes in n and S obtained by the graph of FIG. 4. The graph of FIG. 5 indicates characteristic changes in parameters of n and S based on the formula (2). The value of S does not vary when the light emitting element is held at room temperature, and drastically decreases when a current is supplied to the light emitting element. On the other hand, the value of n decreases not only when a current is supplied to the light emitting element but also when the light emitting element is held for the same hours at room temperature. The rate of the decrease when a current is supplied to the light emitting element is substantially the same as that when no current is supplied thereto. That is, n is considered to be a parameter that decreases almost exclusively with time regardless of whether a current is supplied or not.

The result shows that n can be represented by the following formula (3) as a function of time.

$$n=f(t) \tag{3}$$

The value of n indicating a precipitous change in diode characteristics shows that diode characteristics of the light emitting element change (the value of n decreases and the slope descends) with time regardless of whether a current is supplied or not.

On the other hand, S is a parameter that hardly changes when the light emitting element is held at room temperature and changes when a current is supplied thereto. The value of S that is independent of time and varies with current can be represented as a function of the total amount of charge Q (current×time), and the following formula can be obtained.

$$S=g(Q) \tag{4}$$

Since the value of S decreases when a current is supplied to the light emitting element, g (Q) is considered to be a monotonically decreasing function. The value of S can be considered to be the threshold of diode characteristics. Therefore, it can be explained that the threshold of diode characteristics of the light emitting element is shifted to a higher voltage side when a current is supplied thereto.

From the formulas (1), (3) and (4), current density-voltage characteristics of the monitoring light emitting element and current density-voltage characteristics of the displaying light emitting element can be represented by the following formulas, where Jo is current density (constant) of the monitoring light emitting element, Jp is current density of a pixel, Qm is the total amount of charge flowing through the monitoring light emitting element, Qp is the total amount of charge flowing through the pixel, V is voltage, and t is time.

$$Jo=g(Qm)\cdot V^{f(t)} \tag{5}$$

$$Jp=g(Qp)\cdot V^{f(t)} \tag{6}$$

From the formulas (5) and (6), the current density Jp in the pixel can be represented by the following formula.

$$Jp=Jo\cdot g(Qp)/g(Qm) \quad (7)$$

Since g(Q) is a monotonically decreasing function, the values of Jo and Jp differ from each other when the monitoring light emitting element and the displaying light emitting element have different currents. For example, when more current flows through the monitoring light emitting element than through the displaying light emitting element (i.e., Qm>Qp), Jp is always larger than Jo.

The following consideration should be taken in order to ideally perform the CL drive for keeping the luminance of the displaying light emitting element constant. First, the following formula can be obtained when the luminance of a pixel is L and current efficiency is η.

$$L=\eta\cdot Jp \quad (8)$$

When the initial luminance is Lo and the initial current density is Jo, the current efficiency η is represented by the following degradation curve where k is a rate constant and η is a parameter indicating the initial degradation.

$$\eta=(Lo/Jo)\cdot\exp\{-(k\cdot t)\eta\} \quad (9)$$

As a result, the following formula (10) can be obtained from the formulas (8) and (9).

$$L=Jp\cdot(Lo/Jo)\cdot\exp\{-(k\cdot t)\eta\} \quad (10)$$

In order to maintain the luminance constant, L=Lo (constant) should be satisfied. Thus, when L=Lo is substituted in the formula (10), the following formula (11) can be obtained.

$$Jp=Jo\cdot\exp\{(k\cdot t)\eta\} \quad (11)$$

That is, the CL drive can be achieved by increasing the value of Jp in accordance with the formula (11). Finally, the following formula (12) can be obtained from the formulas (7) and (11).

$$g(Qp/g(Qm)=\exp\{(k\cdot t)\eta\} \quad (12)$$

Thus, the CL drive can be achieved by controlling the values of Qp and Qm so that g (Qp)/g(Qm) is close to exp{(k·t)η}.

When luminance degradation is thus considered based on the amount of charge flowing through the light emitting element, the CL drive can be performed where the amount of charge flowing through the displaying light emitting element is compared with the amount of charge flowing through the monitoring light emitting element, and the luminance of the displaying light emitting element is corrected to be constant.

An example of the operation of a display device provided with a monitoring light emitting element and a displaying light emitting element according to the invention is described with reference to FIGS. 6A and 6B.

Figure 6A:
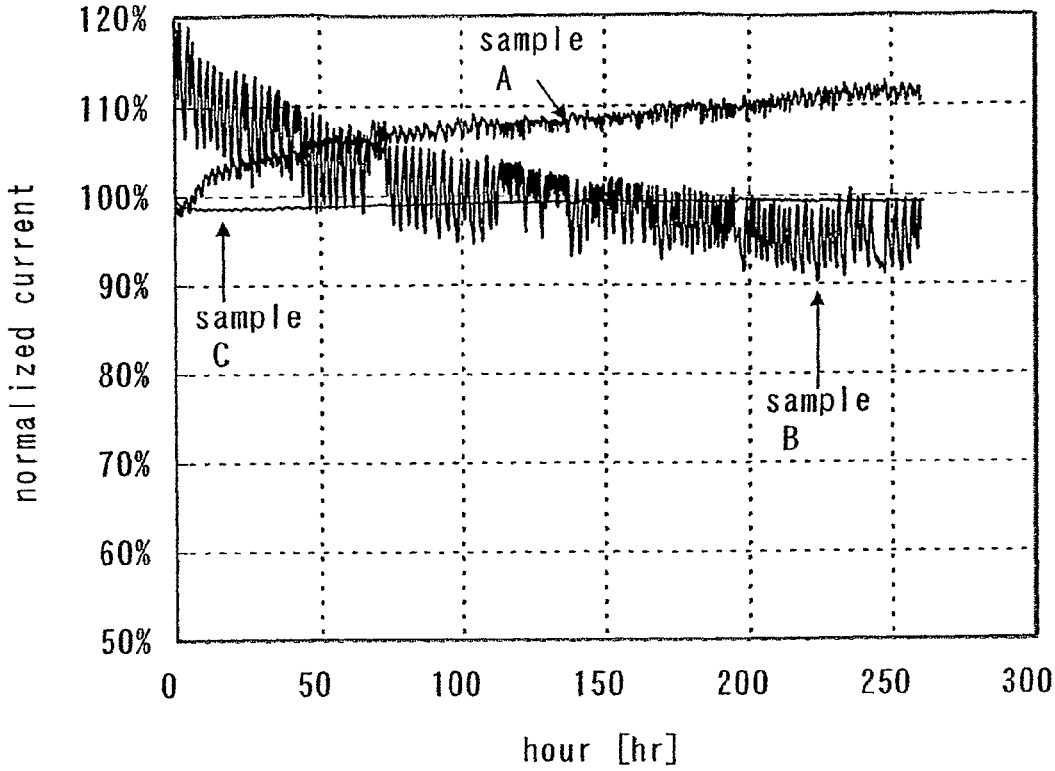
FIG. 6A is a graph showing time-varying characteristics of the current value of a light emitting element.
Figure 6B:
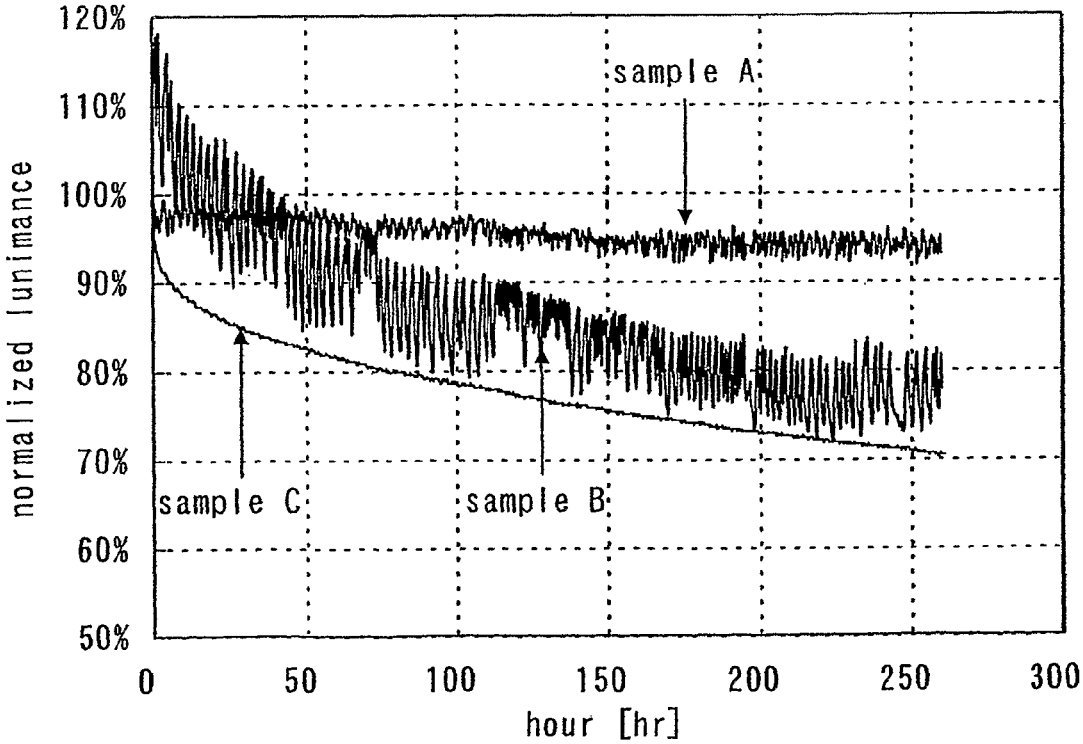
FIG. 6B is a graph showing time-varying characteristics of the luminance of a light emitting element.

FIG. 6A shows the time-varying characteristics of the current value of a light emitting element (260 hours) while FIG. 6B shows the time-varying characteristics of the luminance of a light emitting element (260 hours). In the graphs of FIGS. 6A and 6B, a sample A is a panel having the compensation function of the invention whereas a sample B and a sample C are panels having no compensation function. The samples A and B are driven with a constant voltage and the sample C is driven with a constant current.

In the graphs of FIGS. 6A and 6B, the abscissa represents time (hour). The ordinate in FIG. 6A represents a normalized value (%) of the actual current value while the ordinate in FIG. 6B represents a normalized value (%) of the actual luminance. Note that in all the samples, the duty ratio of a monitoring light emitting element is 100% whereas the duty ratio of a displaying light emitting element is about 64%. The monitoring light emitting element and the displaying light emitting element have the same total amount of current but different instantaneous current values.

FIG. 6A shows that the current value of the sample A tends to increase with time, the current value of the sample B fluctuates considerably and tends to decrease with time, and the current value of the sample C hardly fluctuates and is kept substantially constant after the elapse of time. The reason why the current value of the sample A tends to increase with time is because the monitoring light emitting element has a duty ratio of 100% while the displaying light emitting element has a duty ratio of 64% and thus changes with time of the monitoring light emitting element progress more rapidly than changes with time of the light emitting element.

FIG. 6B shows that the luminance of the sample A hardly fluctuates and is kept substantially constant after the elapse of time, the luminance of the sample B fluctuates considerably and tends to decrease with time, and the luminance of the sample C hardly fluctuates though tends to decrease with time similarly to the sample B.

From the results shown in FIGS. 6A and 6B, it can be found that the sample A using the invention has a constant luminance though the current value thereof increases. This is because changes with time progress more rapidly by an increase +Δ in current though the current value increases. That is to say, the increase +Δ in current due to a compensation function is almost equal to the decrease in current due to changes with time. Accordingly, the luminance of the sample A using the invention can be kept substantially constant.

In view of the aforementioned operation, the display device having the compensation function of the invention can have a constant luminance. The compensation function of the invention enables the CL drive. According to such a driving method, as set forth above, an increase in current due to the compensation function and a decrease in current due to changes with time are obtained in advance, and a light emitting element is driven at a voltage such that the increase is equal to the decrease.

Embodiment 1

An example of a display device provided with a monitoring light emitting element and performing the CL drive is described with reference to FIG. 7.

Figure 7:
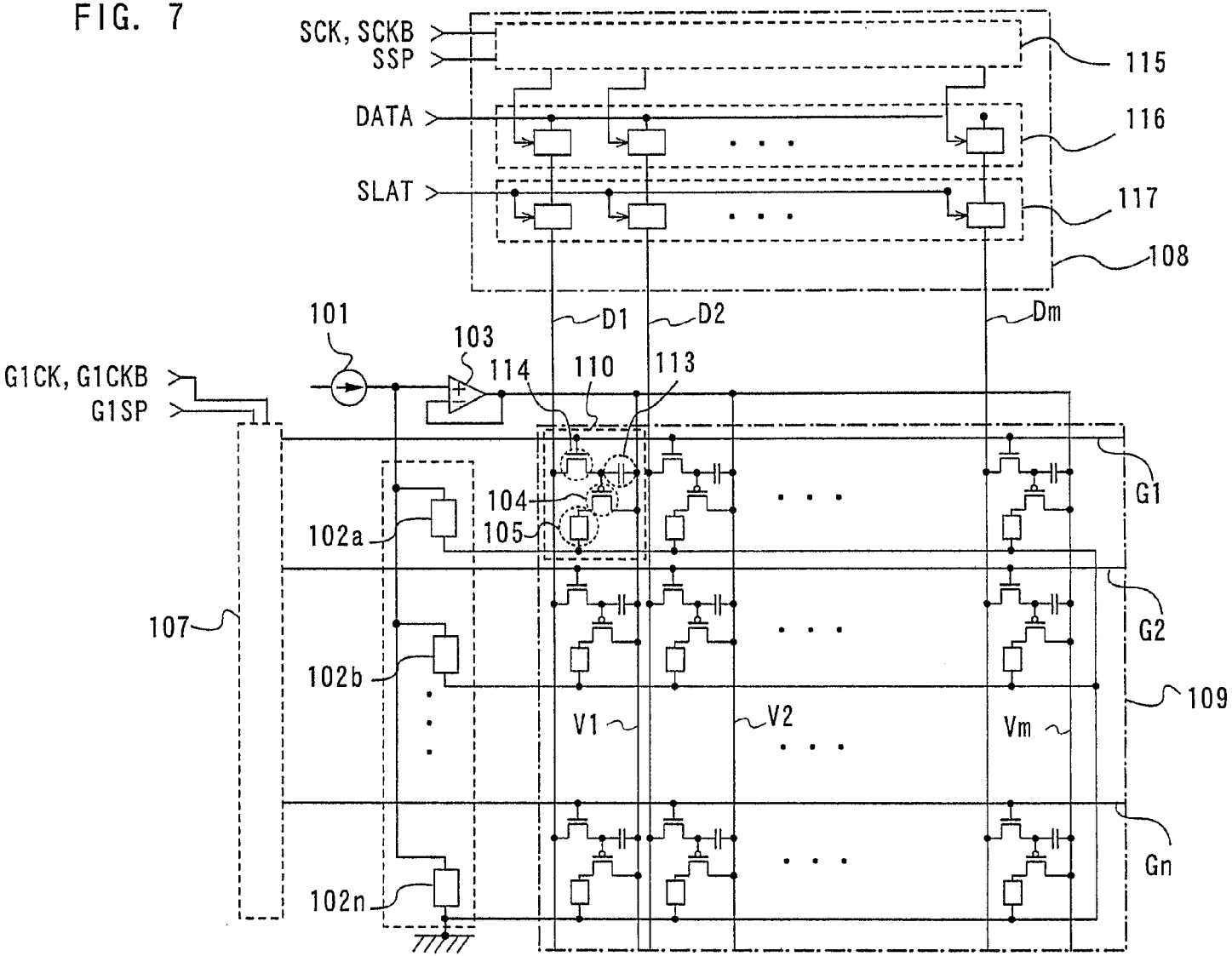
FIG. 7 is a diagram showing a configuration example of a display device according to the invention, which is provided with a displaying light emitting element and a monitoring light emitting element and performs the CL drive.

A display device shown in FIG. 7 includes the scan line driver circuit 107, the data line driver circuit 108 and the display portion 109. The display portion 109 includes the pixel 110 where a switching transistor 114, the driving transistor 104, a capacitor 113, and the displaying light emitting element 105 are provided.

The data line driver circuit 108 includes a pulse output circuit 115, a first latch circuit 116 and a second latch circuit 117. In this data line driver circuit 108, data can be outputted from the second latch circuit 117 at the same time as data is inputted to the first latch circuit 116.

The display portion 109 includes scan lines G1 to Gn connected to the scan line driver circuit 107 and data signal lines D1 to Dm connected to the data line driver circuit 108. The scan line G1 to which a signal is inputted from the scan line driver circuit 107 transmits the signal to a gate electrode of the switching transistor 114 in the pixel 110. The switching transistor 114 selected by the scan line G1 is turned on, and a data signal outputted from the second latch circuit 117 to the data signal line D1 is written to the capacitor 113. The data signal written to the capacitor 113 operates the driving transistor 104, and light emission or non-light emission of the displaying light emitting element 105 is controlled. That is to say, the potential of power supply lines V1 to Vm is supplied to the displaying light emitting element 105 through the driving transistor 104 that is on; thereby light emission or non-light emission of the displaying light emitting element 105 is controlled.

The number of the monitoring light emitting elements 102 can be selected arbitrarily. One or more monitoring light emitting elements may be provided. The display device shown in FIG. 7 has n (n>1) monitoring light emitting elements 102*a* to 102*n*, which are equal to the number of rows of pixels. The n monitoring light emitting elements 102*a* to 102*n* allow variations in characteristics of the monitoring light emitting elements to be averaged.

The monitoring light emitting elements 102*a* to 102*n* in FIG. 7, which are connected in parallel to each other, are connected to the current source 101. The displaying light emitting element 105 emits light or no light depending on the data signal, while the monitoring light emitting elements 102*a* to 102*n* are driven with a constant current and emit light all the time. The voltage generating circuit 103 detects the potential of an electrode of the respective monitoring light emitting elements 102*a* to 102*n*, which is connected to the current source 101, and determines the potentials of the power supply lines V1 to Vm. The voltage generating circuit 103 is typically configured by a voltage follower circuit.

According to this configuration, when the temperature of the display device changes while the monitoring light emitting elements 102*a* to 102*n* are driven with a constant current, the resistance value of each of the monitoring light emitting elements 102*a* to 102*n* varies. With the change in the resistance value, the potential between two electrodes of each of the monitoring light emitting elements 102*a* to 102*n* varies. The potential that has changed is detected by the voltage generating circuit 103, and a driving voltage corresponding to the change in temperature can be applied to the displaying light emitting element 105. Also in the case where light emitting properties of the monitoring light emitting elements 102*a* to 102*n* change due to changes with time, the resistance value of each of the monitoring light emitting elements 102*a* to 102*n* varies. Therefore, the driving voltage of the displaying light emitting element 105 can be determined taking into consideration changes due to degradation. According to such an operation, the CL drive of the displaying light emitting element 105 can be performed.

The display portion 109 can be configured by the displaying light emitting element 105 that emits white light. At this time, the monitoring light emitting elements 102*a* to 102*n* are also configured by white light emitting elements. Alternatively, the display portion 109 may be configured by combining a plurality of displaying light emitting elements that emit different color lights. For example, the display portion 109 may be configured by combining light emitting elements that emit red (R), green (G) and blue (B) lights, or lights of substantially the same colors.

Figure 8:
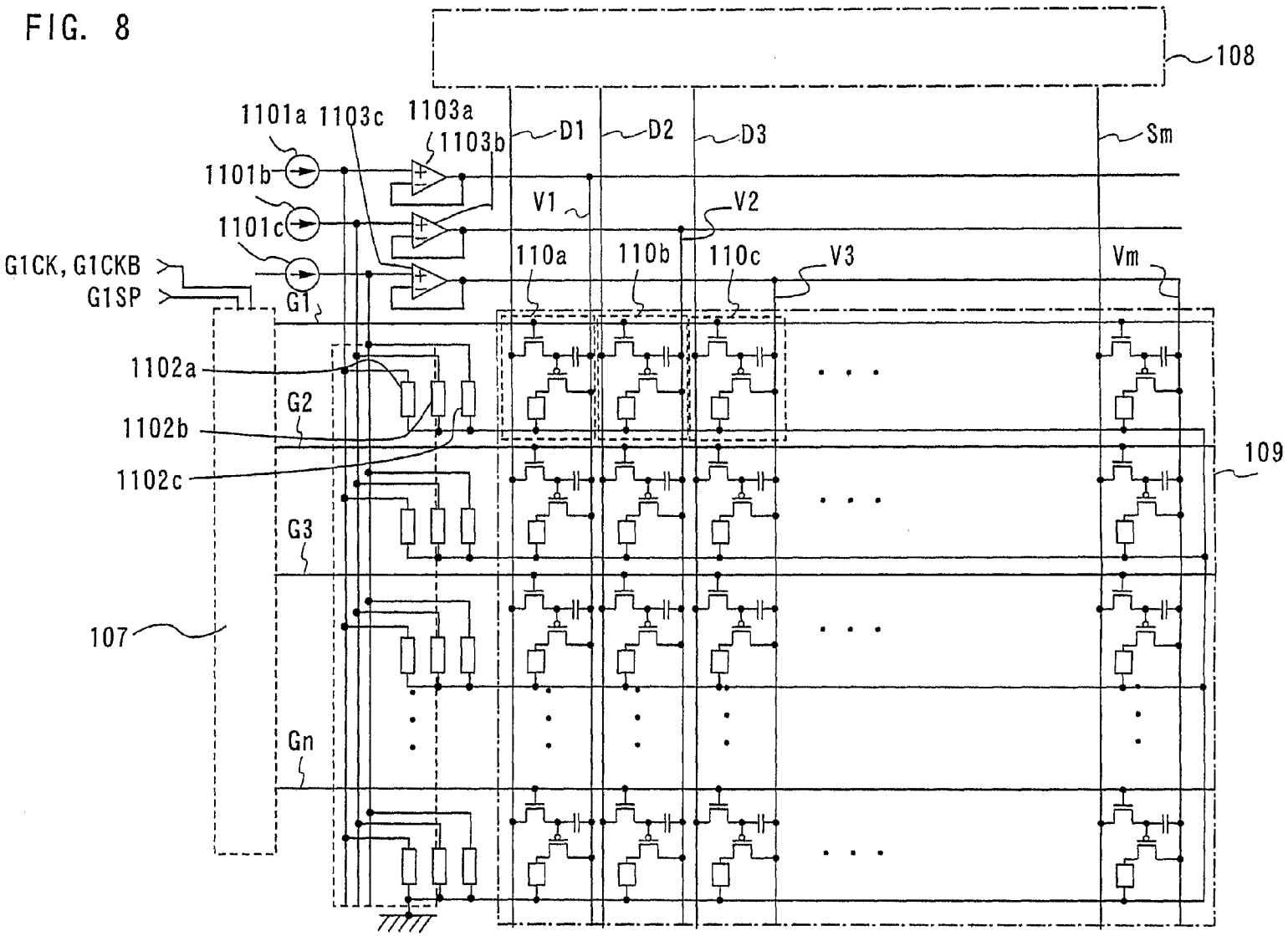
FIG. 8 is a diagram showing a configuration example of a display device according to the invention, which is provided with a displaying light emitting element and a monitoring light emitting element and performs the CL drive.

FIG. 8 shows an example of a display device having monitoring light emitting elements corresponding to each emission color. A pixel 110*a* connected to the data signal line D1 emits red (R) light, a pixel 110*b* connected to the data signal line D2 emits green (G) light, and a pixel 110*c* connected to the data signal line D3 emits blue (B) light. A first current source 1101*a* supplies a current to a monitoring light emitting element 1102*a*, and a first voltage generating circuit 1103*a* detects the potential of the monitoring light emitting element 1102*a* to input the detected potential to the power supply line V1. A second current source 1101*b* supplies a current to a monitoring light emitting element 1102*b*, and a second voltage generating circuit 1103*b* detects the potential of the monitoring light emitting element 1102*b* to input the detected potential to the power supply line V2. A third current source 1101*c* supplies a current to a monitoring light emitting element 1102*c*, and a third voltage generating circuit 1103*c* detects the potential of the monitoring light emitting element 1102*c* to input the detected potential to the power supply line V3. According to such a configuration, the driving voltages of the displaying light emitting elements corresponding to each emission color can be determined in accordance with the corresponding monitoring light emitting elements. Note that the other configurations of the display device shown in FIG. 8 and the operation thereof are similar to those shown in FIG. 7.

Figure 9A:
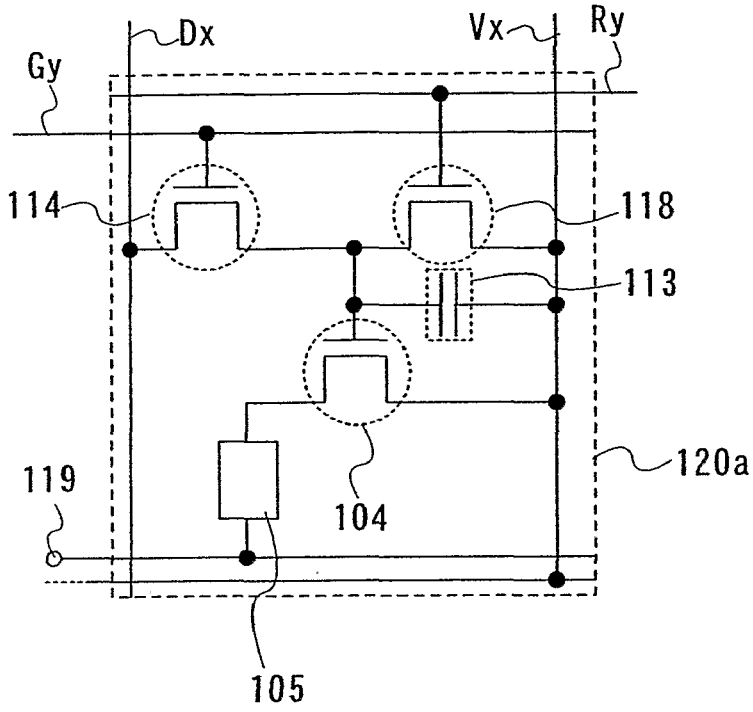
FIGS. 9A and 9B are diagrams each showing a configuration of a pixel circuit that can be applied to a display device according to the invention.
Figure 9B:
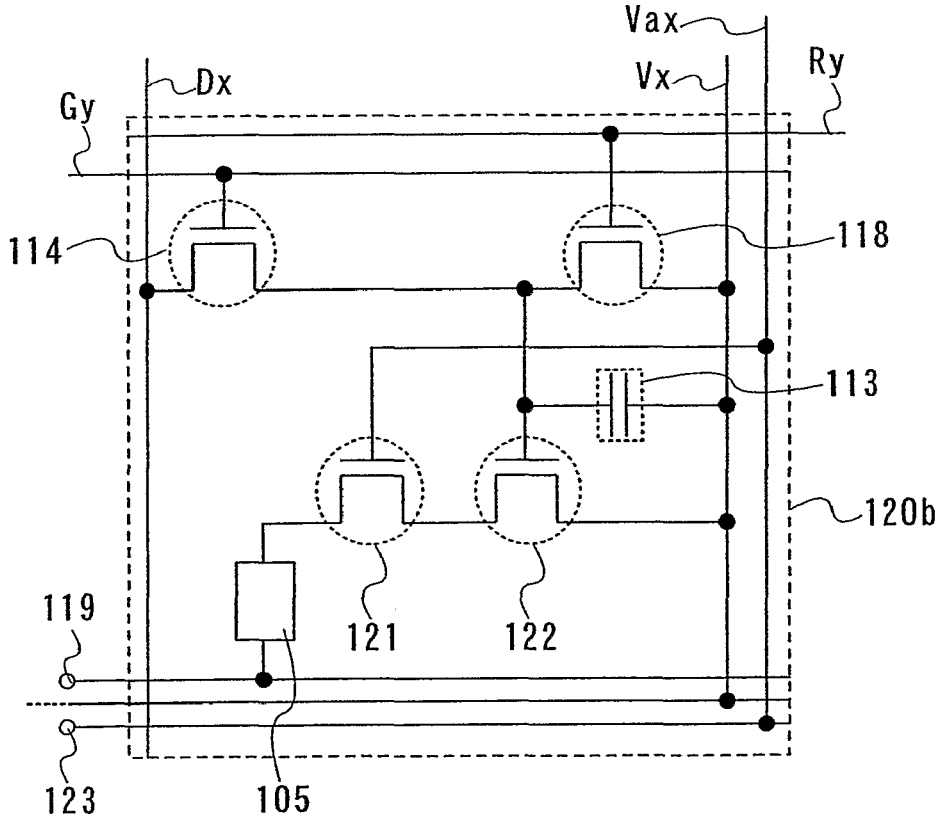

FIGS. 9A and 9B show other configuration examples that can be applied to the pixel 110 of the display devices shown in FIGS. 7 and 8. A pixel 120*a* shown in FIG. 9A includes an erasing transistor 118 and a gate line Ry for erasing in addition to the switching transistor 114 and the driving transistor 104. One electrode of the displaying light emitting element 105 is connected to the driving transistor 104 while the other is connected to an opposite power supply 119. The erasing transistor 118 allows current supply to the displaying light emitting element 105 to be forcibly stopped; therefore, a lighting period can be provided at the same time or immediately after a writing period of a data signal without waiting for a signal to be written to the pixel 110. As a result, the duty ratio can be improved and a lighting period and a non-lighting period can be forcibly controlled, which is suitable for moving image display in particular.

FIG. 9B shows a configuration of a pixel 120*b* where a transistor 121 and a transistor 122 are connected in series to function as a driving transistor, and a gate electrode of the transistor 121 is connected to a power supply line Vax (x is a natural number, 1=x=m). The power supply line Vax is connected to a power supply 123. In this pixel 120*b*, the gate electrode of the transistor 121 is connected to the power supply line Vax with a fixed potential, and thus the gate potential of the transistor 121 is fixed so that the transistor 121 is operated in the saturation region. Since the transistor 122 is operated in the linear region, a gate electrode thereof is inputted with a video signal having data on light emission or non-light emission of the pixel 120*b*. The transistor 122 operated in the linear region has a small source-drain voltage; therefore, a slight fluctuation in the gate-source voltage of the transistor 122 does not influence a current value flowing through the displaying light emitting element 105. Accordingly, a current value flowing through the displaying light emitting element 105 is determined by the transistor 122 operated in the saturation region. According to such a configuration, luminance unevenness of the displaying light emitting element 105 due to variations in characteristics of the transistor 121 can be improved, leading to increased image quality.

As another pixel circuit, the switching transistor 114 may be omitted to configure a pixel by the driving transistor 104 and the displaying light emitting element 105. In this case, the pixel is operated in the same manner as a passive matrix display.

As set forth above, in the display device, a compensation circuit for changes in temperature and luminance degradation is configured by the current source, the monitoring light emitting element and the voltage generating circuit. That is to say, the displaying light emitting element and the monitoring light emitting element that have the similar characteristics are operated under different driving conditions, and the ratio of the total amount of charge flowing through the displaying light emitting element to that flowing through the monitoring light emitting element can be controlled so as to satisfy a certain relation in view of luminance degradation.

In this embodiment, the amount of charge flowing through the displaying light emitting element is compared to that flowing through the monitoring light emitting element; thereby the luminance of the displaying light emitting element is corrected to be constant. For example, when the monitoring light emitting element is driven with a constant current with a duty ratio of 50 to 100% and the driving voltage of the displaying light emitting element is determined by the voltage generating circuit in accordance with the potential difference of the monitoring light emitting element at this time, Qp and Qm can be controlled so that g(Qp)/g(Qm) is close to $\exp\{(k\cdot t)\eta\}$ as represented by the formula (12). As a result, the CL drive where the luminance of the displaying light emitting element is kept constant can be performed.

Embodiment 2

This embodiment shows another configuration example of a display device performing the CL drive by combining a monitoring light emitting element and a displaying light emitting element.

In this embodiment, the amount of current, namely the amount of charge of a monitoring light emitting element is determined taking into consideration the average lighting period of a displaying light emitting element in a pixel. It is experimentally known that the average ratio of a lighting period to a non-lighting period of a displaying light emitting element in each pixel is 3:7. By adjusting a lighting period of the monitoring light emitting element, the amount of charge Qm of the monitoring light emitting element and the amount of charge Qp of the displaying light emitting element can be controlled so that g(Qp)/g(Qm) is close to $\exp\{(k\cdot t)\eta\}$ as represented by the formula (12). The duty ratio of the monitoring light emitting element may be set to 50 to 100%.

Figure 10:
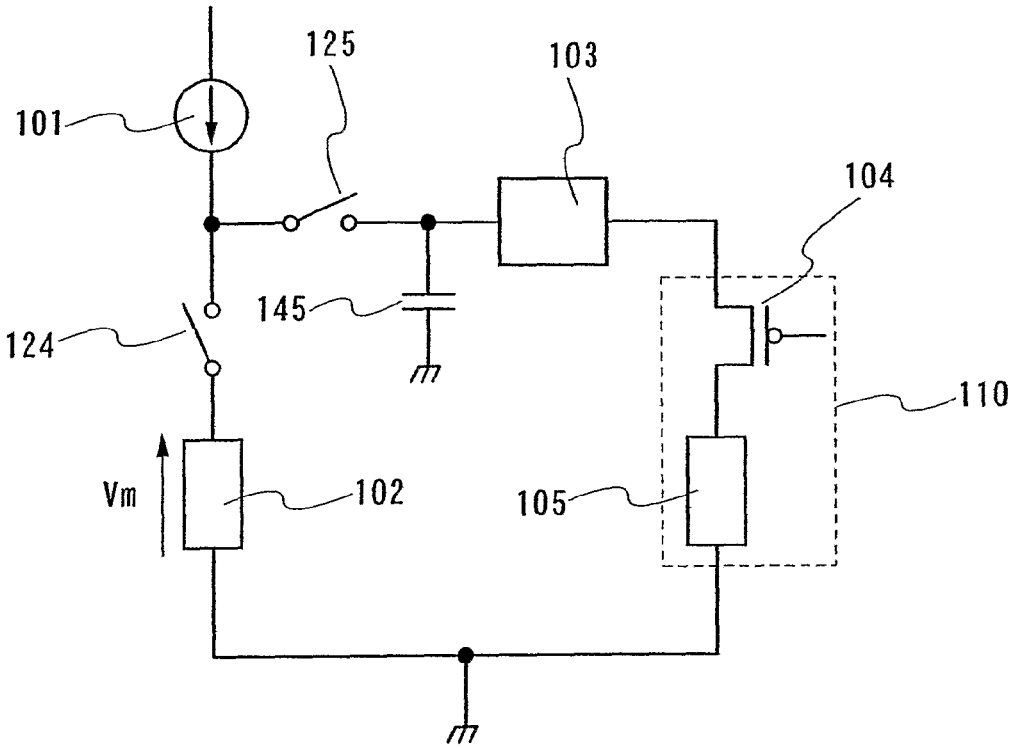
FIG. 10 is a diagram showing an example of a display device according to the invention, which is provided with a displaying light emitting element and a monitoring light emitting element and performs the CL drive.

FIG. 10 shows an example of a compensation circuit for controlling a lighting period of a monitoring light emitting element. This compensation circuit includes the current source 101, the monitoring light emitting element 102, the voltage generating circuit 103, a capacitor 145, a first switch 124, and a second switch 125. The output of the voltage generating circuit 103 is inputted to the displaying light emitting element 105 through the driving transistor 104.

When a current is supplied from the current source 101 to the monitoring light emitting element 102, the first switch 124 and the second switch 125 are turned on. By supplying a current to the monitoring light emitting element 102 in this state, charges are accumulated in the capacitor 145 up to a voltage Vm applied to the monitoring light emitting element 102. Then, the second switch 125 is turned off at the same time or before the first switch 124. Thus, the voltage Vm applied to the monitoring light emitting element 102 when the second switch 125 is turned off is inputted to the voltage generating circuit 103. The voltage generating circuit 103 outputs the same potential as the inputted potential. The driving voltage of the displaying light emitting element 105 is determined in accordance with the outputted potential.

Also in a non-lighting period, the voltage Vm of the monitoring light emitting element 102 when the second switch 125 is turned off is inputted to the voltage generating circuit 103. Then, the same potential is outputted from the voltage generating circuit 103; thereby the current flowing through the monitoring light emitting element 102 when the second switch 125 is turned off can be supplied to the displaying light emitting element 105.

According to such a configuration, the duty ratio of the monitoring light emitting element 102 can be controlled in the range of 50 to 100%. Since changes in temperature can be compensated during a period when a current is supplied to the monitoring light emitting element, both degradation compensation and temperature compensation can be achieved.

It is experimentally known that the ratio of a lighting period to a non-lighting period of a displaying light emitting element in one frame period is 3:7 in the case of performing a time gray scale display. Accordingly, if a current keeps flowing during a display period, the ratio of the amount of charge flowing through the monitoring light emitting element 102 to that flowing through the displaying light emitting element 105 is 10:3. Thus, by supplying a current to the monitoring light emitting element 102 during 50 to 100% of one frame period, the ratio of the amount of charge Qm of the monitoring light emitting element to the amount of charge Qp of the displaying light emitting element can be controlled to be $\exp\{(k\cdot t)\eta\}$.

If several kinds of displaying light emitting elements that emit different color lights are provided in a display portion, monitoring light emitting elements may be provided in accordance with the displaying light emitting elements. Particularly in the case where the several kinds of displaying light emitting elements have different temperature characteristics, degradation rates and lifetimes, the CL drive can be performed by providing the monitoring light emitting elements corresponding to the displaying light emitting elements. In addition, when a lighting period of each monitoring light emitting element is determined depending on the average duty ratio for each emission color, the accuracy of the CL drive can be further improved.

As set forth above, in the display device, a compensation circuit for changes in temperature and luminance degradation is configured by the current source, the monitoring light emitting element and the voltage generating circuit. That is to say, the displaying light emitting element and the monitoring light emitting element that have the similar characteristics are operated under different driving conditions, and the ratio of the total amount of charge flowing through the displaying light emitting element to that flowing through the monitoring light emitting element can be controlled so as to satisfy a certain relation in view of luminance degradation. As a result, the CL drive where the luminance of the displaying light emitting element is kept constant can be performed.

Embodiment 3

This embodiment shows a configuration example of a display device performing the CL drive by combining a monitoring light emitting element and a displaying light emitting element, where a correction function of the monitoring light emitting element can be maintained for a long time.

Figure 11:
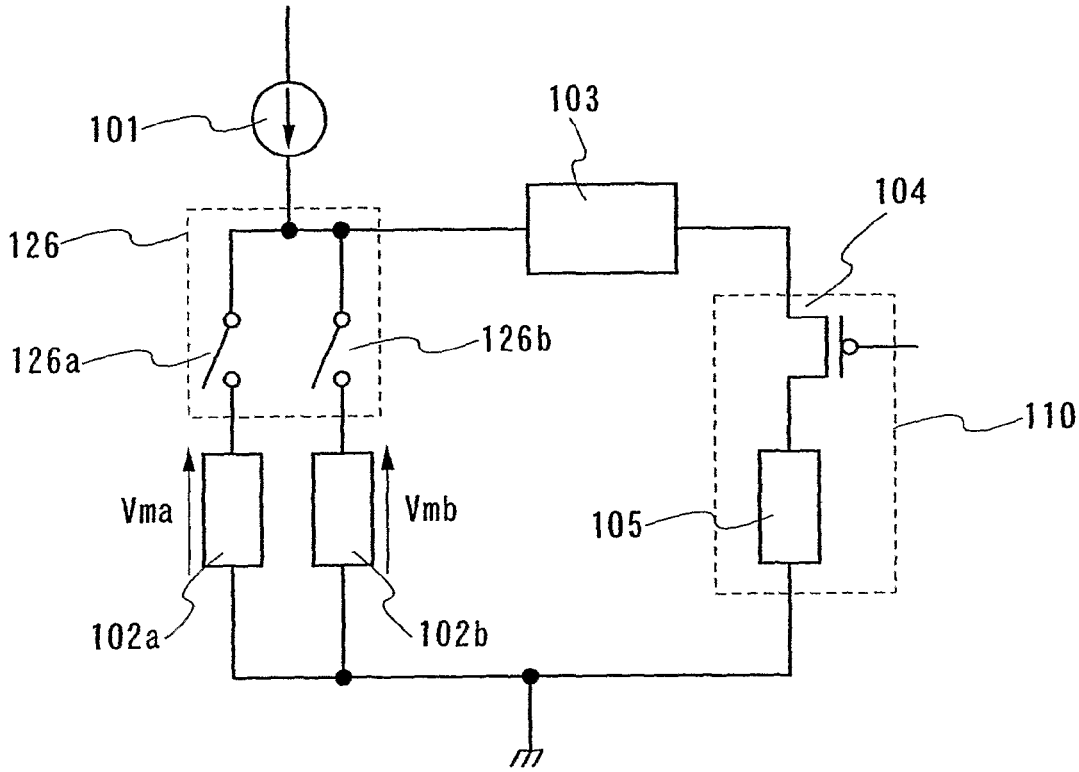
FIG. 11 is a diagram showing a configuration of a display device according to the invention, which is provided with a displaying light emitting element and a monitoring light emitting element.

FIG. 11 shows an example of a compensation circuit for correcting degradation with time of a monitoring light emitting element. This compensation circuit includes the current source 101, the monitoring light emitting element 102*a*, the monitoring light emitting element 102*b*, the voltage generating circuit 103, and a switch circuit 126 having a switch 126*a* and a switch 126*b*. The output of the voltage generating circuit 103 is inputted to the displaying light emitting element 105 through the driving transistor 104.

The switch 126*a* and the switch 126*b* switch a connection with the current source 101 between the monitoring light emitting element 102*a* and the monitoring light emitting element 102*b*, respectively. By operating the switch 126*a* and the switch 126*b*, a current from the current source 101 can be alternately supplied to the monitoring light emitting element 102*a* and the monitoring light emitting element 102*b*. At this time, the voltage generating circuit 103 detects a potential Vma applied to the monitoring light emitting element 102*a* or a potential Vmb applied to the monitoring light emitting element 102*b*, and the driving voltage of the displaying light emitting element 105 can be determined in accordance with the detected potential.

The rate of degradation with time of the monitoring light emitting element 102*a* and the monitoring light emitting element 102*b* can be adjusted by arbitrarily changing the timing of switching between the switch 126*a* and the switch 126*b*. For example, if the switch 126*a* and the switch 126*b* are switched at the same timing, the apparent rate of degradation with time of the monitoring light emitting element 102*a* and the monitoring light emitting element 102*b* is reduced to half. Alternatively, one of the two monitoring light emitting elements may emit light for a longer time, and may be switched to the other at the end of the life of the one monitoring light emitting element. According to this method, the compensation circuit can be operated for a long time.

For example, the monitoring light emitting element 102*a* is driven with a duty ratio of 80% while the monitoring light emitting element 102*b* is driven with a duty ratio of 20%. First, the CL drive is performed with the voltage Vma of the monitoring light emitting element 102*a* used as a correction voltage. When the voltage Vma of the monitoring light emitting element 102*a* rises to a certain level, the monitoring light emitting element 102*b* is changed to be driven with a duty ratio of 80%. After that, the voltage Vmb of the monitoring light emitting element 102*b* is used as a correction voltage for the CL drive. In this manner, the CL drive of the displaying light emitting element 105 can be performed for a long time.

In either case, a current is always supplied to either the monitoring light emitting element 102*a* or the monitoring light emitting element 102*b*, the potential of the monitoring light emitting element supplied with a current is detected, and the driving voltage of the displaying light emitting element is determined; therefore, temperature compensation can also be continuously performed.

Figure 12:
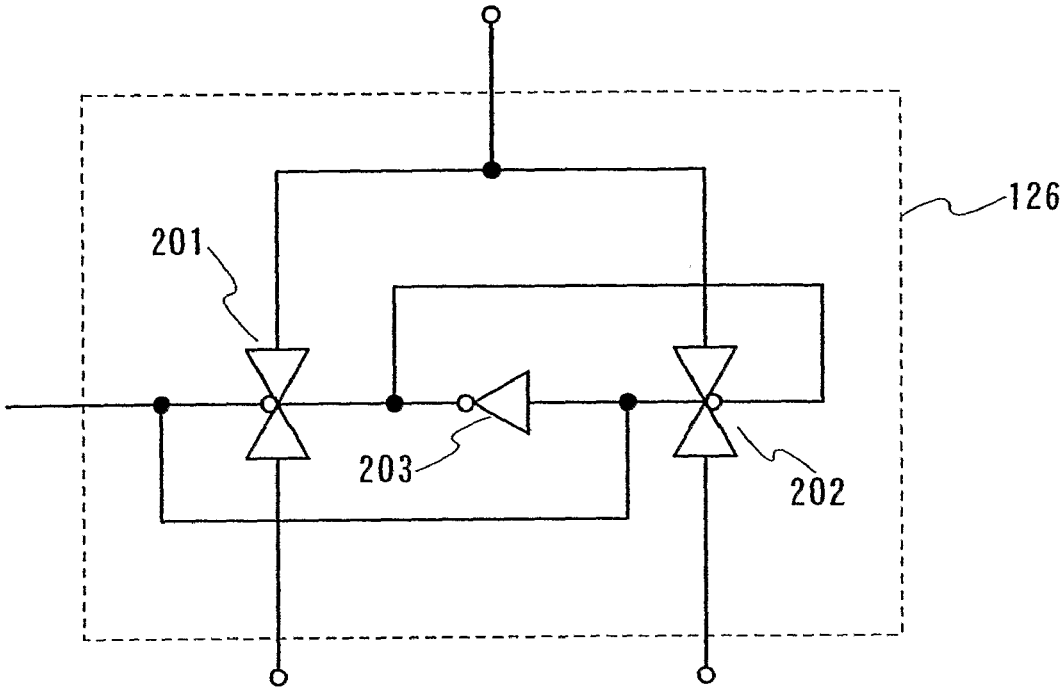
FIG. 12 is a diagram showing a part of a control circuit of a monitoring light emitting element according to the invention.

The switch circuit 126 can be achieved by various means. FIG. 12 shows an example of the switch circuit 126, which is configured by an analog switch 201, an analog switch 202 and an inverter 203. A control signal is inputted to control input terminals of the analog switch 201 and the analog switch 202, one of which is turned on. It can thus be selected which of the monitoring light emitting element 102*a* and the monitoring light emitting element 102*b* is supplied with a current.

Figure 13:
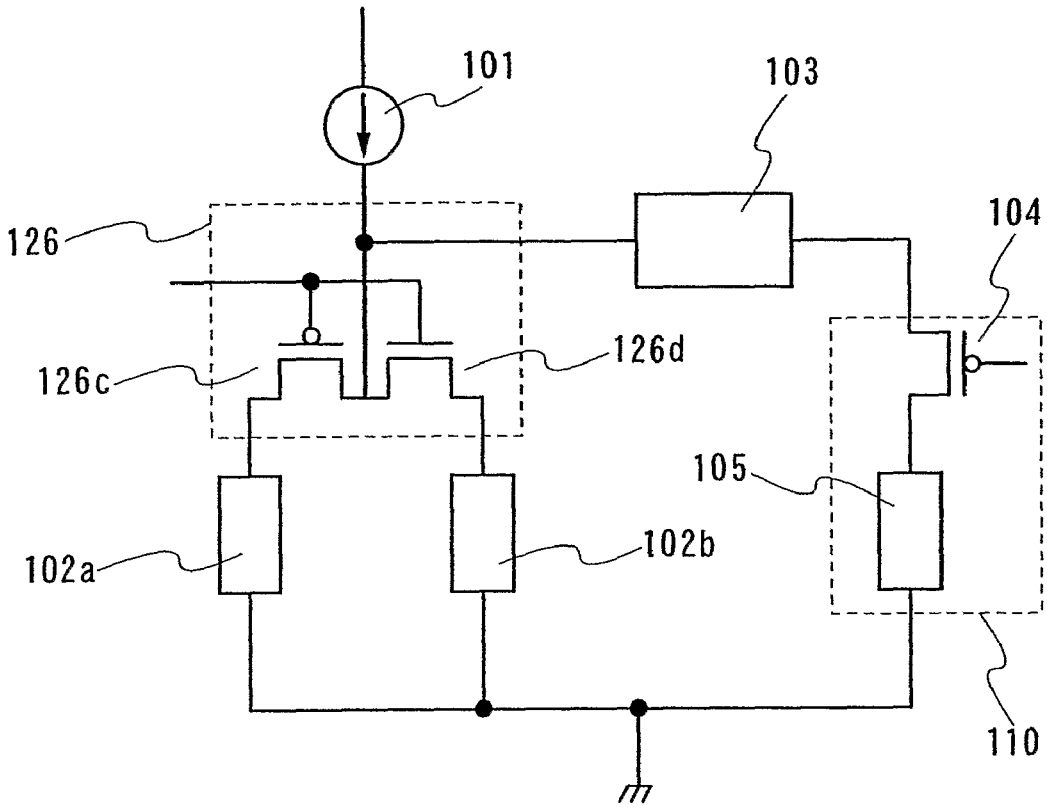
FIG. 13 is a diagram showing a configuration of a display device according to the invention, which is provided with a displaying light emitting element and a monitoring light emitting element.

It is needless to say that the configuration of the switch circuit 126 is not limited to the one shown in FIG. 12, and other configurations can be adopted if the same function is achieved. For example, in a display device, the switch circuit 126 may be configured by transistors as shown in FIG. 13. In FIG. 13, a P-channel switching transistor 126*c* and an N-channel switching transistor 126*d* are used. A source electrode of the P-channel switching transistor 126*c* and a drain electrode of the P-channel switching transistor 126*d* are connected to the current source 101. A drain electrode of the P-channel switching transistor 126*c* is connected to the monitoring light emitting element 102*a* while a source electrode of the N-channel switching transistor 126*d* is connected to the monitoring light emitting element 102*b*. When a control signal is inputted to gate electrodes of the switching transistors 126*c* and 126*d*, one of them is turned on. In this manner, either the monitoring light emitting element 102*a* or the monitoring light emitting element 102*b* can be selected.

Figure 14:
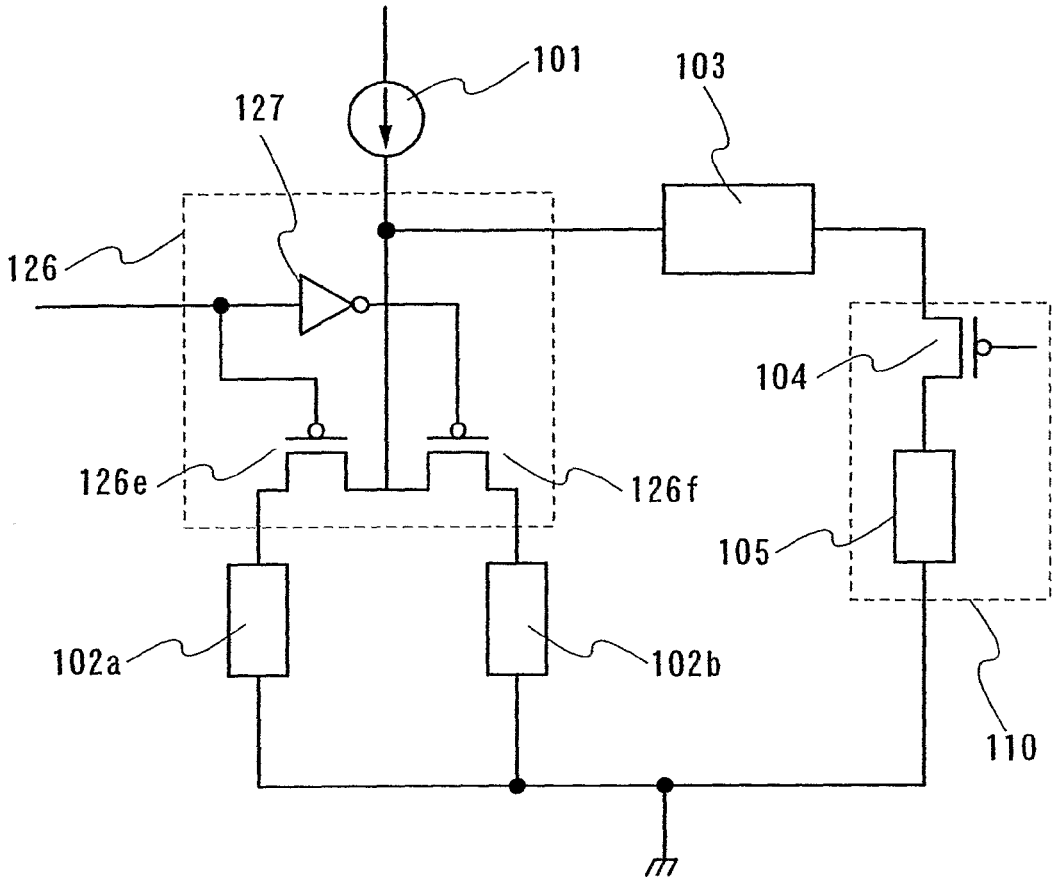
FIG. 14 is a diagram showing a configuration of a display device according to the invention, which is provided with a displaying light emitting element and a monitoring light emitting element.

The switch circuit 126 can also be achieved by using transistors having the same polarity as shown in FIG. 14. A control signal is inputted directly to a gate electrode of one switching transistor 126*e*, while a control signal is inputted to the other switching transistor 126*f* through an inverter 127. As a result, an inverted control signal is inputted to the switching transistor 126*f*; thereby one of the switching transistors 126*e* and 126*f* can be selected. Although the P-channel switching transistors 126*e* and 126*f* are used in FIG. 14, the same function can be achieved by using N-channel transistors.

Figure 15:
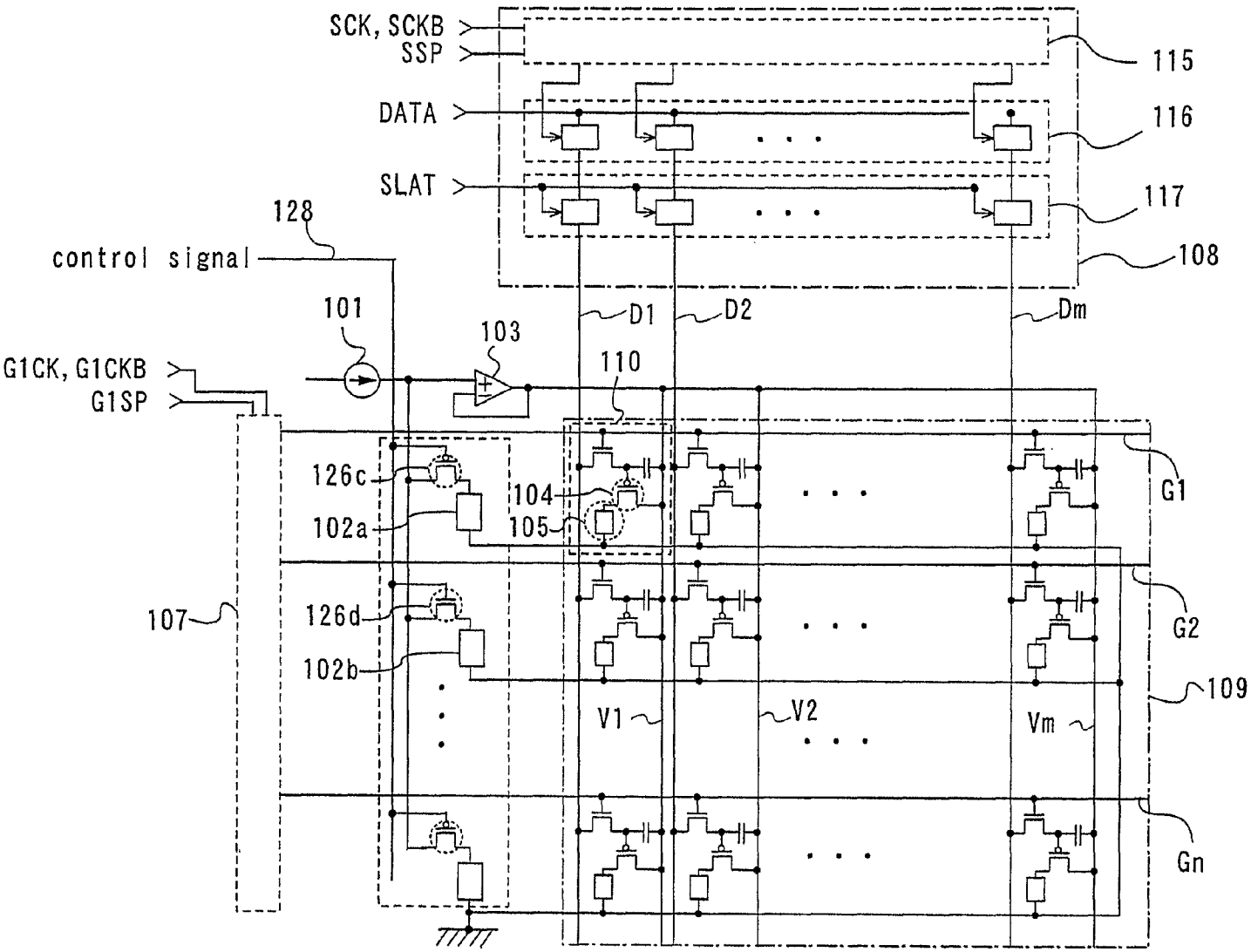
FIG. 15 is a diagram showing a configuration example of a display device according to the invention.

FIG. 15 shows an example of a display device adopting the switch circuit shown in FIG. 13. In the display device, both the switching transistor 126*c* and the switching transistor 126*d* function as a switch circuit. A control signal is inputted from a control line 128 to the gate electrodes of the switching transistors, so that the P-channel switching transistor 126*c* and the N-channel switching transistor 126*d* can be alternately turned on. In other words, a current is alternately supplied to the monitoring light emitting element 102*a* and the monitoring light emitting element 102*b*. The other configurations are similar to those shown in FIG. 7.

Figure 16:
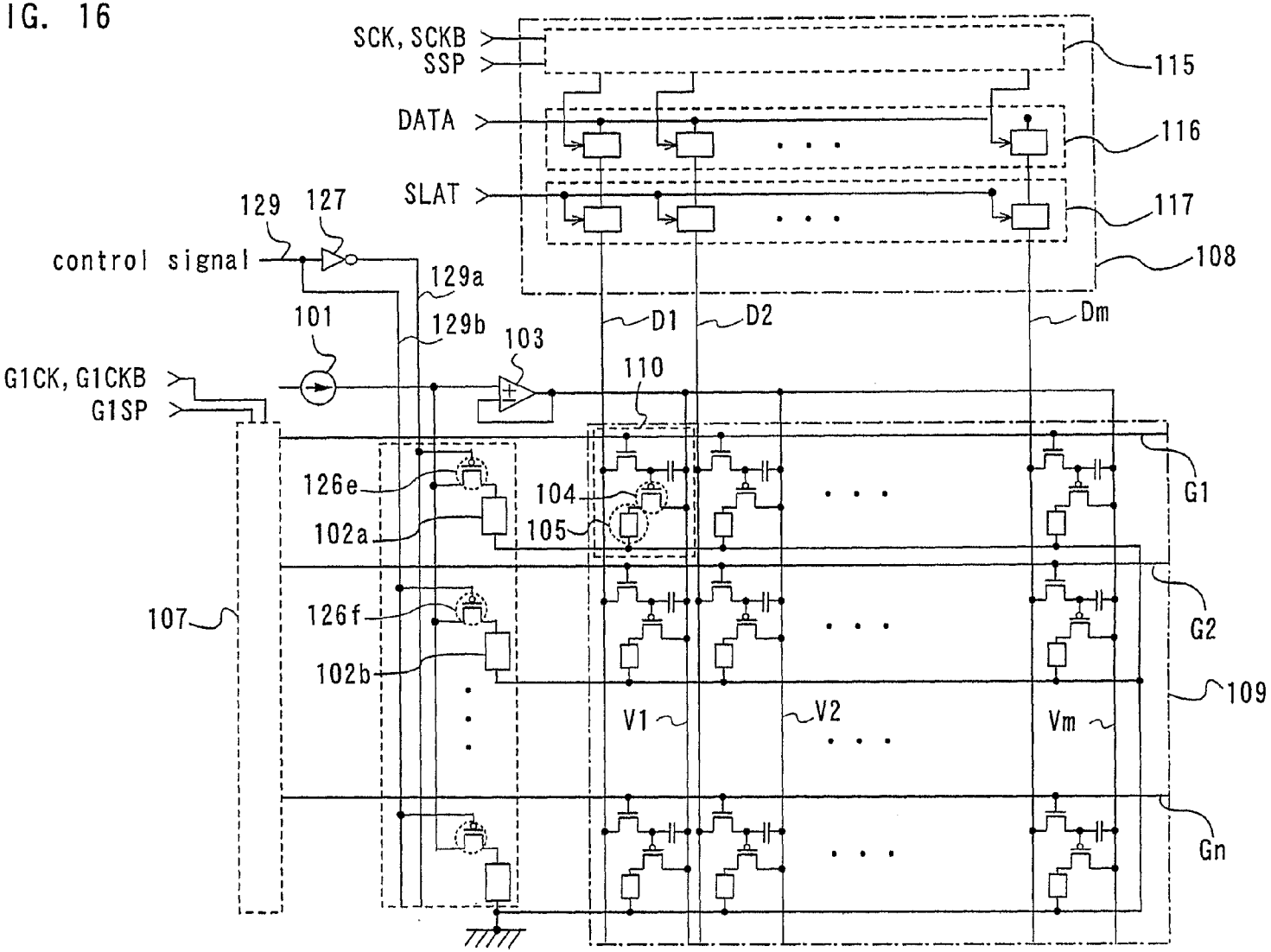
FIG. 16 is a diagram showing a configuration example of a display device according to the invention.

FIG. 16 shows an example of a display device adopting the switch circuit shown in FIG. 14. In the display device, both the switching transistor 126*e* and the switching transistor 126*f* function as a switch circuit. A control signal inputted to a control signal line 129 is transmitted to a control signal line 129*a* and a control signal line 129*b*. At this time, an inverted signal is transmitted to the control signal line 129*a* through the inverter 127. A signal from the control signal line 129*b* is inputted to the gate electrode of the switching transistor 126*e* while a signal from the control signal line 129*b* is inputted to the gate electrode of the switching transistor 126*f*, so that one of the switching transistors is turned on depending on the polarity of the control signal. In other words, a current is alternately supplied to the monitoring light emitting element 102*a* and the monitoring light emitting element 102*b*. The other configurations are similar to those shown in FIG. 7.

The number of monitoring light emitting elements to be selected is not limited two, and three or more monitoring light emitting elements may be arranged in parallel. For example, monitoring light emitting elements for red (R), green (G) and blue (B) may be provided corresponding to emission colors of displaying light emitting elements, and may be arbitrarily switched by switching transistors.

As set forth above, in the display device, a compensation circuit for changes in temperature and luminance degradation is configured by the current source, the plurality of monitoring light emitting elements and the voltage generating circuit. That is to say, the displaying light emitting element and the monitoring light emitting elements that have the similar characteristics are operated under different driving conditions, and the ratio of the total amount of charge flowing through the displaying light emitting element to that flowing through the monitoring light emitting elements can be controlled so as to satisfy a certain relation in view of luminance degradation. As a result, the CL drive where the luminance of the displaying light emitting element is kept constant can be performed.

Embodiment 4

This embodiment shows a CL drive for correction in accordance with changes with time of a light emitting element and an example of a display device performing the CL drive. The description is made with reference to FIG. 17.

Figure 17:
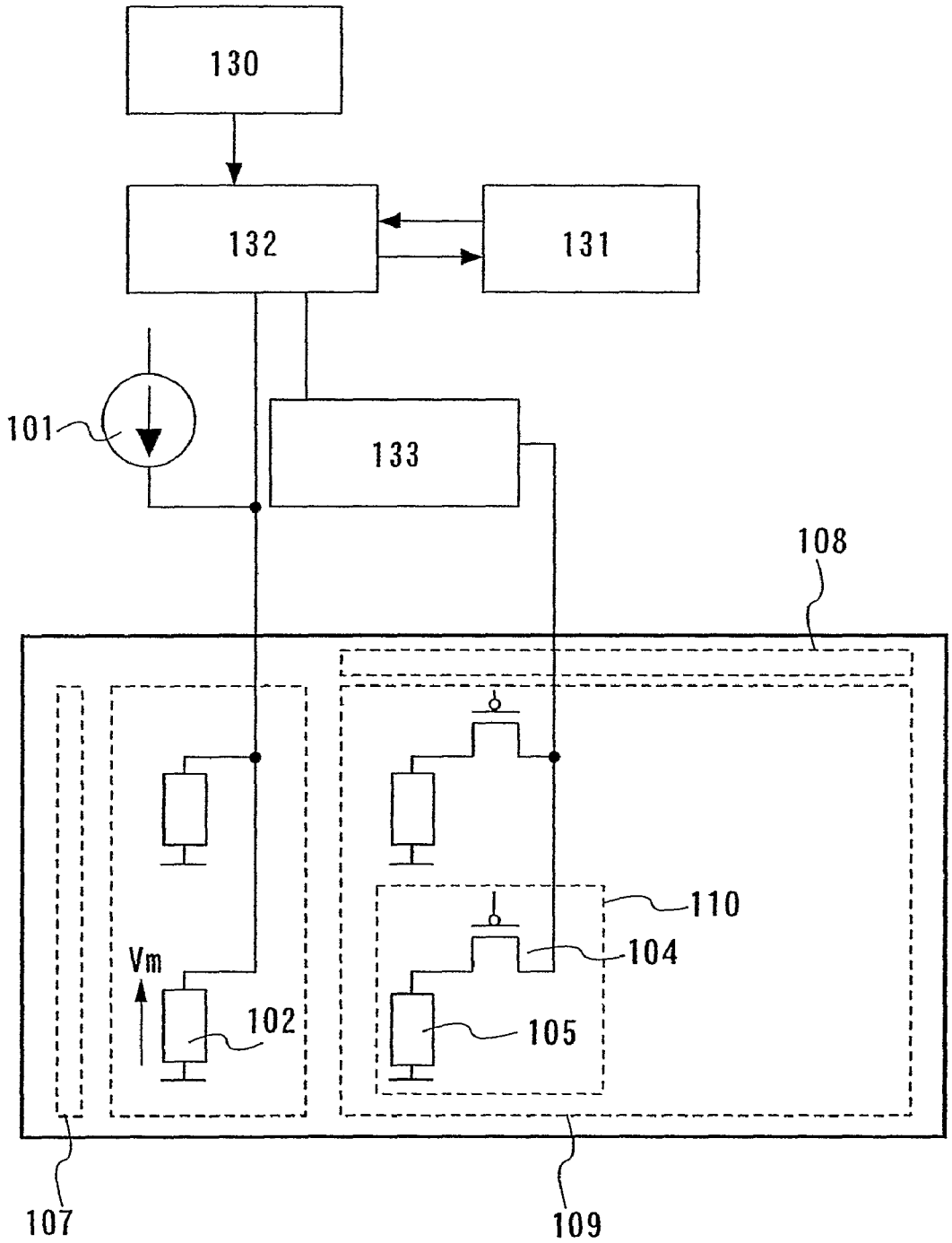
FIG. 17 is a diagram showing a configuration example of a display device according to the invention.

A display device shown in FIG. 17 includes the displaying light emitting element 105 formed in the display portion 109 and the monitoring light emitting element 102. The displaying light emitting element 105 and the monitoring light emitting element 102 are desirably formed in the same manufacturing step. According to this, these light emitting elements 105 and 102 can have similar characteristics in terms of changes in ambient temperature and changes with time.

The display device includes a time measurement circuit 130, a memory circuit 131, a corrected data generating circuit 132, a power supply circuit 133, and the current source 101. These circuits may be formed over the same substrate as the displaying light emitting element 105 and the monitoring light emitting element 102, or may be mounted externally.

The display portion 109 includes the pixel 110 where the displaying light emitting element 105 and the driving transistor 104 are provided. Light emission or non-light emission of the displaying light emitting element 105 is controlled by the scan line driver circuit 107 and the data line driver circuit 108 that are formed over the substrate.

One or more monitoring light emitting elements 102 are provided. The one or more monitoring light emitting elements 102 may be formed in the display portion 109 or other areas. A constant current is supplied from the current source 101 to the monitoring light emitting element 102. When changes in the temperature of the display device and/or changes with time of the light emitting element occur in this state, the resistance value of the monitoring light emitting element 102 itself changes. Since a constant current is supplied to the monitoring light emitting element 102, the voltage Vm applied between two electrodes of the monitoring light emitting element 102 varies. This voltage Vm is inputted to the corrected data generating circuit 132 by using a buffer amplifier and the like.

The time measurement circuit 130 has a function to measure the time during which the power supply circuit 133 supplies power to the panel including the displaying light emitting element 105, or a function to measure the lighting period of the displaying light emitting element 105 by sampling a video signal supplied to each pixel in the display portion 109. The lighting period of the displaying light emitting element 105 is different for each pixel 110 to display any image. Accordingly, it is preferable that the lighting period of each displaying light emitting element 105 be accumulated and an average lighting period be obtained by adding the accumulated time. Alternatively, the lighting period of arbitrarily selected displaying light emitting elements 105 may be accumulated to use the average thereof. The time measurement circuit 130 outputs a signal including data on elapsed time obtained by the aforementioned function to the corrected data generating circuit 132.

The memory circuit 131 stores time-varying I-V characteristics of the displaying light emitting element 105. That is to say, the memory circuit 131 stores I-V characteristics of the displaying light emitting element 105 at each elapsed time, and preferably stores the I-V characteristics for 10000 to 100000 hours. The memory circuit 131, in accordance with a signal supplied from the corrected data generating circuit 132, outputs data on the I-V characteristics of the displaying light emitting element 105 corresponding to its elapsed time to the corrected data generating circuit 132.

The corrected data generating circuit 132 calculates optimum voltage conditions for operating the displaying light emitting element 105 in accordance with the output of the monitoring light emitting element 102 and the output of the memory circuit 131. In other words, optimum voltage conditions for obtaining a desired luminance are determined and a signal including the data is outputted to the power supply circuit 133.

The power supply circuit 133 outputs a corrected power supply potential to the displaying light emitting element 105 in accordance with a signal supplied from the corrected data generating circuit 132. When a color display is performed using the panel including the displaying light emitting element 105, electro luminescent layers having different emission wavelength bands may be provided in each pixel. Typically, an electro luminescent layer corresponding to each color of red (R), green (G) and blue (B) may be provided. In such a case, the monitoring light emitting element 102 corresponding to each color of red (R), green (G) and blue (B) may be provided to correct a power supply potential for each color. The memory circuit 131 stores the acceleration factor obtained by performing an acceleration test of degradation of the light emitting element. Correction data is calculated using the acceleration factor.

In this embodiment, the voltage conditions of the light emitting element are optimized using the monitoring light emitting element, which suppresses the influence of changes in the current value of the light emitting element due to changes in temperature and changes with time. In addition, any user operation is not required in this embodiment, leading to longer life of the product.

Embodiment 5

An example of a display device capable of applying a reverse bias voltage to a monitoring light emitting element and performing the CL drive is described with reference to FIG. 18. In this embodiment, an AC transistor connected in series to the monitoring light emitting element is provided.

Figure 18:
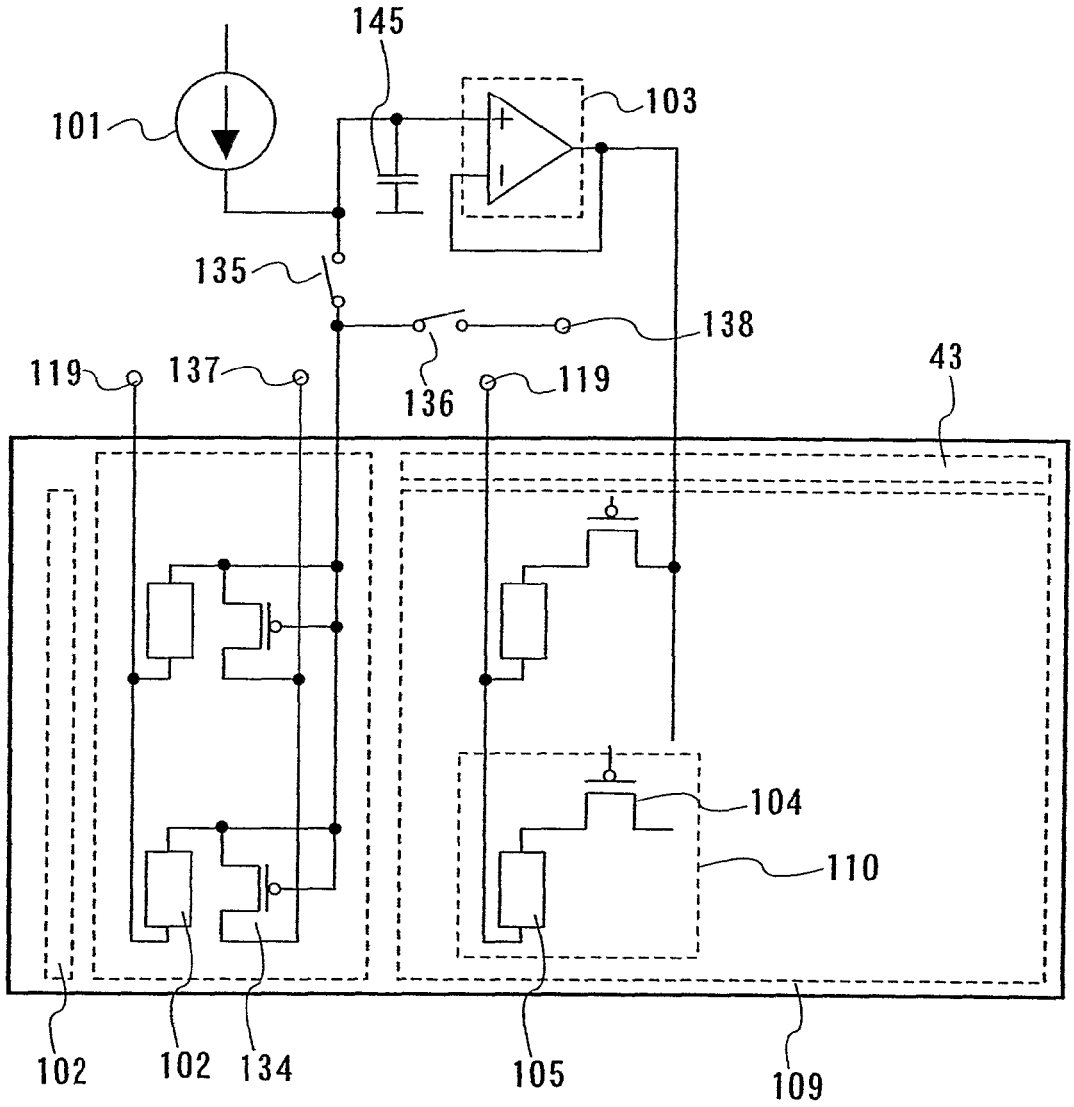
FIG. 18 is a diagram showing a configuration example of a display device according to the invention.

In FIG. 18, a gate electrode of an AC transistor 134 is connected to an input terminal of the voltage generating circuit 103 through a switch 135. The gate electrode of the AC transistor 134 is also connected to an AC power supply 138 through a switch 136. One of a source electrode and a drain electrode of the AC transistor 134 is connected to an AC power supply 137, while the other is connected to the monitoring light emitting element 102. The AC transistor 134 is provided in order to apply a reverse bias voltage to the monitoring light emitting element 102. A reverse bias voltage means a voltage with the opposite polarity to a voltage applied between the two terminals of the light emitting element so that light is emitted. If a positive voltage is applied to one terminal (anode) of the light emitting element while a negative voltage is applied to the other terminal (cathode) thereof to emit light, a reverse bias voltage is applied by applying a negative voltage to one terminal (anode) while applying a positive voltage to the other terminal (cathode).

When a reverse bias voltage is applied to the monitoring light emitting element 102, the switch 135 is turned off so that the monitoring light emitting element 102 is not electrically connected to the voltage generating circuit 103. Further, the potential of the AC power supply 138 is inputted to the AC transistor 134 by turning on the switch 136; thereby the AC transistor 134 is turned on. Then, a magnitude relation between the potential of the opposite power supply 119 and the potential of the AC power supply 137 is arbitrarily determined. By applying a reverse bias voltage to the monitoring light emitting element 102, a current can be supplied locally to a short-circuit portion between the anode and the cathode of the monitoring light emitting element 102 to insulate the short-circuit portion. As a result, it is possible to correct a defect due to the short-circuit portion of the monitoring light emitting element 102.

The capacitor 145 is provided in order to maintain the potential of the input terminal of the voltage generating circuit 103 in the case of applying a reverse bias voltage to the monitoring light emitting element 102. The display device does not necessarily include the capacitor 145, and circuits other than the capacitor 145 may be employed if the potential can be held.

On the other hand, when a forward bias voltage is applied to the monitoring light emitting element 102, the switch 135 is turned on while the switch 136 is turned off. Note that a P-channel transistor is used for the AC transistor 134 in the drawing, though an N-channel transistor may be used instead. Further, the display device of this embodiment is not limited to the configuration where the gate electrode of the AC transistor 134 is connected to the input terminal of the voltage generating circuit 103. Alternatively, a control circuit may be provided independently to control on/off of the AC transistor 134.

Another example of a display device capable of applying a reverse bias voltage to the monitoring light emitting element and performing the CL drive is described with reference to FIG. 19.

Figure 19:
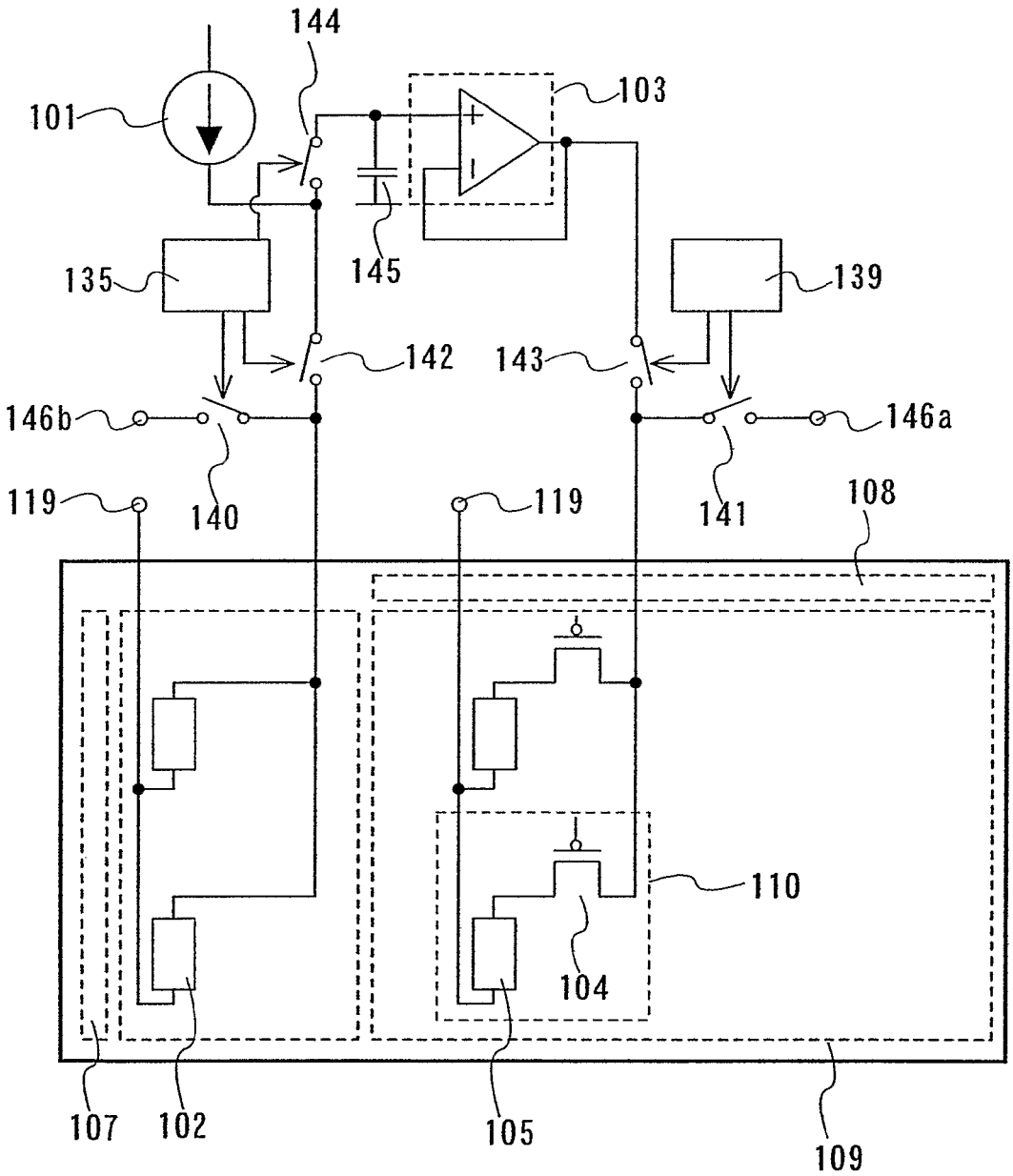
FIG. 19 is a diagram showing a configuration example of a display device according to the invention.

A display device shown in FIG. 19 includes the capacitor 145 connected to the input terminal of the voltage generating circuit 103, a first switch 143 provided between the displaying light emitting element 105 and the output terminal of the voltage generating circuit 103, a second switch 141 provided between the displaying light emitting element 105 and an AC power supply 146*a*, a third switch 142 provided between the monitoring light emitting element 102 and the input terminal of the voltage generating circuit 103, a fourth switch 140 provided between the monitoring light emitting element 102 and the AC power supply 146*b*, and a fifth switch 144 provided between the current source 101 and the input terminal of the voltage generating circuit 103. A known element such as a transistor having a switching function may be used for the first switch 143, the second switch 141, the third switch 142, and the fourth switch 140.

When a reverse bias voltage is applied to the displaying light emitting element 105 and the monitoring light emitting element 102, the control circuit 139 brings the first switch 143, the third switch 142 and the fifth switch 144 into a non-conductive state while the second switch 141 and the fourth switch 140 into a conductive state. Then, a magnitude relation between the potential of the opposite power supply 119 and the potential of the AC power supply 146*b* is arbitrarily determined. As described above, by applying a reverse bias voltage to the displaying light emitting element 105 and the monitoring light emitting element 102, a short-circuit portion can be insulated and a defect due to the short-circuit portion can be corrected.

On the other hand, when a forward bias voltage is applied to the displaying light emitting element 105 and the monitoring light emitting element 102, the control circuit 139 brings the first switch 143, the third switch 142 and the fifth switch 144 into a conductive state while the second switch 141 and the fourth switch 140 into a non-conductive state.

The capacitor 145 is provided in order to maintain the potential of the input terminal of the voltage generating circuit 103 in the case of applying a reverse bias voltage to the displaying light emitting element 105 and the monitoring light emitting element 102. The invention is not limited to the capacitor 145, and circuits other than the capacitor 145 may be employed if the potential can be held.

Another example of a display device capable of applying a reverse bias voltage to the monitoring light emitting element and performing the CL drive is described with reference to FIG. 20.

Figure 20:
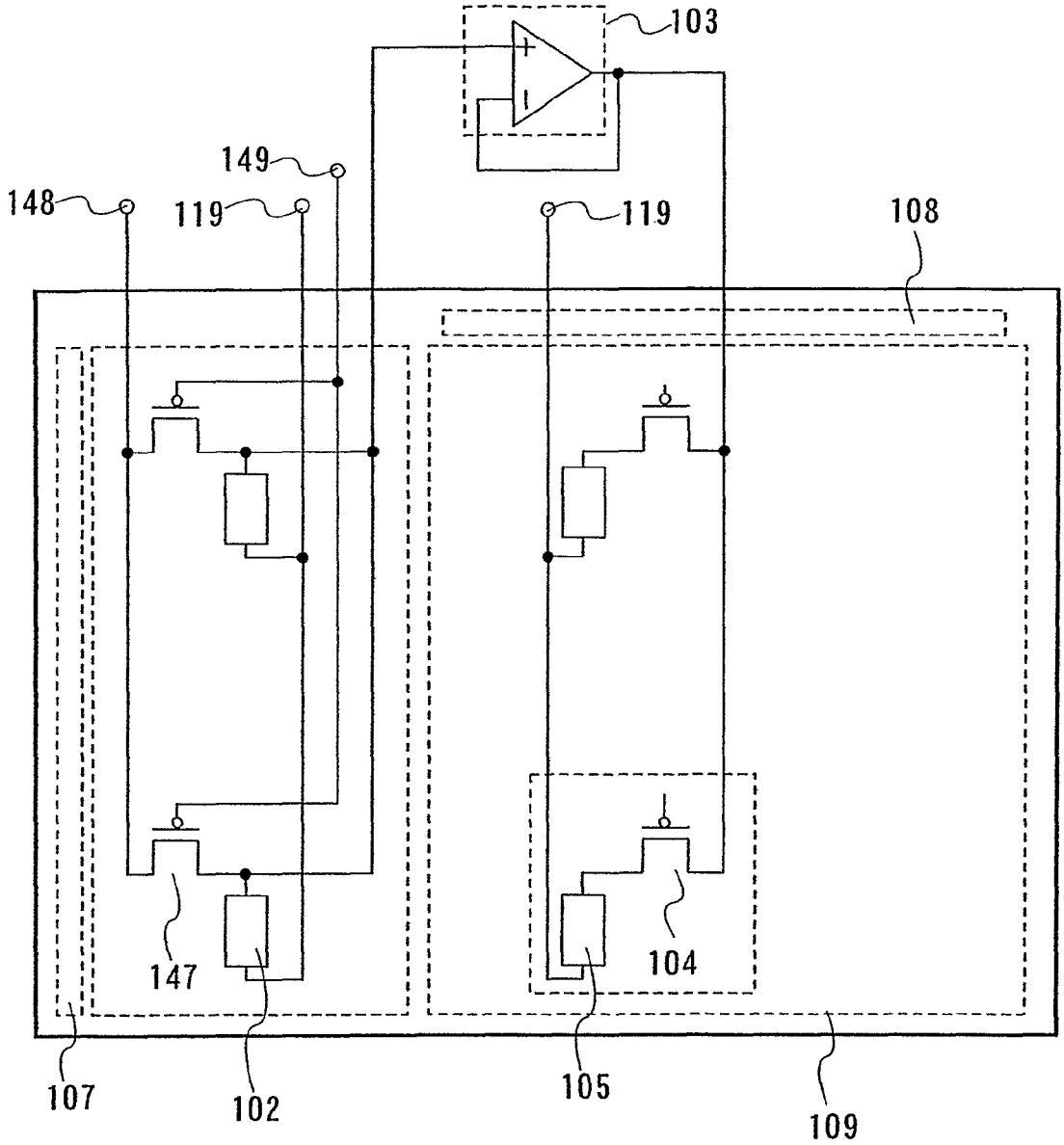
FIG. 20 is a diagram showing a configuration example of a display device according to the invention.

A display device shown in FIG. 20 includes a current source transistor 147 instead of the current source. The current source transistor 147 is connected in series to the monitoring light emitting element 102. A gate electrode of the current source transistor 147 is connected to a power supply 149, and one of a source electrode and a drain electrode thereof is connected to one electrode of the monitoring light emitting element 102 while the other electrode is connected to a power supply 148.

The current source transistor 147 is operated in the saturation region to be used as a current source. Accordingly, a gate-source voltage of the current source transistor 147 is adjusted by arbitrarily setting the potentials of the power supply 148 and the power supply 149. In addition, in order to operate the current source transistor 147 in the saturation region, the ratio (L/W) of the channel length to the channel width of the current source transistor 147 is preferably set to 2 to 100. Note that although a P-channel transistor is used for the current source transistor 147 in FIG. 20, the invention is not limited to this configuration and an N-channel transistor may be used instead.

Figure 21:
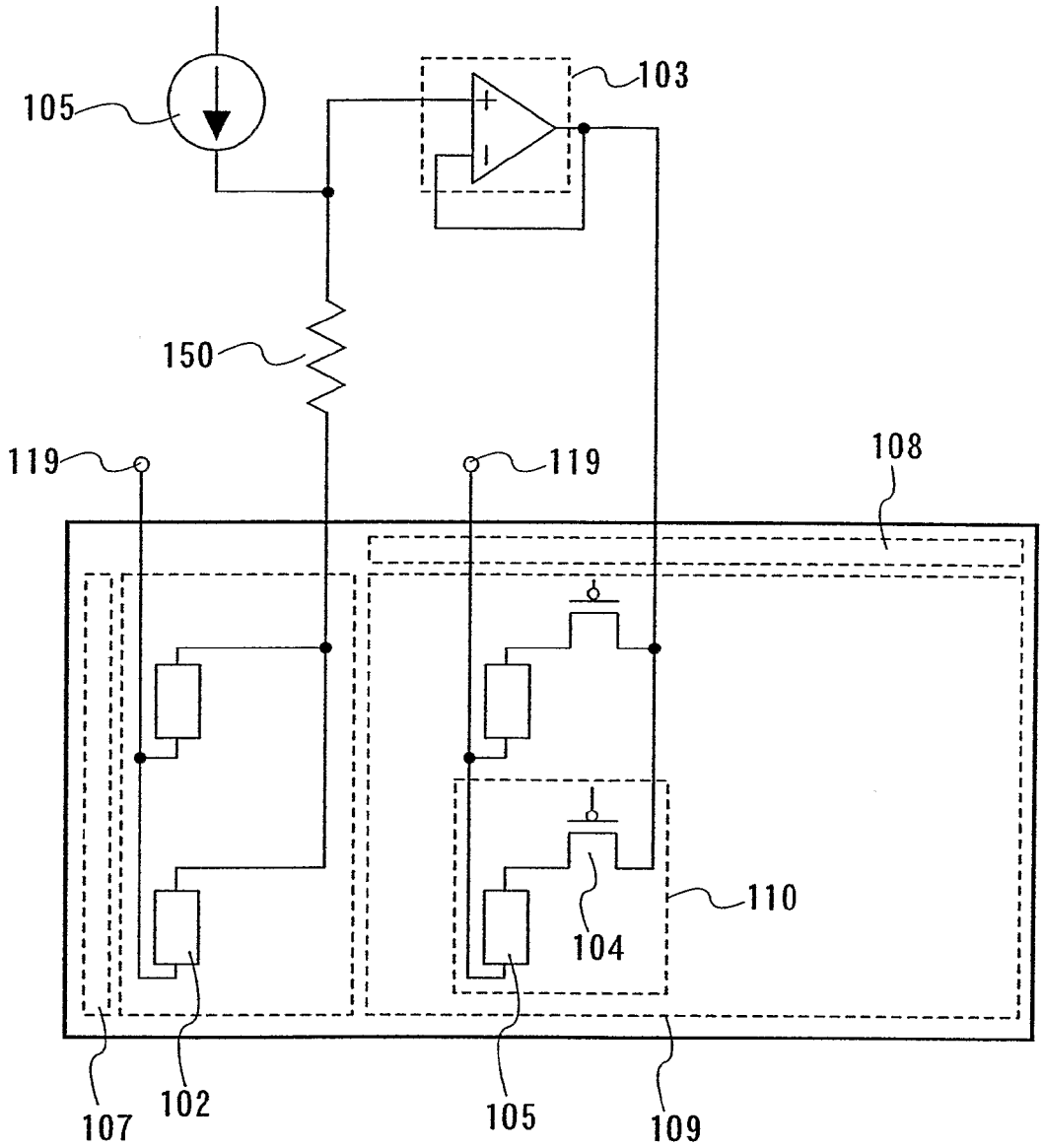
FIG. 21 is a diagram showing a configuration example of a display device according to the invention.

A configuration shown in FIG. 21 includes a resistor 150 provided between the input terminal of the voltage generating circuit 103 and the monitoring light emitting element 102. The resistor 150 may be a variable resistor or a fixed resistor.

The resistor 150 adjusts the difference between the total amount of current of the monitoring light emitting element 102 and the total amount of current of the displaying light emitting element 105 during a certain period (e.g., one frame period). If the monitoring light emitting element 102 is operated normally using the current source 101, the monitoring light emitting element 102 has a duty ratio of 100% while the displaying light emitting element 105 has a duty ratio of about 70% even when the entire screen displays white images. The duty ratio of the displaying light emitting element 105 is further reduced when the lighting ratio is taken into consideration. That is to say, in a normal operation, the monitoring light emitting element 102 degrades at a higher rate than the displaying light emitting element 105.

Accordingly, in the configuration shown in FIG. 21, the resistor 150 is provided so that the current value of the monitoring light emitting element 102 is lower than that of the displaying light emitting element 105 at a certain instant; thereby the total amount of current can be made equal in the monitoring light emitting element 102 and the displaying light emitting element 105 during a certain period to adjust degradation with time. As a result, the power supply potential can be corrected more accurately in accordance with degradation with time of the displaying light emitting element 105.

Another configuration of a display device using a resistor similarly to the aforementioned configuration is described with reference to FIG. 22. This configuration includes the monitoring light emitting element 102*a* and the monitoring light emitting element 102*b*. Each of the monitoring light emitting element 102*a* and the monitoring light emitting element 102*b* may be provided in plurality. The monitoring light emitting element 102*a* is connected to a resistor 151, a voltage generating circuit 153, a current source 155, and a resistor 157. Meanwhile, the monitoring light emitting element 102*b* is connected to a resistor 152, a voltage generating circuit 154, a current source 156, and a resistor 158.

According to the aforementioned configuration, an instantaneous current value of the monitoring light emitting element 102*a* and an instantaneous current value of the monitoring light emitting element 102*b* can be changed by varying the resistance values of the resistor 151 and the resistor 152.

Therefore, the total amount of current of the monitoring light emitting element 102*a* of one column can be made different from that of the monitoring light emitting element 102*b* of another column. Besides, according to the aforementioned configuration, an output terminal of the buffer amplifier 153 and an output terminal of the buffer amplifier 154 are connected to the input terminal of the voltage generating circuit 103. Accordingly, the average value of the output of the buffer amplifier 153 and the output of the buffer amplifier 154 is outputted from the output terminal of the voltage generating circuit 103.

Figure 22:
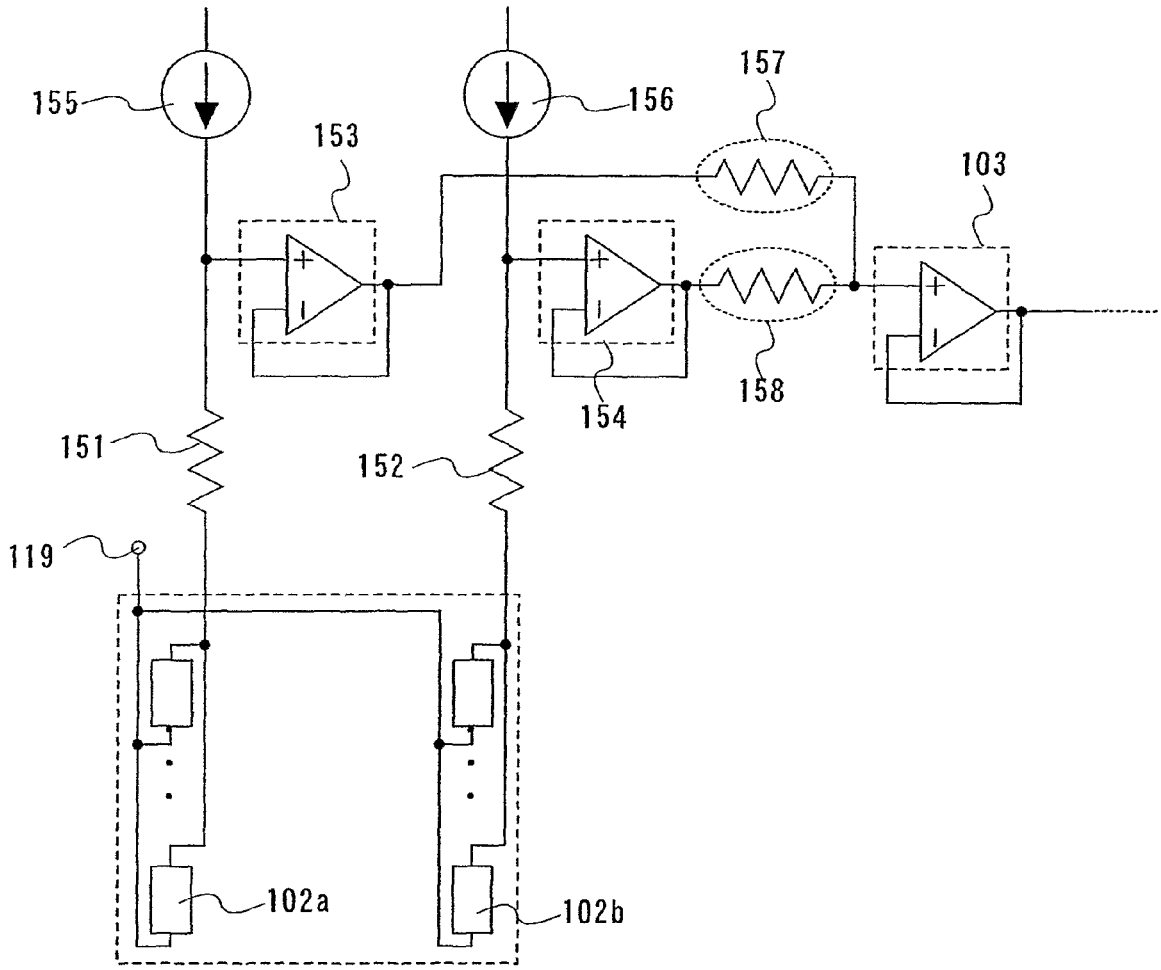
FIG. 22 is a diagram showing details of a monitoring light emitting element and a control circuit thereof according to the invention.

The configuration shown in FIG. 22 can be applied to the case where the displaying light emitting element has a duty ratio of 20 to 50%. In such a case, the total amount of current of the monitoring light emitting element 102*a* is made equal to that of the displaying light emitting element with a duty ratio of 20%, and the total amount of current of the monitoring light emitting element 102*b* is made equal to that of the displaying light emitting element with a duty ratio of 50%. As a result, the voltage generating circuit 103 can output a power supply potential in view of changes with time of the displaying light emitting element with a duty ratio of 35% that is the average value of the duty ratios (20 to 50%) of the displaying light emitting elements.

Figure 23:
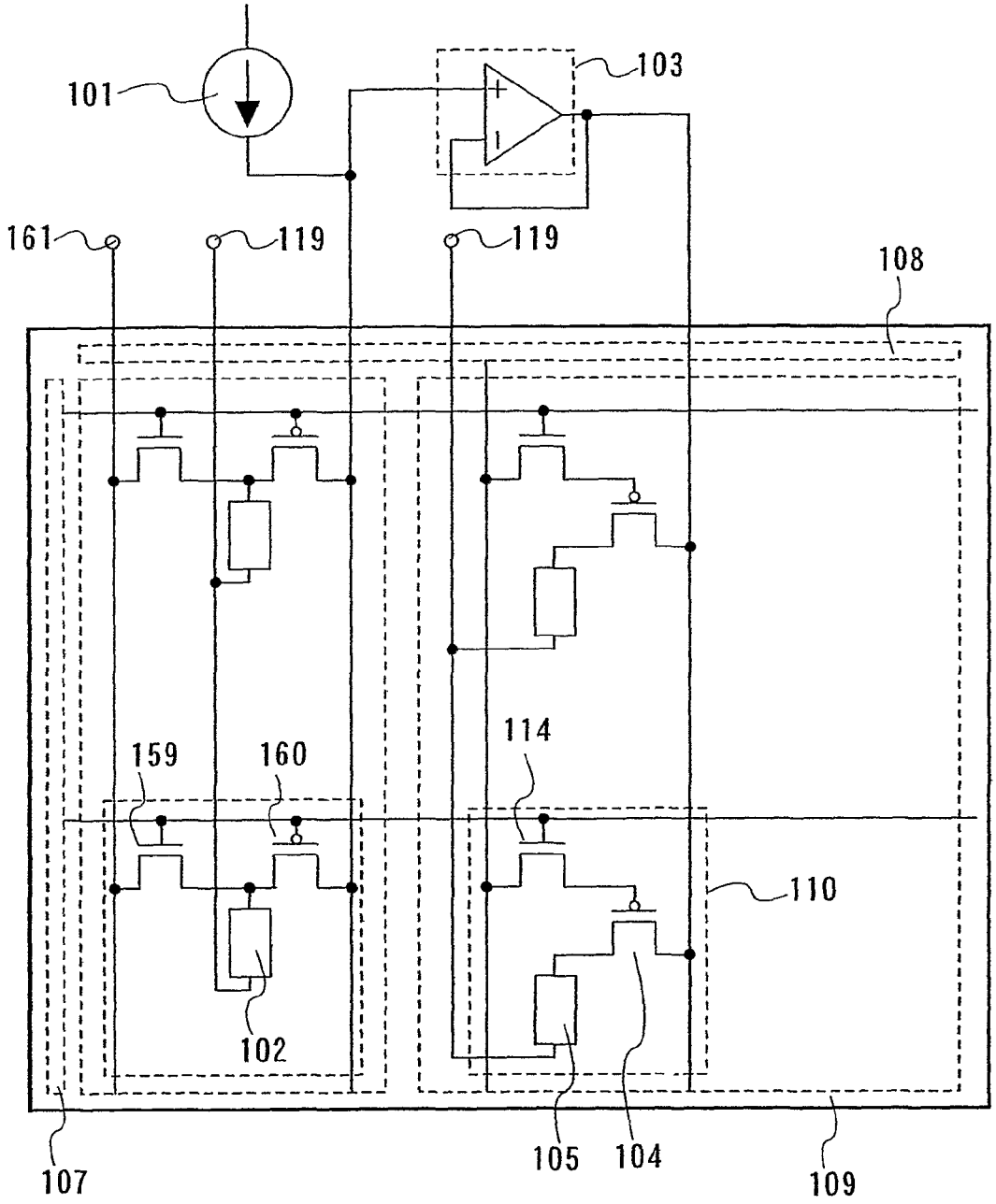
FIG. 23 is a diagram showing a configuration example of a display device according to the invention.

A configuration shown in FIG. 23 includes a forward bias transistor 159 connected in series to the monitoring light emitting element 102. A gate electrode of the forward bias transistor 159 is connected to a gate line of the same row as the switching transistor 114 in the pixel 110. One of a source electrode and a drain electrode of the forward bias transistor 159 is connected to the monitoring light emitting element 102 and the other is connected to a forward bias power supply 161. The forward bias transistor 159 is provided in order to apply a forward bias voltage to the monitoring light emitting element 102.

When a forward bias voltage is applied to the monitoring light emitting element 102, the forward bias transistor 159 is turned on, and a magnitude relation between the potential of the opposite power supply 119 and the potential of the forward bias power supply 161 is arbitrarily determined. By applying a forward bias voltage to the monitoring light emitting element 102, a current is supplied locally to a short-circuit portion of the monitoring light emitting element 102 to insulate the short-circuit portion. As a result, a defect due to the short-circuit portion of the monitoring light emitting element 102 can be corrected. Note that in this configuration, a limiter transistor 160 is provided in addition to the forward bias transistor 159.

When adopting any one of the configurations described in this embodiment, luminance correction of the displaying light emitting element can be performed in accordance with changes in temperature and changes with time of the display device.

When a color display is performed, electro luminescent layers having different emission wavelength bands may be provided in pixels. Typically, an electro luminescent layer corresponding to each color of red (R), green (G) and blue (B) is provided in each pixel. In such a case, at least the monitoring light emitting element 102 corresponding to each color of red (R), green (G) and blue (B), the current source 101 and the voltage generating circuit 103 may be provided to correct a power supply potential for each color.

Embodiment 6

An example of a display device provided with a monitoring light emitting element and performing the CL drive is described with reference to FIG. 24. A display device shown in FIG. 24 includes the display portion 109 where the pixels 110 are arranged in matrix, a first scan line driver circuit 107*a*, a second scan line driver circuit 107*b*, and the data line driver circuit 108. The first scan line driver circuit 107*a* and the second scan line driver circuit 107*b* are disposed so as to face each other with the display portion 109 interposed therebetween. Alternatively, the first scan line driver circuit 107*a* and the second scan line driver circuit 107*b* are disposed on one of the four sides of the display portion 109.

The data line driver circuit 108 includes the pulse output circuit 115, the first latch circuit 116, the second latch circuit 117, and a selection circuit 166. The selection circuit 166 has a transistor 169 and an analog switch 167. The transistor 169 and the analog switch 167 are provided for each column corresponding to a data signal line Dx. An inverter 168 generates an inverted signal of a WE (Write Erase) signal, and is not necessarily provided if an inverted signal of the WE signal is supplied externally.

A gate electrode of the transistor 169 is connected to a selection signal line 171, and one of a source electrode and a drain electrode thereof is connected to the data signal line Dx while the other is connected to a power supply 170. The analog switch 167 is provided between the second latch circuit 117 and the data signal line Dx. That is to say, an input node of the analog switch 167 is connected to the second latch circuit 117 while an output node thereof is connected to the data signal line Dx. One of two control nodes of the analog switch 167 is connected to the selection signal line 170 and the other is connected to the selection signal line 170 through the inverter 168. The power supply 171 has a potential that turns off the driving transistor 104 included in the pixel 110. The potential of the power supply 171 is at L level if an N-channel transistor is used for the driving transistor 104 while at H level if a P-channel transistor is used for the driving transistor 104.

The first scan line driver circuit 107*a* includes a pulse output circuit 173 and a selection circuit 172. The second scan line driver circuit 107*b* includes a pulse output circuit 176 and a selection circuit 175. The selection circuits 172 and 175 are connected to the selection signal line 170, though the selection circuit 175 included in the second scan line driver circuit 107*b* is connected to the selection signal line 170 through an inverter 178. In other words, WE signals inputted to the selection circuits 172 and 175 through the selection signal line 170 are inverted from each other.

Each of the selection circuits 172 and 175 includes a tri-state buffer circuit. An input node of the tri-state buffer circuit is connected to the pulse output circuit 173 or the pulse output circuit 176. A control node of the tri-state buffer circuit is connected to the selection signal line 170 while an output node thereof is connected to a scan line Gy. The tri-state buffer circuit is brought into an operating state when a signal transmitted from the selection signal line 170 is at H level and into a floating state when the signal is at L level.

Each of the pulse output circuit 115 included in the data line driver circuit 108, the pulse output circuit 173 included in the first scan line driver circuit 107*a*, and the pulse output circuit 176 included in the second scan line driver circuit 107*b* includes a shift register having a plurality of flip flop circuits or a decoder circuit. If a decoder circuit is used as the pulse output circuits 115, 173 and 175, the data signal line Dx or the scan line Gy can be selected at random. By selecting the data signal line Dx or the scan line Gy at random, pseudo contour occurring when adopting a time gray scale method can be prevented.

The configuration of the data line driver circuit 108 is not limited to the aforementioned one, and a level shifter or a buffer circuit may be provided additionally. The configuration of the first scan line driver circuit 107*a* and the second scan line driver circuit 107*b* is also not limited to the aforementioned one, and a level shifter or a buffer circuit may be provided additionally. Further, each of the data line driver circuit 108, the first scan line driver circuit 107*a*, and the second scan line driver circuit 107*b* may include a protection circuit.

A power supply control circuit 163 includes a controller 164 and a power supply circuit 165 for supplying power to the displaying light emitting element 105. The power supply circuit 165 is connected to a pixel electrode of the displaying light emitting element 105 through the driving transistor 104 and a power supply line Vx. The power supply circuit 165 is also connected to a counter electrode of the displaying light emitting element 105 through a power supply line.

When a forward bias voltage is applied to the displaying light emitting element 105 so that the displaying light emitting element 105 emits light, the potential of a first power supply line 162*a* is set to be higher than that of a second power supply line 162*b*. On the other hand, when a reverse bias voltage is applied to the displaying light emitting element 105, the potential of the first power supply line 162*a* is set to be lower than that of the second power supply line 162*b*. Such a setting of the power supply can be performed by supplying a predetermined signal from the controller 164 to the power supply circuit 165.

In the display device according to this embodiment, a reverse bias voltage is applied to the displaying light emitting element 105 by using the power supply control circuit 163, leading to suppressed degradation with time of the displaying light emitting element 105 and increased reliability. In addition, a short-circuit defect of the displaying light emitting element 105 can be corrected. The short-circuit defect of the displaying light emitting element 105, where two electrodes sandwiching an EL layer are short-circuited, is caused by a defect in the EL layer due to the deposition of foreign substance, unevenness of a base film, and the like. Such an initial defect prevents light emission or non-light emission from being controlled depending on a signal. If the displaying light emitting element has the short-circuit defect, a current flows through the short-circuit portion, which prevents normal light emission. The short-circuit portion can be corrected by applying a reverse bias voltage to the displaying light emitting element. When a reverse bias voltage is applied to the displaying light emitting element 105, a current can be supplied locally to the short-circuit portion to generate heat in the short-circuit portion and insulate the short-circuit portion by oxidization or carbonization. As a result, the short-circuit defect can be corrected and images can be displayed with high quality.

A short-circuit defect of the displaying light emitting element occurs with time in some cases; therefore, a reverse bias voltage is desirably applied to the light emitting element as needed. In the display device according to this embodiment, a reverse bias voltage can be applied to the displaying light emitting element 105 by the power supply control circuit 163. Therefore, such a short-circuit defect can be corrected and images can be displayed with high quality. The timing of applying a reverse bias voltage to the displaying light emitting element 105 is not particularly limited.

The display device according to this embodiment also includes the monitoring light emitting element 102. The monitoring light emitting element 102 is controlled by a control circuit 180 including a constant current source and a buffer circuit. The control circuit 180 outputs a signal for changing a power supply potential to the power supply control circuit 163 in accordance with the output of the monitoring light emitting element 102. The power supply control circuit 163 varies a power supply potential supplied to the display portion 109 in accordance with a signal inputted from the control circuit 180. The display device according to this embodiment having the aforementioned configuration performs the CL drive by suppressing variations in current value of the light emitting element due to changes in temperature.

Figure 24:
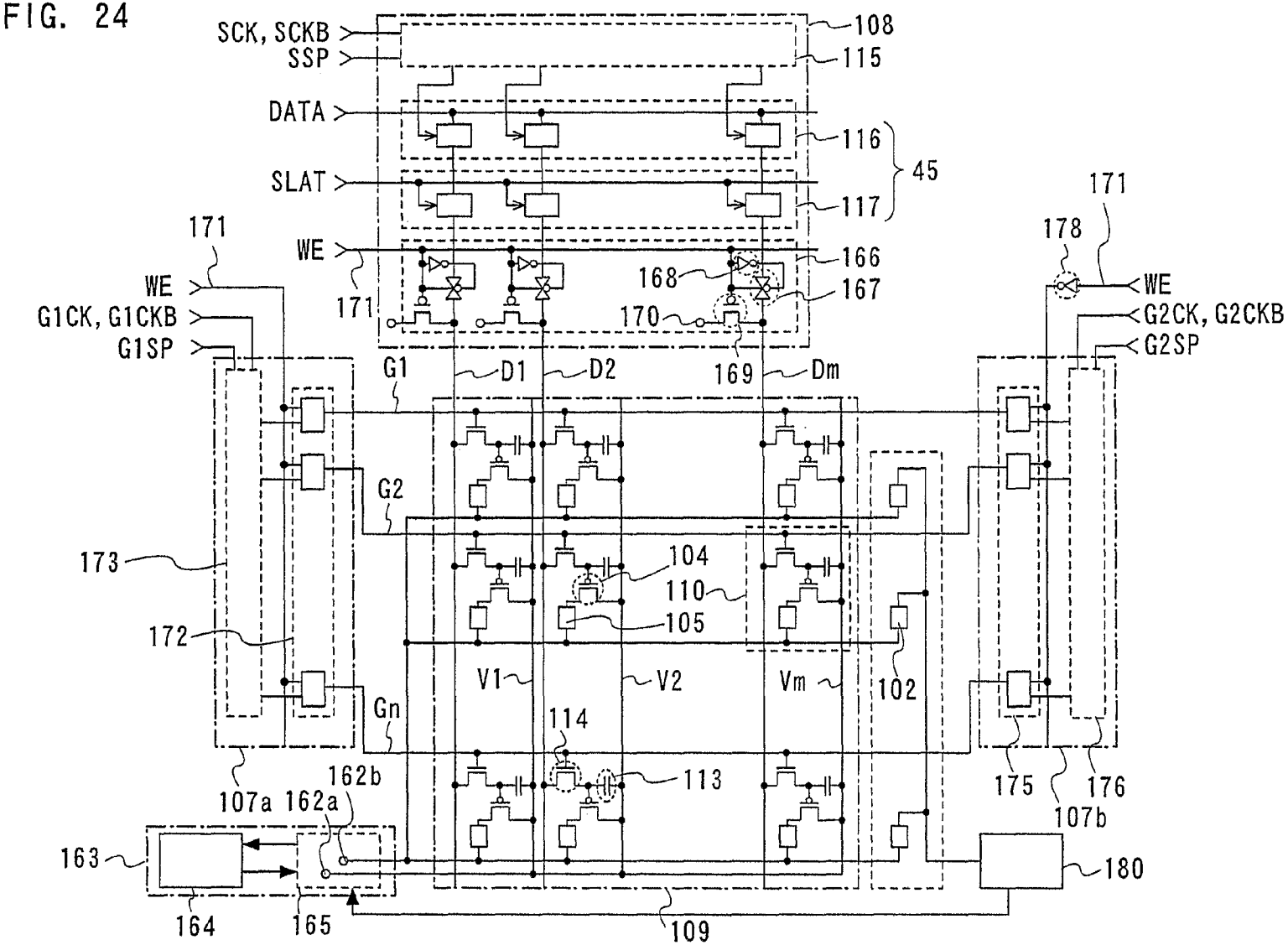
FIG. 24 is a diagram showing a configuration example of a display device according to the invention.

The display device shown in FIG. 24 can be achieved using various substrates such as a glass substrate, a plastic substrate and a single crystalline semiconductor substrate. Some circuits of the display device in FIG. 24 may be formed over a substrate and the other circuits may be formed over another substrate. For example, in the display device in FIG. 24, the display portion 109 and the scan line driver circuit 107 may be formed over a glass substrate using thin film transistors, and the data line driver circuit 108 may be formed over a single crystalline semiconductor substrate to be attached onto the glass substrate by COG (Chip On Glass) as a driver IC. Alternatively, the driver IC may be connected to the glass substrate by TAB (Tape Auto Bonding).

Figure 25:
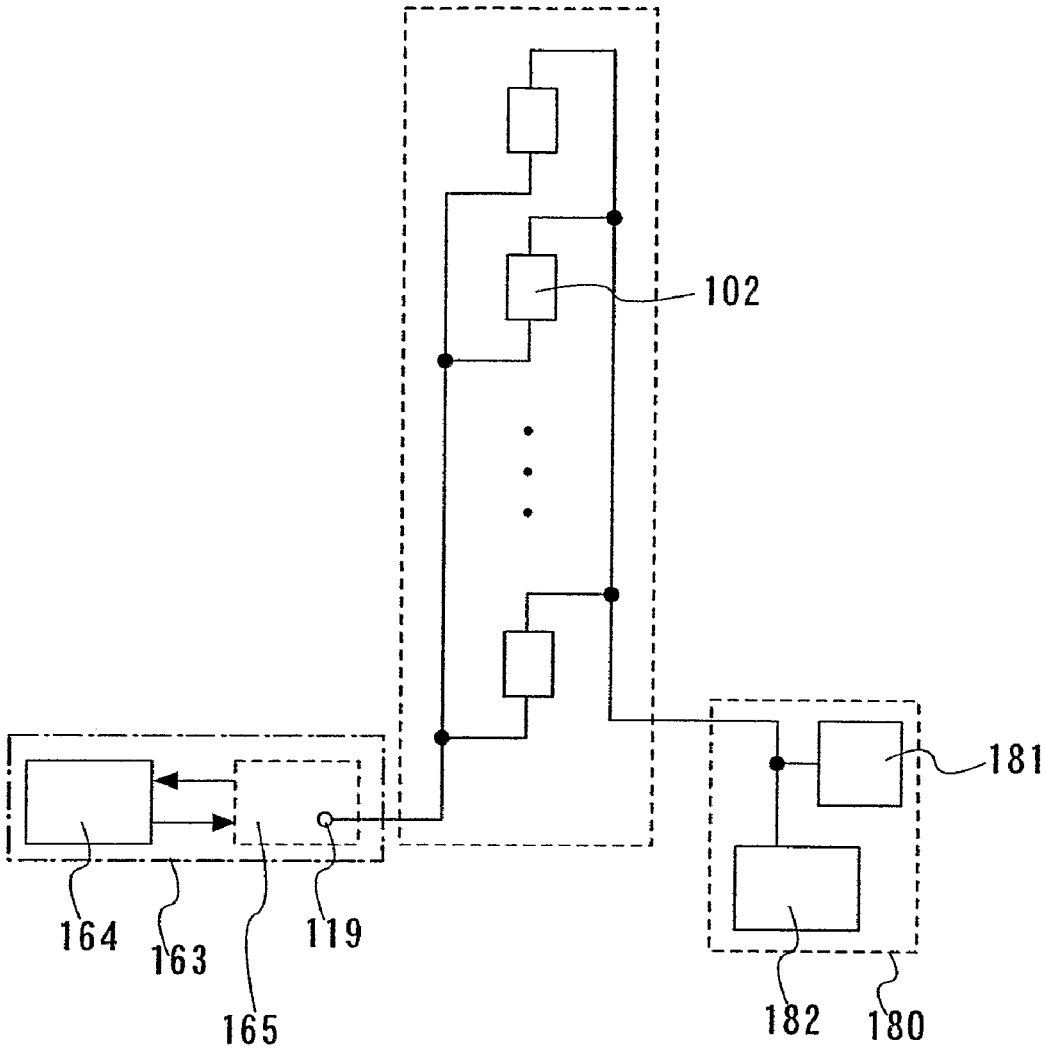
FIG. 25 is a diagram showing details of a monitoring light emitting element and a control circuit thereof according to the invention.

FIG. 25 shows specific configurations of the monitoring light emitting element 102 and the control circuit 180 thereof. The monitoring light emitting element 102 has two terminals, one of which is connected to a power supply with a fixed potential (grounded in the drawing) and the other is connected to the control circuit 180. The control circuit 180 includes a current source 181 and an amplifier circuit 182. The power supply control circuit 163 includes the power supply circuit 165 and the controller 164. Note that the power supply circuit 165 is preferably a variable power supply that can change a power supply potential to be supplied.

Explanation is made on a mechanism for detecting the ambient temperature by the monitoring light emitting element 102 in FIG. 25. A constant current is supplied from the current source 181 between the two terminals of the monitoring light emitting element 102. When the temperature of the display device changes in this state, the resistance value of the monitoring light emitting element 102 varies. When the resistance value of the monitoring light emitting element 102 varies, the potential difference between the two terminals of the monitoring light emitting element 102 changes since a constant current is supplied thereto. A change in the temperature of the display device can be detected by detecting the change in the potential difference of the monitoring light emitting element 102 due to changes in temperature. More specifically, the potential of the electrode of the monitoring light emitting element 102, which is connected to a fixed potential, does not change; therefore, a change in the potential of the electrode connected to the current source 181 is detected. A signal including data on such a change in potential is amplified by the amplifier circuit 182, and then outputted to the power supply control circuit 163. The power supply control circuit 163 changes the potential of a power supply inputted to the display portion through the amplifier circuit 182. As a result, the power supply potential can be corrected in accordance with changes in temperature. That is to say, variations in current value due to changes in temperature can be suppressed.

Although a plurality of the monitoring light emitting elements 102 are provided in the configuration shown in FIG. 25, this embodiment is not limited to this. The monitoring light emitting element 102 may be connected in series to a transistor so that a current can be supplied to the monitoring light emitting element 102 as needed.

Figure 27A:
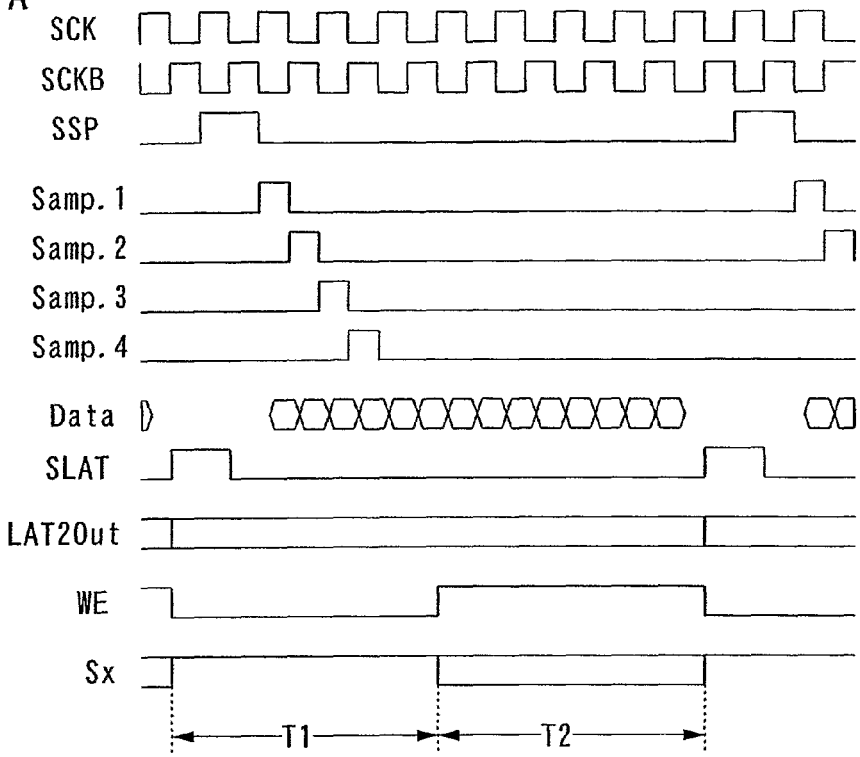
FIGS. 27A and 27B are signal waveform diagrams showing an operation example of a display device according to the invention.
Figure 27B:
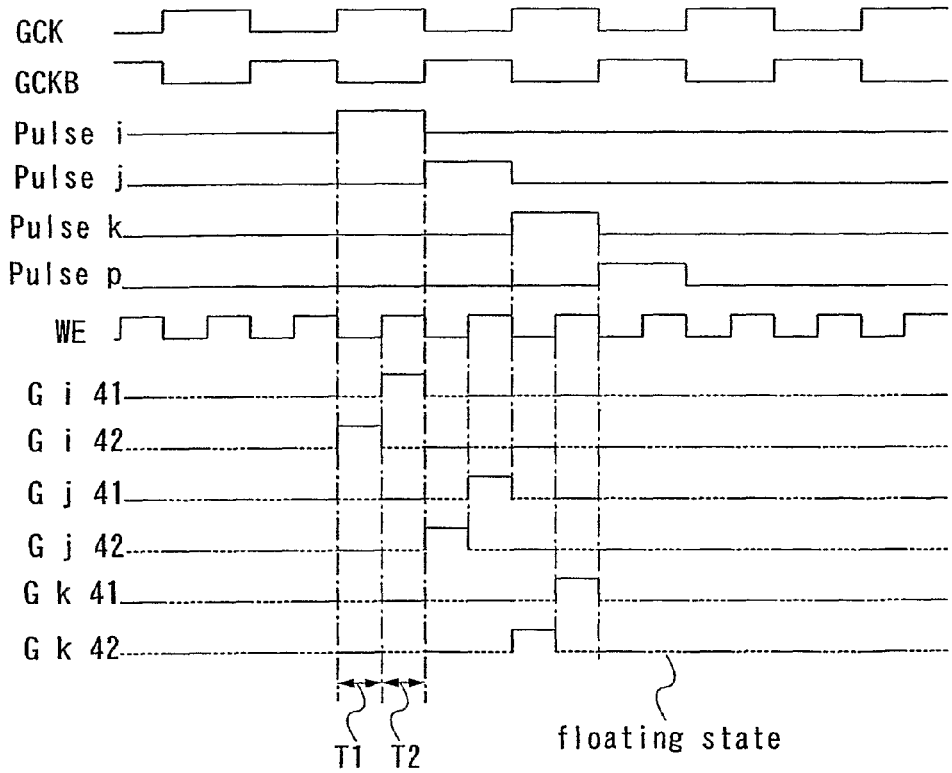

An operation of the display device shown in FIG. 24 is described with reference to FIGS. 27A and 27B. The data line driver circuit 108 is operated in the following manner A clock signal (hereinafter referred to as SCK), a clock inverted signal (hereinafter referred to as SCKB) and a start pulse (hereinafter referred as SSP) are inputted to the pulse output circuit 115, and a sampling pulse is outputted to the first latch circuit 116 at the timing of these signals. The first latch circuit 116 to which data is inputted holds video signals of the first to last columns when the sampling pulse is inputted. When a latch pulse is inputted to the second latch circuit 117, the video signals held in the first latch circuit 116 are simultaneously transmitted to the second latch circuit 117.

When it is assumed that an L level WE signal is transmitted from the selection signal line 170 during a period T1 while an H level WE signal is transmitted during a period T2, the selection circuit 166 is operated during each period in the following manner. Each of the periods T1 and T2 corresponds to half of a horizontal scan period, and the period T1 is called a first subgate selection period whereas the period T2 is called a second subgate selection period.

During the period T1 (first subgate selection period), an L level WE signal is transmitted from the selection signal line 170, the transistor 169 is turned on, and the analog switch 167 is turned off. Then, the plurality of signal lines D1 to Dn are electrically connected to the power supply 171 through the transistor 169 provided in each column. That is, the potentials of the signal lines D1 to Dn become equal to the potential of the power supply 171. At this time, the switching transistor 114 included in the pixel 110 is on, and the potential of the power supply 171 is transmitted to the gate electrode of the driving transistor 104 through the switching transistor 114. Thus, the driving transistor 104 is turned off and the two electrodes of the displaying light emitting element 105 have the same potential. That is to say, no current flows between the two electrodes of the displaying light emitting element 105, thereby no light is emitted. In this manner, the potential of the power supply 171 is transmitted to the gate electrode of the driving transistor 104 regardless of the state of a video signal inputted to a video line, and thus the transistor 114 is turned off and the two electrodes of the displaying light emitting element 105 have the same potential. Such an operation is called an erasing operation.

During the period T2 (second subgate selection period), an H level WE signal is transmitted from the selection signal line 170, the transistor 169 is turned off, and the analog switch 167 is turned on. Then, the video signals held in the second latch circuit 117 are simultaneously transmitted to the signal lines D1 to Dn for one row. At this time, the switching transistor 114 included in the pixel 110 is on, and the video signal is transmitted to the gate electrode of the driving transistor 104 through the switching transistor 114. Thus, the driving transistor 104 is turned on or off depending on the inputted video signal, thereby the two electrodes of the displaying light emitting element 105 have different potentials or the same potential. More specifically, when the driving transistor 104 is turned on, the two electrodes of the displaying light emitting element 105 have different potentials and a current flows therethrough, namely, the displaying light emitting element 105 emits light. Note that the same current flows through the displaying light emitting element 105 and between the source and the drain of the driving transistor 104. On the other hand, when the driving transistor 104 is turned off, the two electrodes of the displaying light emitting element 105 have the same potential and no current flows therethrough, namely, the displaying light emitting element 105 emits no light. In this manner, the driving transistor 104 is turned on or off depending on a video signal, and the displaying light emitting element 105 is controlled to emit light or no light. Such an operation is called a writing operation.

An operation of the first scan line driver circuit 107*a* and the second scan line driver circuit 107*b* is described next. A clock signal (G1CK), a clock inverted signal (G1CKB) and a start pulse (GISP) are inputted to the pulse output circuit 173, and pulses are sequentially outputted to the selection circuit 172 at the timing of these signals. A clock signal (G2CK), a clock inverted signal (G2CKB) and a start pulse (G2SP) are inputted to the pulse output circuit 176, and pulses are sequentially outputted to the selection circuit 175 at the timing of these signals. FIG. 27B shows the potentials of pulses supplied to the selection circuits 172 and 175 of the i-th, j-th, k-th, and p-th rows (i, j, k, and p are natural numbers, 1=i, j, k, p=n).

When it is assumed that an L level WE signal is transmitted from the selection signal line 170 during a period T1 while an H level WE signal is transmitted during a period T2 similarly to the operation of the data line driver circuit 108, the selection circuit 172 in the first scan line driver circuit 107*a* and the selection circuit 175 in the second scan line driver circuit 107*b* operate in each period in the following manner. In the timing chart of FIG. 27B, the potential of the scan line Gy (y is a natural number, 1=y=n) that receives a signal from the first scan line driver circuit 107*a* is denoted by Gy41, while the potential of the scan line that receives a signal from the second scan line driver circuit 107*b* is denoted by Gy42.

In the period T1 (first subgate selection period), an L level WE signal is transmitted from the selection signal line 170. Thus, an L level WE signal is inputted to the selection circuit 172 in the first scan line driver circuit 107*a*; thereby the selection circuit 172 is brought into a floating state. On the other hand, an inverted WE signal, namely an H level WE signal is inputted to the selection circuit 175 in the second scan line driver circuit 107*b*; thereby the selection circuit 175 is brought into an operating state. That is, the selection circuit 175 transmits an H level signal (row selection signal) to a scan line Gi of the i-th row such that the scan line Gi has the same potential as the H level signal. The scan line Gi of the i-th row is selected by the second scan line driver circuit 107*b*. As a result, the switching transistor 114 included in the pixel 110 is turned on. Then, the potential of the power supply 171 included in the data line driver circuit 108 is transmitted to the gate electrode of the driving transistor 104; thereby the driving transistor 104 is turned off and the two electrodes of the displaying light emitting element 105 have the same potential. That is to say, the erasing operation is performed in this period.

In the period T2 (second subgate selection period), an H level WE signal is transmitted from the selection signal line 170. Thus, an H level WE signal is inputted to the selection circuit 172 in the first scan line driver circuit 107*a*; thereby the selection circuit 172 is brought into an operating state. That is, the selection circuit 172 transmits an H level signal to the scan line Gi of the i-th row such that the scan line Gi has the same potential as the H level signal. The scan line Gi of the i-th row is selected by the first scan line driver circuit 107*a*. As a result, the switching transistor 114 included in the pixel 110 is turned on. Then, the video signal is transmitted from the second latch circuit 117 in the data line driver circuit 108 to the gate electrode of the driving transistor 104; thereby the driving transistor 104 is turned on or off and the two electrodes of the displaying light emitting element 105 have different potentials or the same potential. That is to say, the writing operation where the displaying light emitting element 105 emits light or no light is performed in this period. Meanwhile, the selection circuit 175 in the second scan line driver circuit 107*b* is inputted with an L level signal, and brought into a floating state.

As set forth above, the scan line Gy is selected by the second scan line driver circuit 107*b* during the period T1 (first subgate selection period) while selected by the first scan line driver circuit 107*a* during the period T2 (second subgate selection period). The scan line is controlled by the first scan line driver circuit 107*a* and the second scan line driver circuit 107*b* in a complementary manner The erasing operation is performed during one of the first and second subgate selection periods, and the writing operation is performed during the other thereof.

During a period when the first scan line driver circuit 107*a* selects the scan line Gi of the i-th row, the second scan line driver circuit 107*b* does not operate (the selection circuit 175 is in a floating state), or transmits a row selection signal to the scan lines other than the i-th row. Similarly, during a period when the second scan line driver circuit 107*b* transmits a row selection signal to the scan line Gi of the i-th row, the first scan line driver circuit 107*a* is in a floating state, or transmits a row selection signal to the scan lines other than the i-th row.

According to the invention performing the aforementioned operations, the displaying light emitting element 105 can be turned off forcibly, leading to an increased duty ratio even with an increased number of gray scale levels. Further, the displaying light emitting element 105 can be turned off forcibly without providing a TFT for discharging the charges of the capacitor 113, which results in a high aperture ratio. When the high aperture ratio is achieved, the luminance of the light emitting element can be reduced with the increase in light emitting area. That is to say, driving voltage can be reduced and thus power consumption can be reduced.

The invention is not limited to the aforementioned embodiment where a gate selection period is divided into two periods. The gate selection period may be divided into three or more periods. Note that an erasing signal is inputted to a pixel during the first half of the gate selection period (first subgate selection period) while a video signal is inputted to the pixel during the second half of the gate selection period (second subgate selection period), though the invention is not limited to this. Alternatively, a video signal may be inputted to a pixel during the first half of the gate selection period (first subgate selection period) while an erasing signal may be inputted to the pixel during the second half of the gate selection period (second subgate selection period). Further alternatively, a video signal may be inputted to a pixel during both the first half of the gate selection period (first subgate selection period) and the second half of the gate selection period (second subgate selection period). In this case, signals corresponding to different subframe periods may be inputted during each period. As a result, subframe periods can be provided so that lighting periods are sequentially arranged without an erasing period. Since no erasing period is required in such a case, duty ratio can be increased.

An operation of the display device is described with reference to timing charts (FIGS. 28A and 28C) each having an ordinate representing a scan line and an abscissa representing time and timing charts (FIGS. 28B and 28D) of a scan line Gi of the i-th row (1≤i≤m). According to a time gray scale method, one frame period has a plurality of subframe periods SF1, SF2, . . . , and SFn (n is a natural number). Each of the subframe periods has one of a plurality of writing periods Ta1, Ta2, . . . , and Tan for performing the writing operation or the erasing operation, and one of a plurality of lighting periods Ts1, Ts2, . . . , and Tsn. Each of the writing periods is divided into a plurality of gate selection periods each of which has a plurality of subgate selection periods. The number of divisions of each gate selection period is not particularly limited, though each gate selection period is preferably divided into two to eight subgate selection periods, and more preferably two to four subgate selection periods. The length ratio of the lighting periods Ts1:Ts2: . . . :Tsn is, for example, 2(n-1): 2(n-2): . . . :21:20. In other words, the lighting periods Ts1, Ts2, . . . , and Tsn have different lengths for each bit.

Figure 28A:
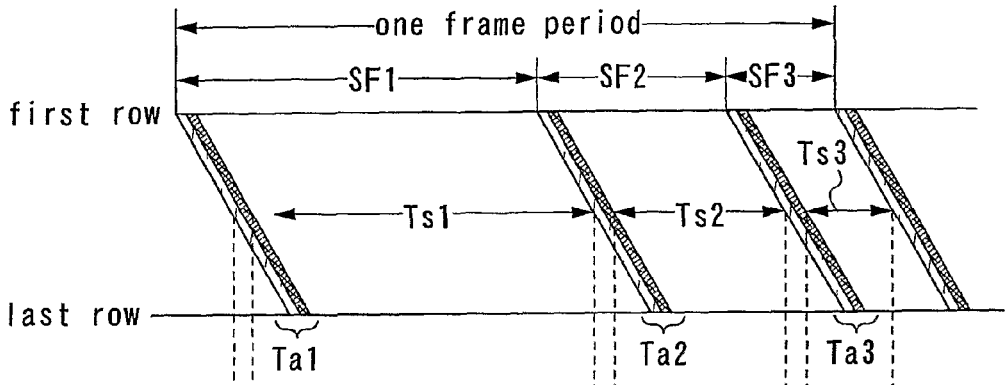
FIGS. 28A to 28D are timing charts showing an operation example of a display device according to the invention.
Figure 28B:
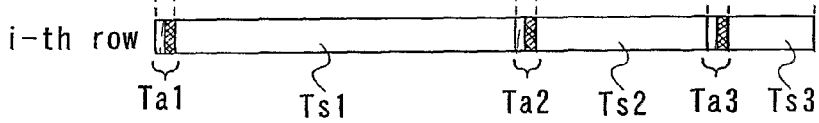

An operation in the case of including no AC driving period is described hereinafter with reference to FIGS. 28A and 28B. A 3-bit (8-level gray scale) image is displayed herein for example. In this case, one frame period is divided into three subframe periods SF1 to SF3. Each of the subframe periods SF1 to SF3 has one of writing periods Ta1 to Ta3 and one of lighting periods Ts1 to Ts3. Each writing period is divided into a plurality of gate selection periods each of which has a plurality of subgate selection periods. In this embodiment, each of the gate selection periods has two subgate selection periods, and the erasing operation is performed during the first subgate selection period while the writing operation is performed during the second subgate selection period. It should be noted that the erasing operation is performed so that a light emitting element emits no light, and performed only during a needed subframe period.

Figure 28C:
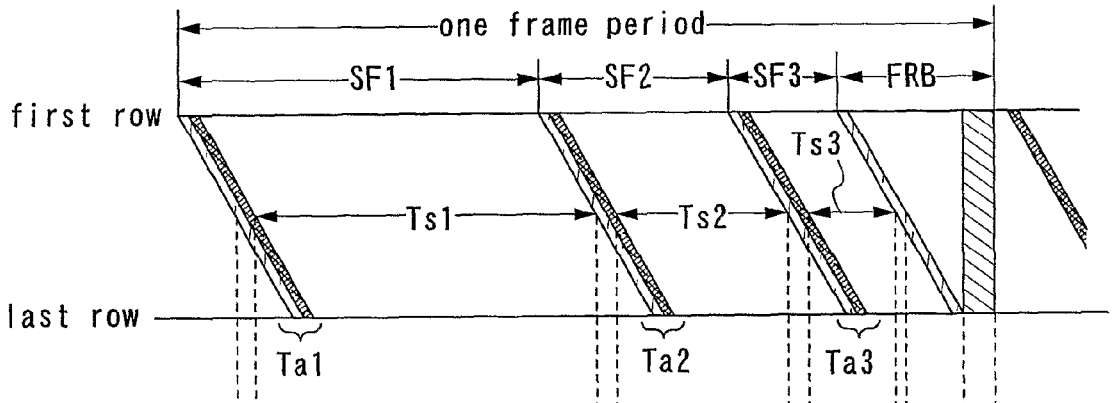
Figure 28D:
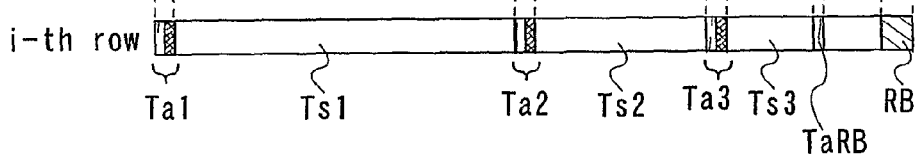

An operation in the case of including an AC driving period is described next with reference to FIGS. 28C and 28D. An AC driving period FRB includes a writing period TaRB for performing only the erasing operation and a reverse bias voltage applying period RB for applying a reverse bias voltage to all the light emitting elements at a time. Note that the AC driving period FRB is not necessarily provided for each frame period, and may be provided for every several frame periods. In addition, the reverse bias voltage applying period RB is not necessarily provided separately from the subframe periods SF1 to SF3, and may be provided in the lighting periods SF1 to SF3 in a certain subframe period.

The subframe periods are not necessarily ordered from the most significant bit to the least significant bit, and may be ordered at random. Further, the order of the subframe periods may be different for each frame period. Besides, one or more periods selected from the plurality of subframe periods may be divided into a plurality of periods. In this case, each of the divided one or more periods as well as each of one or more periods that are not divided has one of writing periods Ta1, Ta2, . . . , and Tam (m is a natural number) and one of lighting periods Ts1, Ts2, . . . , and Tsm.

Explanation is made on a timing chart in the case where a subframe period of an upper bit is divided into a plurality of periods and subframe periods are ordered at random (see FIG. 28). The timing chart shows the case of displaying a 6-bit image. A subframe period SF1 is divided into three periods (SF1-1 to SF1-3), a subframe period SF2 is divided into two periods (SF2-1 and SF2-2), and a subframe period SF3 is divided into two periods (SF3-1 and SF3-2). The timing chart also shows a display timing of pixels of the first row, a display timing of pixels of the last row, a scan timing of an erasing scan line driver circuit, and a scan timing of a writing scan line driver circuit. Note that the timing chart shows an example of a duty ratio of 51%.

Embodiment 7

Figure 34:
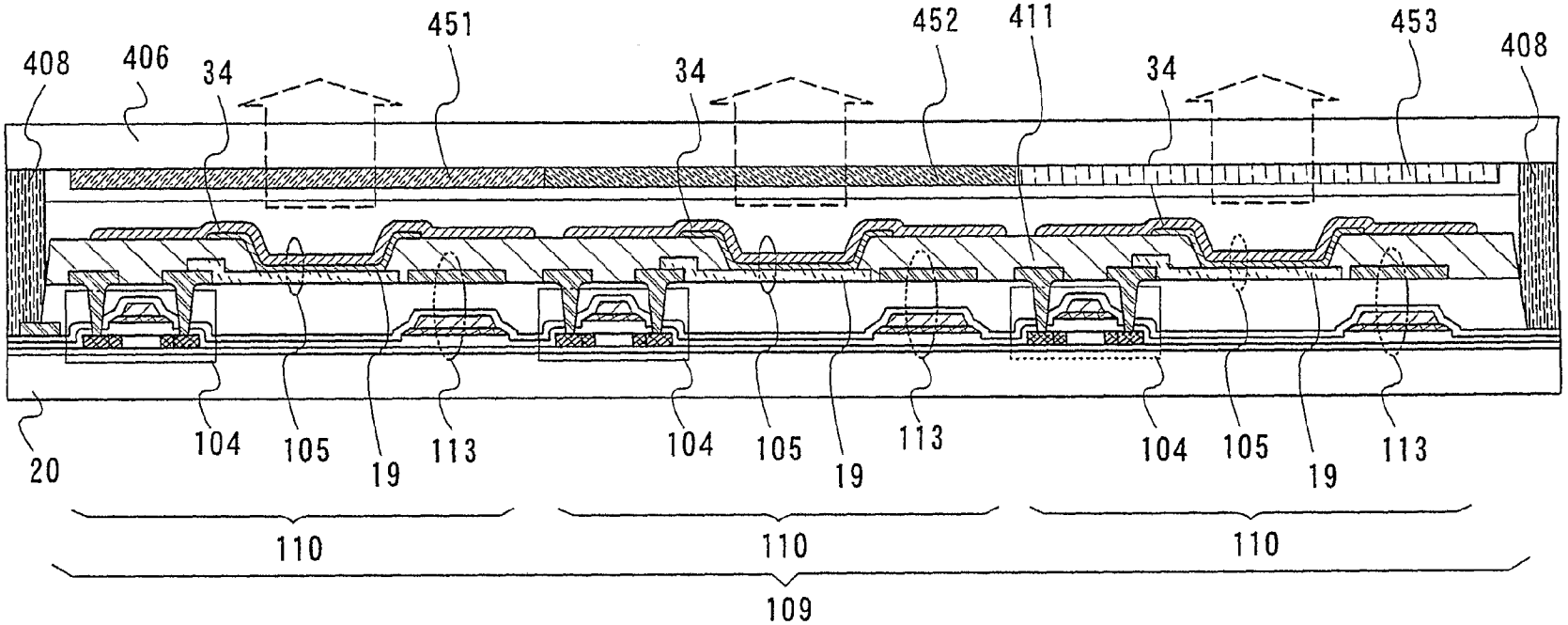
FIG. 34 is a diagram showing a configuration example of a display portion of a display device according to the invention.

An example of the display devices shown in Embodiments 1 to 6, which performs the CL drive using a white light emitting element, is described with reference to FIG. 34.

The display portion 109 is formed over a substrate 20. The display portion 109 includes the pixels 110 each having the driving transistor 104, the displaying light emitting element 105 that emits white light, and the capacitor 113. The displaying light emitting elements 105 in adjacent pixels are separated from each other with a bank layer 411. The bank layer 411 is formed using an organic or inorganic insulating material. For example, an insulating material containing non-photosensitive polyimide, acrylic or siloxane may be applied and then etched to form the bank layer 411. Alternatively, an organic material of photosensitive polyimide, acrylic or the like may be applied and exposed to light to pattern the bank layer 411. In such a case, the bank layer 411 may contain carbon particles, titanium particles, colorant, or the like to block light.

A counter substrate 406 is provided to face the substrate 20 and fixed so that the display portion 109 is sandwiched between the two substrates. The substrate 20 and the counter substrate 406 are attached with a sealing member 408 provided outside of the display portion 109. Colored layers 451 to 453 are formed on the counter substrate 406 so as to correspond to the displaying light emitting elements 105. Each of the colored layers 451 to 453 transmits light with a specific wavelength, which is selected from white light emitted from the displaying light emitting element 105. Since the colored layers 451 to 453 have different optical characteristics, they transmit light with different wavelengths, which results in a display device capable of performing a multi-color display.

In order to perform a multi-color display, EL layers of the displaying light emitting elements may be formed to emit different color lights, though the pixel pitch increases in some cases since the EL layers are formed separately. That is to say, the bank layer occupies a larger area in the display portion. Meanwhile, when the EL layers that emit white light are combined with colored layers, it is not necessary to form the EL layers separately and increase the distance between pixels or bank layers, leading to high definition.

A triplet excited light emitting material including a metal complex or the like as well as a singlet excited light emitting material may be used for the EL layer that emits white light. As an example of the triplet excited light emitting material, there are known a metal complex used as a dopant, a metal complex having platinum that is a third transition series element as a central metal, a metal complex having iridium as a central metal, and the like. The triplet excited light emitting material is not limited to these compounds and it is also possible to use a compound having the aforementioned structure and having an element belonging to Groups 8 to 10 of the periodic table as a central metal. A light emitting element that emits white light may be constituted by two or three light emitting layers including a blue electro luminescent layer. Alternatively, a white light emitting element may be formed by arbitrarily stacking a functional layer such as a hole injection layer, a hole transporting layer, an electron injection layer, an electron transporting layer, a light emitting layer, an electron blocking layer, and a hole blocking layer. Further, a mixed layer or a mixed connection of these layers may also be formed.

At this time, the monitoring light emitting element is formed in the same manner as the displaying light emitting element. In this case, the monitoring light emitting element may be formed for each emission color, though it is preferably used in common since the same light emitting element is used even with different emission colors.

Embodiment 8

Described in this embodiment is an example of the display devices shown in Embodiments 1 to 6, which corrects degradation with time of a displaying light emitting element during a non-display period.

The luminance degradation of a light emitting element using an EL material can be phenomenologically divided into initial degradation and medium and long-term degradation. The initial degradation means drastic degradation in luminance for several to several tens of hours after the light emitting element immediately after the production is conducted. Meanwhile, the medium and long-term degradation means luminance degradation after the initial degradation, which may be caused regardless of current density.

In a display device using such a light emitting element, it is preferable to perform an aging process of causing initial degradation in the light emitting element before adjustment of the luminance of a display portion. When initial drastic changes with time of the light emitting element occur in advance by such an aging process, changes with time do not progress rapidly thereafter, which reduces variations in luminance and image burn-in in the display portion.

The aging process is performed by activating a light emitting element only during a certain period, and preferably by applying a voltage higher than usual. According to this, initial changes with time occur in a short time.

If the display device of the invention is operated using a rechargeable battery, it is preferable to perform, during charging the display device that it not in use, a process of lighting or flashing all the pixels, a process of displaying an image whose contrast is inverted relative to a normal image (e.g., standby display image or the like), a process of detecting a pixel that emits light at a low frequency by sampling a video signal and lighting or flashing the pixel, and the like.

The aforementioned process is performed in order to reduce image burn-in during a period when the display device is not in use, and called a flashout process. Even when image burn-in occurs after the flashout process, the difference between the brightest point and the darkest point of the burned-in image can be set to five gray scale level or less, and more preferably one gray scale level or less. In order to reduce image burn-in, a fixed image may be reduced as much as possible in addition to the aforementioned processes.

Embodiment 9

The invention can also be applied to a display device driven with a constant current. Described in this embodiment is a configuration where the rate of changes with time is detected by using a plurality of monitoring light emitting element and a video signal or a power supply potential is corrected based on the detected result. The description is made with reference to FIG. 26.

Figure 26:
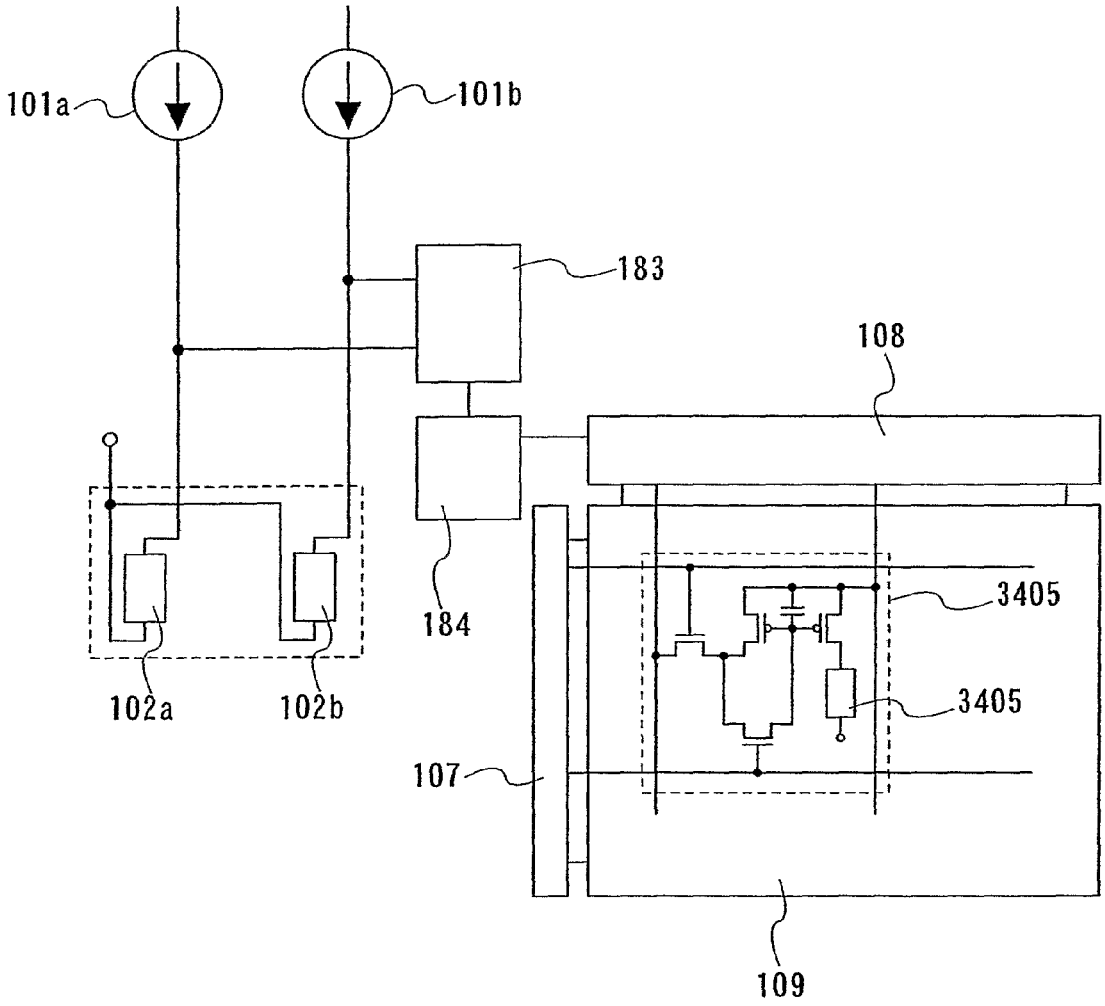
FIG. 26 is a diagram showing a configuration example of a display device according to the invention, which is provided with a displaying light emitting element and a monitoring light emitting element and performs the CL drive.

A display device shown in FIG. 26 uses the two monitoring light emitting elements 102*a* and 102*b*. A constant current is supplied from a first current source 101*a* to the monitoring light emitting element 102*a* while a constant current is supplied from a second current source 101*b* to the monitoring light emitting element 102*b*. When supplying different currents from the first current source 101*a* and the second current source 101*b*, the total amount of charge flowing through the monitoring light emitting element 102*a* can be made different from that through the monitoring light emitting element 102*b*. As a result, degradation with time of the monitoring light emitting element 102*a* and the monitoring light emitting element 102*b* progresses at different rates.

The monitoring light emitting elements 102*a* and 102*b* are connected to an arithmetic circuit 183. The arithmetic circuit 183 calculates the difference (voltage value) between the output of the monitoring light emitting element 102*a* and the output of the monitoring light emitting element 102*b*. The voltage value calculated by the arithmetic circuit 183 is inputted to a video signal generating circuit 184. The video signal generating circuit 184 corrects a video signal supplied to each pixel in accordance with the voltage value supplied from the arithmetic circuit 183, and supplies the corrected signal to the data line driver circuit 108. According to such a configuration, changes with time of the displaying light emitting element can be compensated.

A circuit such as a buffer amplifier for preventing changes in potential may be provided between the monitoring light emitting element 102*a* and the arithmetic circuit 183 and between the monitoring light emitting element 102*b* and the arithmetic circuit 183. The pixel 110 may have a circuit configuration suitable for driving the displaying light emitting element 105 with a constant current, and a current mirror circuit or the like may be used.

As described in this embodiment, luminance degradation can be corrected by detecting degradation with time using a plurality of monitoring light emitting elements and by correcting a video signal or a power supply potential based on the detected result. In other words, the displaying light emitting element and the monitoring light emitting element having the similar characteristics are operated under different driving conditions, and the ratio of the total amount of charge flowing through the displaying light emitting element to that flowing through the monitoring light emitting elements is controlled to satisfy a certain relation in view of luminance degradation. Accordingly, the CL drive for keeping the luminance of the displaying light emitting element constant can be performed.

Embodiment 10

Either an analog video signal or a digital video signal may be used in the display device of the invention. If a digital video signal is used, the video signal may use either a voltage or a current. That is to say, a video signal inputted to a pixel in light emission of a light emitting element may be either a constant voltage or a constant current. When a video signal is a constant voltage, a constant voltage is applied to a light emitting element or a constant current flows through the light emitting element. When a video signal is a constant current, a constant voltage is applied to a light emitting element or a constant current flows through the light emitting element. When a constant voltage is applied to a light emitting element, a constant voltage drive is performed. Meanwhile, when a constant current flows through a light emitting element, a constant current drive is performed. According to the constant current drive, a constant current flows regardless of changes in resistance of the light emitting element. The display device of the invention may adopt either the constant current drive or the constant voltage drive, though a voltage video signal is used in the display device of the invention.

Embodiment 11

A configuration example of a pixel used in the display devices shown in Embodiments 1 to 10 is described with reference to FIG. 29, FIG. 30 and FIG. 31.

Figure 29:
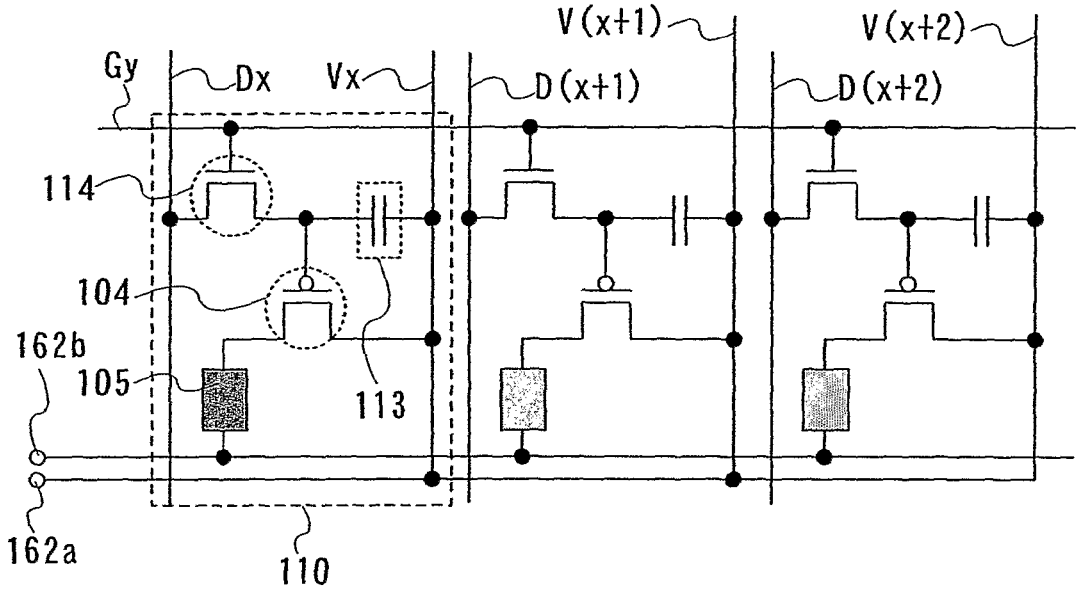
FIG. 29 is a diagram showing a pixel circuit of a display device according to the invention.

The pixel 110 shown in FIG. 29 has two transistors. The pixel 110 is provided in an area where a data signal line Dx (x is a natural number, 1=x=m) and a scan line Gy (y is a natural number, 1=y=n) cross each other with an insulating layer interposed therebetween. The pixel 110 has the displaying light emitting element 105, the capacitor 113, the switching transistor 114, and the driving transistor 104. The switching transistor 114 controls video signal input, and the driving transistor 104 controls light emission or non-light emission of the displaying light emitting element 105. These transistors are field effect transistors, and for example, thin film transistors may be used.

The gate electrode of the switching transistor 114 is connected to the scan line Gy, one of the source electrode and the drain electrode thereof is connected to the data signal line Dx, and the other is connected to the gate electrode of the driving transistor 104. One of the source electrode and the drain electrode of the driving transistor 104 is connected to the first power supply line 162*a* through a power supply line Vx (x is a natural number, 1=x=m), and the other is connected to the displaying light emitting element 105. The opposite electrode of the displaying light emitting element 105, which is not connected to the first power supply line 162*a*, is connected to the second power supply line 162*b*.

The capacitor 113 is provided between the gate electrode and the source electrode of the driving transistor 104. Either an N-channel transistor or a P-channel transistor may be used for the switching transistor 114 and the driving transistor 104. In the pixel 110 shown in FIG. 29, the switching transistor 114 is an N-channel transistor while the driving transistor 104 is a P-channel transistor. The potential of the first power supply line 162*a* and the potential of the second power supply line 162*b* are not limited either, though different potentials are inputted to the first power supply line 162*a* and the second power supply line 162*b* so as to apply a forward bias voltage or a reverse bias voltage to the displaying light emitting element 105.

Figure 30:
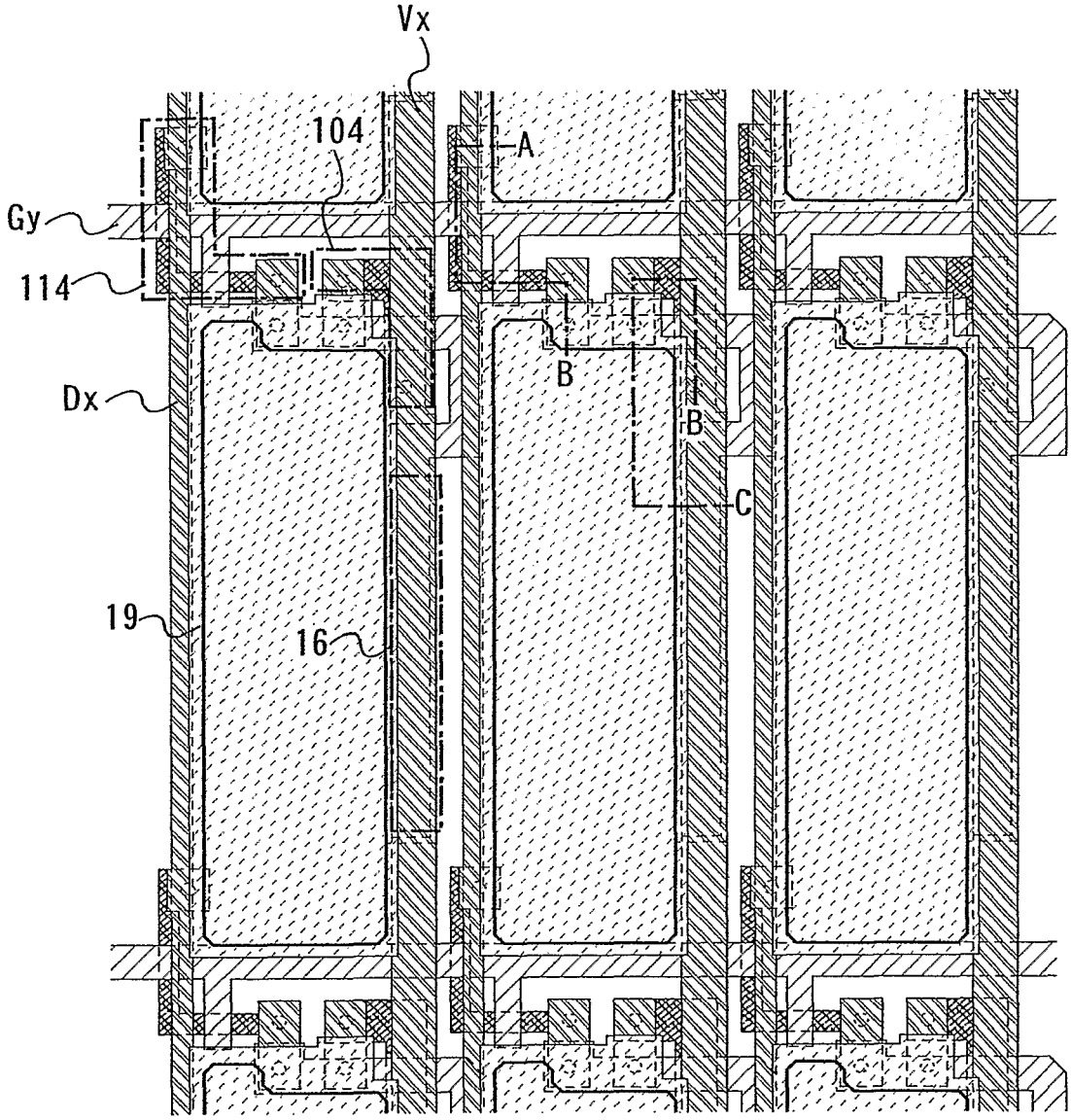
FIG. 30 is a diagram showing a pixel example of a display device according to the invention.

FIG. 30 is a plan view of such a pixel 110 including the switching transistor 114, the driving transistor 104 and the capacitor 113. A first electrode 19 is one electrode of the displaying light emitting element 105, and an EL layer is stacked over the first electrode 19; thereby the displaying light emitting element 105 connected to the driving transistor 104 is obtained. In order to increase aperture ratio, the capacitor 113 is provided so as to overlap the power supply line Vx.

Figure 31:
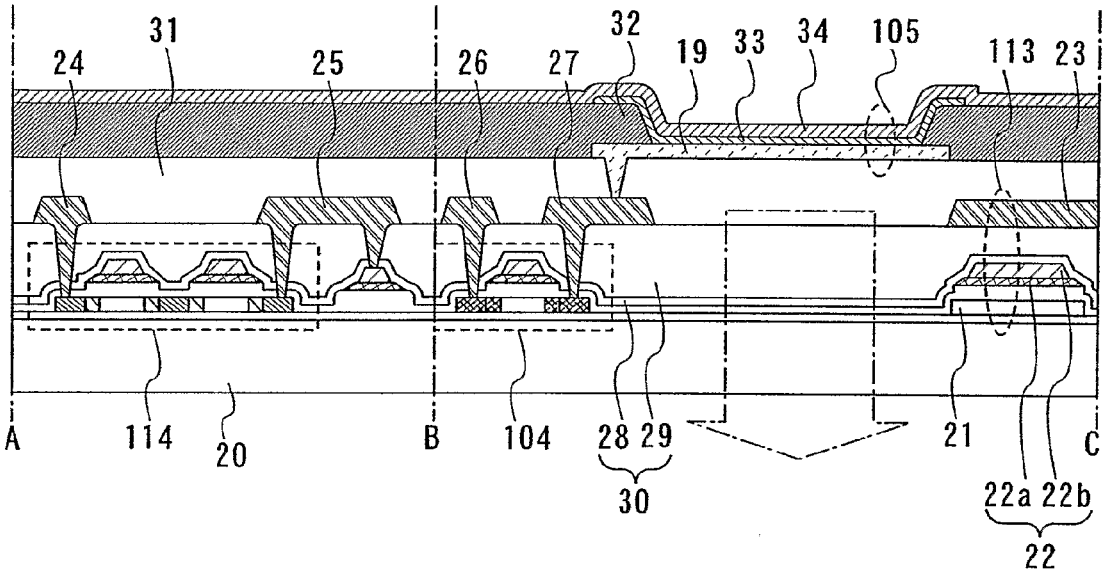
FIG. 31 is a longitudinal sectional view showing a configuration example of a display portion of a display device according to the invention.

FIG. 31 is a cross sectional view obtained by cutting along a line A-B-C of FIG. 30. The switching transistor 114, the driving transistor 104, the displaying light emitting element 105, and the capacitor 113 are provided over the substrate 20 having an insulating surface such as glass and quartz. The switching transistor 114 preferably has a multi-gate structure to reduce off-current. The switching transistor 114 and the driving transistor 104 may have a channel portion formed using various materials such as an amorphous semiconductor mainly containing silicon, a semi-amorphous semiconductor (also referred to as a microcrystalline semiconductor), a polycrystalline semiconductor, and an organic semiconductor. The semi-amorphous semiconductor is formed by using silane gas (SiH4) and fluorine gas (F2), or silane gas and hydrogen gas. Alternatively, a polycrystalline semiconductor may be used, which is obtained by forming an amorphous semiconductor by a physical deposition method such as a sputtering method or a chemical deposition method such as a vapor deposition method and by crystallizing the amorphous semiconductor by irradiation of electromagnetic energy such as laser beam. The gate electrodes of the switching transistor 114 and the driving transistor 104 preferably adopt a stacked structure of tungsten (W) and tungsten nitride (WN), a stacked structure of molybdenum (Mo), aluminum (Al) and molybdenum (Mo), or a stacked structure of molybdenum (Mo) and molybdenum nitride (MoN).

Wirings 24, 25, 26, and 27 connected to the source electrodes and the drain electrodes of the switching transistor 114 and the driving transistor 104 are formed of a single layer or stacked layers using a conductive material. For example, a stacked structure of titanium (Ti), aluminum silicon (Al—Si)

and titanium (Ti), a stacked structure of Mo, Al—Si and Mo, or a stacked structure of MoN, Al—Si and MoN is adopted.

The displaying light emitting element 105 has a stacked structure of the first electrode 19 corresponding to the pixel electrode, an EL layer 33, and a second electrode 34 corresponding to the counter electrode. The end portion of the first electrode 19 is surrounded by a bank layer 32. The EL layer 33 and the second electrode 34 are stacked so as to overlap the first electrode 19 in an opening of the bank layer 32. This stacked portion corresponds to the displaying light emitting element 105. If both of the first electrode 19 and the second electrode 34 transmit light, the displaying light emitting element 105 emits light in the directions of the first electrode 19 and the second electrode 34. That is to say, the displaying light emitting element 105 performs dual emission. Meanwhile, if one of the first electrode 19 and the second electrode 34 transmits light and the other blocks light, the displaying light emitting element 105 emits light only in the direction of the first electrode 19 or the direction of the second electrode 34. That is to say, the displaying light emitting element 105 performs top emission or bottom emission.

FIG. 31 shows a cross sectional structure in the case where the displaying light emitting element 105 performs the bottom emission. The capacitor 113 is provided between the gate electrode and the source electrode of the driving transistor 104, and holds a gate-source voltage of the driving transistor 104. The capacitor 113 is constituted by a semiconductor layer 21 formed on the same layer as semiconductor layers of the switching transistor 114 and the driving transistor 104, conductive layers 22*a* and 22*b* (hereinafter collectively referred to as a conductive layer 22) formed on the same layer as the gate electrodes of the switching transistor 114 and the driving transistor 104, and an insulating layer between the semiconductor layer 21 and the conductive layer 22.

The capacitor 113 is also constituted by the conductive layer 22 formed on the same layer as the gate electrodes of the switching transistor 114 and the driving transistor 104, a wiring 23 formed on the same layer as the wirings 24 to 27 connected to the source electrodes and the drain electrodes of the switching transistor 114 and the driving transistor 104, and an insulating layer between the conductive layer 22 and the wiring 23. According to such a structure, the capacitor 113 can obtain capacitance large enough to hold the gate-source voltage of the driving transistor 104. The capacitor 113 is provided so as to overlap a conductive layer constituting the power supply line; therefore, decrease in aperture ratio due to the capacitor 113 can be prevented.

The respective thicknesses of the wirings 24 to 27 connected to the source electrodes and the drain electrodes of the switching transistor 114 and the driving transistor 104 are 500 to 2000 nm, and preferably 500 to 1300 nm. When the respective thicknesses of the wirings 24 to 27 increase in this manner, the influence of voltage drop can be suppressed since the data signal line Dx and the power supply line Vx are constituted by the wirings 24 to 27.

A first insulating layer 30 and a second insulating layer 31 are made of an inorganic material such as silicon oxide and silicon nitride, or an organic material such as polyimide and acrylic. The first insulating layer 30 and the second insulating layer 31 may be made of the same material or different materials. As the organic material, a siloxane-based material may be used, which is, for example, composed of a skeleton formed by the bond of silicon (Si) and oxygen (O). The siloxane-based material includes an organic group containing at least hydrogen (such as an alkyl group or aromatic hydrocarbon) as a substituent. Alternatively, a fluoro group may be used as the substituent. Further alternatively, a fluoro group and an organic group containing at least hydrogen may be used as the substituent.

Embodiment 12

Described is a panel incorporating the display portion 109, the scan line driver circuit 107 and the data line driver circuit 108, which is one mode of the display device shown in Embodiment 11. The display portion 109 having a plurality of pixels each including the displaying light emitting element 105, the scan line driver circuit 107, the data line driver circuit 108, and a connection film 407 are formed over the substrate 20 (see FIG. 32A). The connection film 407 is connected to an external circuit.

Figure 32A:
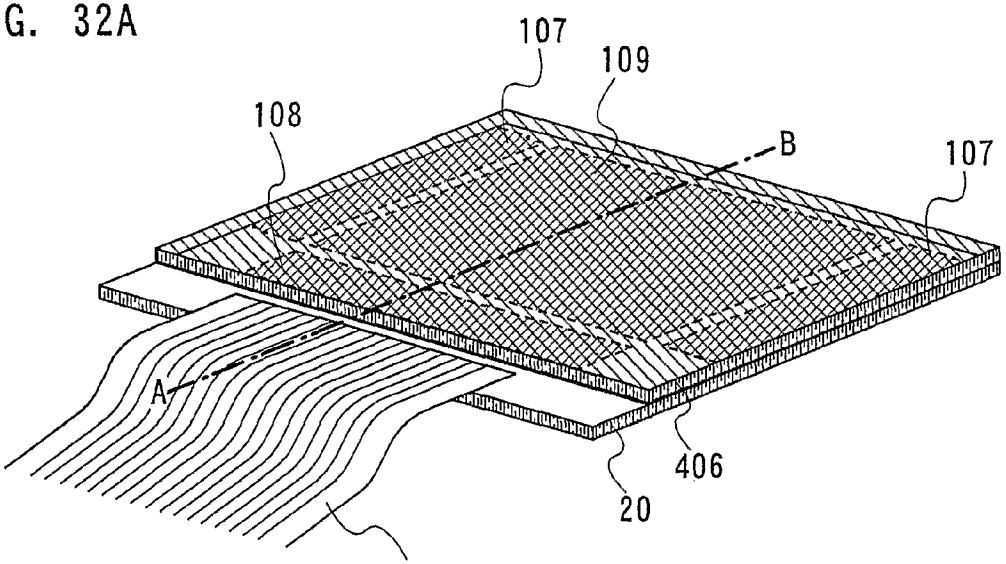
FIGS. 32A and 32B are diagrams each showing a configuration example of a display device according to the invention, which includes a display portion, a scan line driver circuit and a data line driver circuit.
Figure 32B:
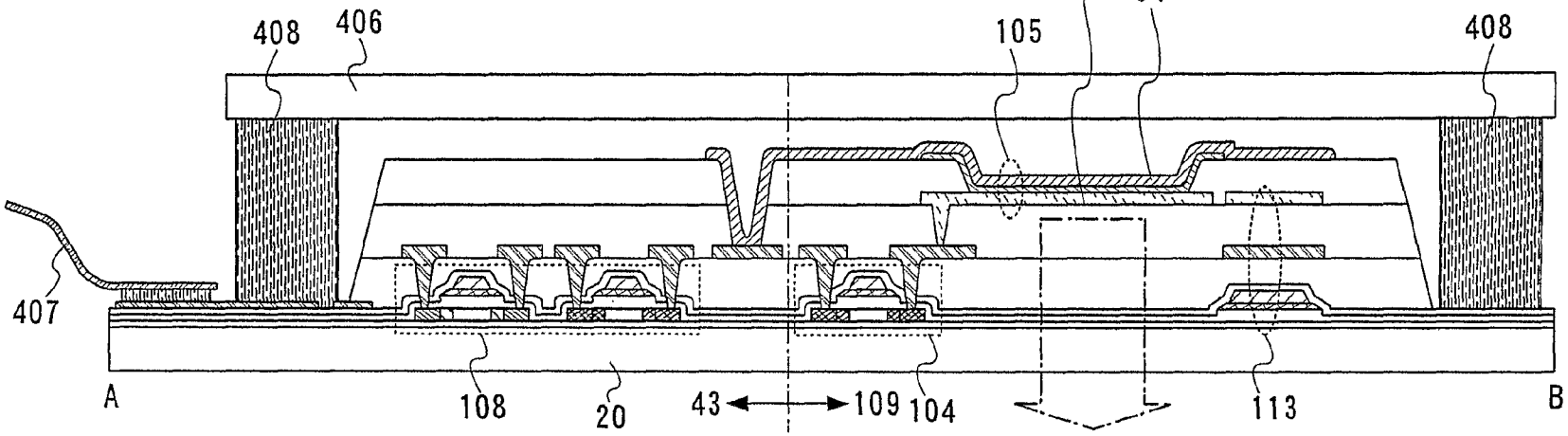

FIG. 32B is a cross sectional view obtained by cutting along a line A-B of the panel, which shows the display portion 109 including the driving transistor 104, the displaying light emitting element 105 and the capacitor 113, and the data line driver circuit 108 including transistors. The sealing member 408 is provided so as to surround the display portion 109, the scan line driver circuit 107 and the data line driver circuit 108. The displaying light emitting element 105 is sealed with the sealing member 408 and the counter substrate 406. This sealing process is performed in order to protect the displaying light emitting element 105 from moisture. In this embodiment, a cover material (glass, ceramics, plastic, metal or the like) is used for sealing, though a heat curable resin or a UV light curable resin may be used as well as a high barrier thin film such as metal oxide and nitride. The elements over the substrate 20 are preferably formed of a crystalline semiconductor (polysilicon) having superior characteristics in mobility and the like as compared with an amorphous semiconductor, in which case the elements can be monolithically formed over the same surface. The panel having the aforementioned structure can reduce the number of external ICs to be connected, leading to reduction in size, weight, and thickness.

Figure 33A:
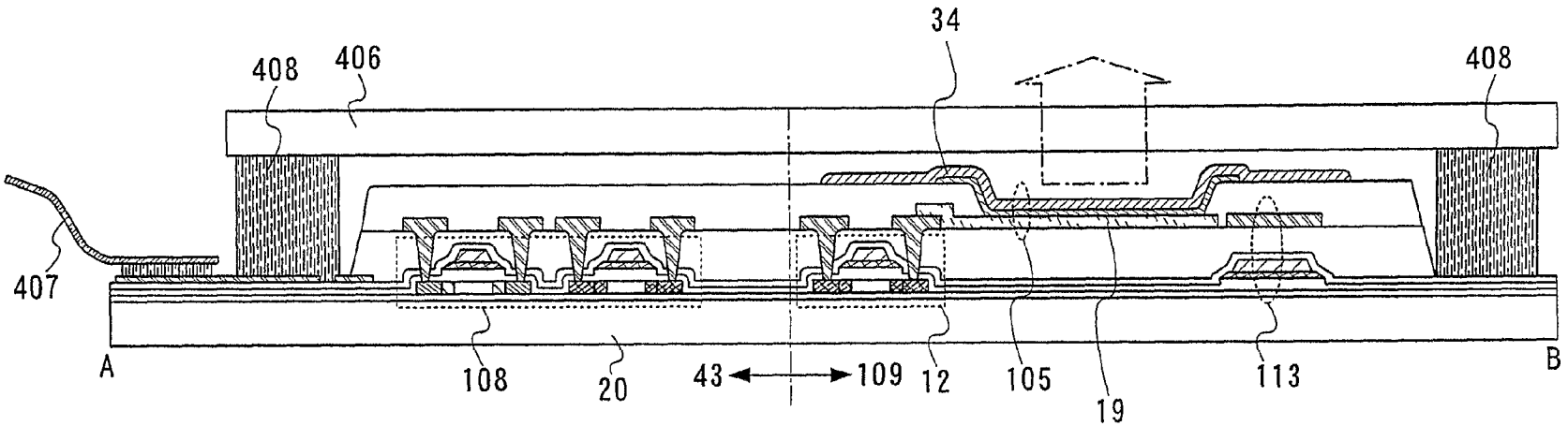
FIGS. 33A and 33B are diagrams each showing a configuration example of a display device according to the invention, which includes a display portion, a scan line driver circuit and a data line driver circuit.
Figure 33B:
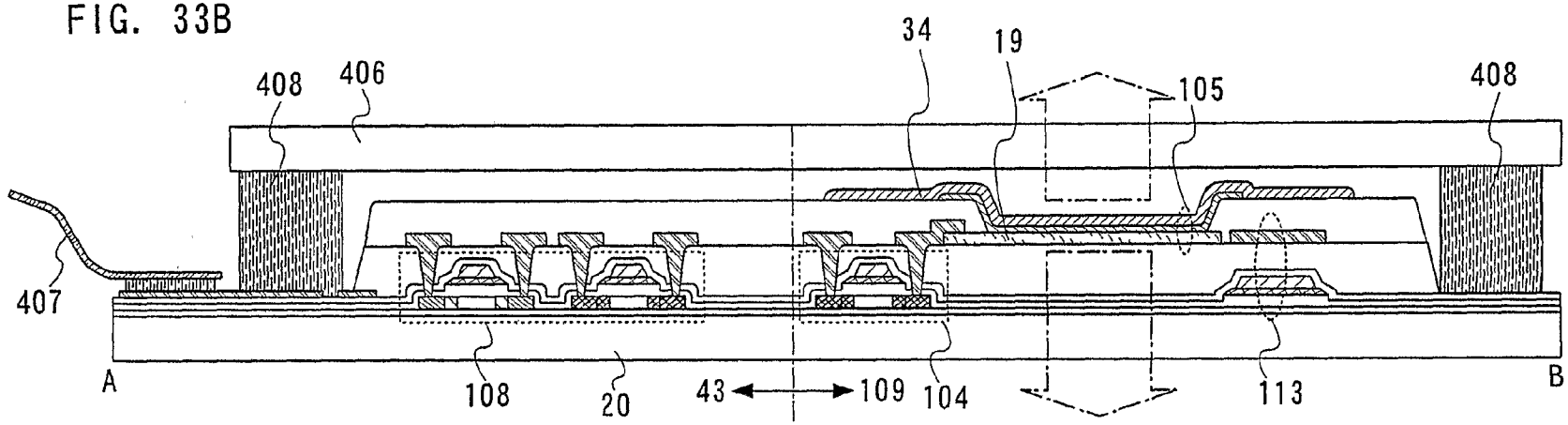

In the aforementioned structures shown in FIGS. 32A and 32B, the first electrode 19 of the displaying light emitting element 105 transmits light while the second electrode 34 blocks light. Therefore, the displaying light emitting element 105 emits light in the direction of the substrate 20. As a structure different from the aforementioned, there is a structure where the first electrode 19 of the displaying light emitting element 105 blocks light while the second electrode 34 transmits light as shown in FIG. 33A. In this case, the displaying light emitting element 105 performs the top emission. As another structure, there is a structure where both of the first electrode 19 and the second electrode 34 of the light emitting element 105 transmit light as shown in FIG. 33B. In this case, the dual emission is performed. In these structures, the monitoring light emitting element may have the same configuration as the displaying light emitting element.

The display portion 109 may be constituted by a transistor that is formed over an insulating surface and has a channel portion formed of an amorphous semiconductor (amorphous silicon). The scan line driver circuit 107 and the data line driver circuit 108 may be constituted by an IC chip. The IC chip may be attached onto the substrate 20 by COG or attached to the connection film 407 connected to the substrate 20. The amorphous semiconductor can be easily formed over a large substrate by CVD and requires no crystallization step, and thus provides an inexpensive panel. Further, when a conductive layer is formed by a droplet discharging method typified by an ink jet printing method, a more inexpensive panel can be achieved.

Embodiment 13

A display device provided with a display portion including a light emitting element can be applied to various electronic apparatuses such as a television set (television, television receiver), a digital camera, a digital video camera, a mobile phone set (cellular phone), a portable information terminal such as a PDA, a portable game machine, a monitor, a computer, an audio reproducing device such as an in-car audio system, and an image reproducing device provided with a recording medium such as a home game machine. The display device of the invention can be applied to display portions of these electronic apparatuses. Specific examples of them are described with reference to FIGS. 35A to 35F.

Figure 35A:
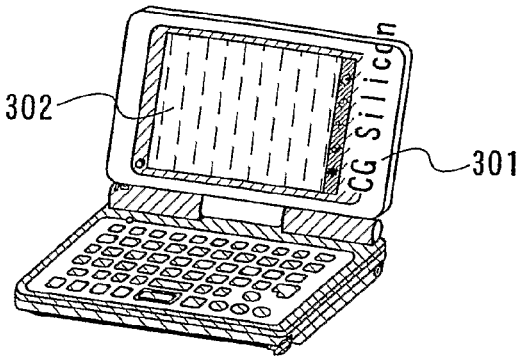
FIGS. 35A to 35F are views each showing an example of an electronic apparatus using the invention.

FIG. 35A shows a portable information terminal using the display device of the invention, which includes a main body 301, a display portion 302 and the like. According to the invention, decrease in the luminance of the display portion 302 can be suppressed, leading to longer life thereof. In addition, the driving voltage of a light emitting element can be reduced by the constant voltage drive, which results in reduction in power consumption.

Figure 35B:
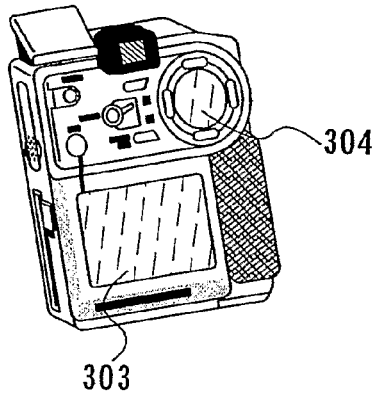

FIG. 35B shows a digital video camera using the display device of the invention, which includes a main body 303, a display portion 304 and the like. According to the invention, decrease in the luminance of the display portion 304 can be suppressed, leading to longer life thereof. In addition, the driving voltage of a light emitting element can be reduced by the constant voltage drive, which results in reduction in power consumption.

Figure 35C:
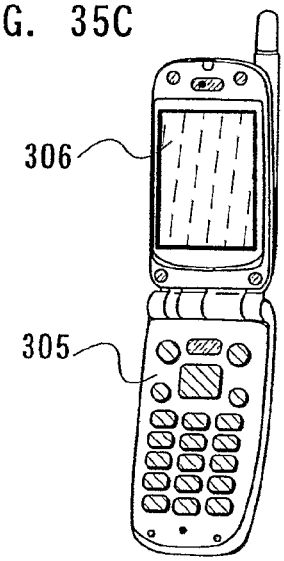

FIG. 35C shows a portable terminal using the display device of the invention, which includes a main body 305, a display portion 306 and the like. According to the invention, decrease in the luminance of the display portion 306 can be suppressed, leading to longer life thereof. In addition, the driving voltage of a light emitting element can be reduced by the constant voltage drive, which results in reduction in power consumption.

Figure 35D:
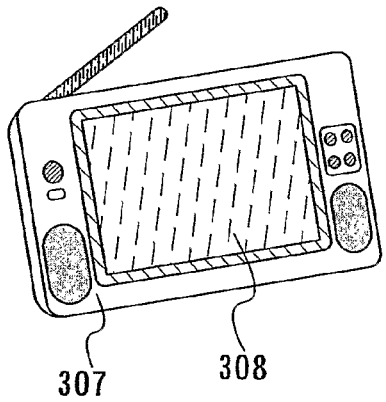

FIG. 35D shows a portable television set using the display device of the invention, which includes a main body 307, a display portion 308 and the like. According to the invention, decrease in the luminance of the display portion 308 can be suppressed, leading to longer life thereof. In addition, the driving voltage of a light emitting element can be reduced by the constant voltage drive, which results in reduction in power consumption.

Figure 35E:
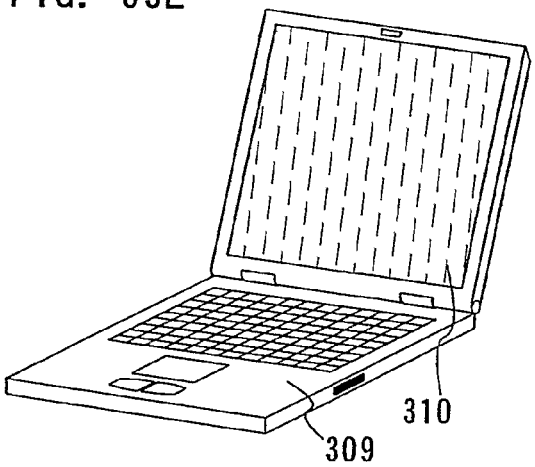

FIG. 35E shows a portable computer using the display device of the invention, which includes a main body 309, a display portion 310 and the like. According to the invention, decrease in the luminance of the display portion 310 can be suppressed, leading to longer life thereof. In addition, the driving voltage of a light emitting element can be reduced by the constant voltage drive, which results in reduction in power consumption.

Figure 35F:
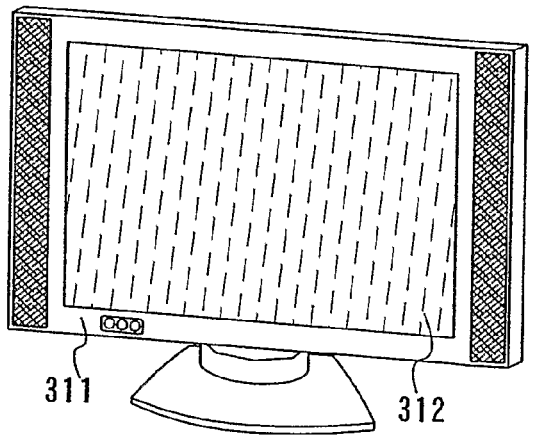

FIG. 35F shows a television set using the display device of the invention, which includes a main body 311, a display portion 312 and the like. According to the invention, decrease in the luminance of the display portion 312 can be suppressed, leading to longer life thereof. In addition, the driving voltage of a light emitting element can be reduced by the constant voltage drive, which results in reduction in power consumption.

If the aforementioned electronic apparatuses use a rechargeable battery, the life of them increases with reduction in power consumption, thereby the charge of the rechargeable battery can be saved.

The invention claimed is:

1. A display device comprising:

a plurality of monitoring light emitting elements electrically connected to a current source;

a first connection switching means electrically connected between the current source and the plurality of monitoring light emitting elements;

a voltage generating circuit electrically connected between the plurality of monitoring light emitting elements and a light emitting element;

a second connection switching means electrically connected between the plurality of monitoring light emitting elements and the voltage generating circuit; and a controller electrically connected to the first connection switching means and the second connection switching means, wherein the first connection switching means is configured to control electrical connections between the current source and the plurality of monitoring light emitting elements, and wherein the second connection switching means is configured to control electrical connections between the plurality of monitoring light emitting elements and the voltage generating circuit.

2. The display device according to claim 1, wherein an output voltage of the voltage generating circuit is applied to the light emitting element.

3. The display device according to claim 1, wherein a same potential as one of the plurality of monitoring light emitting elements is inputted to the voltage generating circuit.

4. The display device according to claim 1, wherein the controller detects a voltage applied to one of the plurality of monitoring light emitting elements and instructs the second connection switching means to change a connection with the voltage generating circuit from one of the plurality of monitoring light emitting elements to another one of the plurality of monitoring light emitting elements.

5. The display device according to claim 1, wherein the controller detects an accumulated driving time of one of the plurality of monitoring light emitting elements and instructs the second connection switching means to change a connection with the voltage generating circuit from one of the plurality of monitoring light emitting elements to another one of the plurality of monitoring light emitting elements.

6. The display device according to claim 1, wherein the voltage generating circuit comprises a voltage follower circuit.

7. The display device according to claim 1, wherein the plurality of monitoring light emitting elements and the light emitting element are formed over the same substrate.

8. The display device according to claim 1, wherein each of the plurality of monitoring light emitting elements and the light emitting element comprises an EL layer between a pair of electrodes.

9. A display device comprising:

a plurality of monitoring light emitting elements electrically connected to a current source;

a first connection switching means electrically connected between the current source and the plurality of monitoring light emitting elements;

a voltage generating circuit electrically connected between the plurality of monitoring light emitting elements and a light emitting element;

a second connection switching means electrically connected between the plurality of monitoring light emitting elements and the voltage generating circuit; and a controller electrically connected to the first connection switching means and the second connection switching means, wherein the plurality of monitoring light emitting elements are configured to be driven with different ratios of a lighting period to a non-lighting period, wherein the first connection switching means is configured to control electrical connections between the current source and the plurality of monitoring light emitting elements, and wherein the second connection switching means is configured to control electrical connections between the plurality of monitoring light emitting elements and the voltage generating circuit.

10. The display device according to claim 9, wherein an output voltage of the voltage generating circuit is applied to the light emitting element.

11. The display device according to claim 9, wherein a same potential as one of the plurality of monitoring light emitting elements is inputted to the voltage generating circuit.

12. The display device according to claim 9, wherein the controller detects a voltage applied to one of the plurality of monitoring light emitting elements and instructs the second connection switching means to change a connection with the voltage generating circuit from one of the plurality of monitoring light emitting elements to another one of the plurality of monitoring light emitting elements.

13. The display device according to claim 9, wherein the controller detects an accumulated driving time of one of the plurality of monitoring light emitting elements and instructs the second connection switching means to change a connection with the voltage generating circuit from one of the plurality of monitoring light emitting elements to another one of the plurality of monitoring light emitting elements.

14. The display device according to claim 9, wherein the voltage generating circuit comprises a voltage follower circuit.

15. The display device according to claim 9, wherein the plurality of monitoring light emitting elements and the light emitting element are formed over the same substrate.

16. The display device according to claim 9, wherein each of the plurality of monitoring light emitting elements and the light emitting element comprises an EL layer between a pair of electrodes.

17. A display device comprising:

a plurality of monitoring light emitting elements electrically connected to a current source;

a first connection switching means electrically connected between the current source and the plurality of monitoring light emitting elements;

a voltage generating circuit electrically connected between the plurality of monitoring light emitting elements and a light emitting element;

a second connection switching means electrically connected between the plurality of monitoring light emitting elements and the voltage generating circuit; and a controller electrically connected to the first connection switching means and the second connection switching means, wherein a ratio of a lighting period in a certain period having one or both of a lighting period and a non-lighting period is 50 to 100% in one of the plurality of monitoring light emitting elements, and wherein a ratio of a lighting period in the certain period having one or both of a lighting period and a non-lighting period is 5 to 45% in the light emitting element wherein the first connection switching means is configured to control electrical connections between the current source and the plurality of monitoring light emitting elements, and wherein the second connection switching means is configured to control electrical connections between the plurality of monitoring light emitting elements and the voltage generating circuit.

18. The display device according to claim 17, wherein an output voltage of the voltage generating circuit is applied to the light emitting element.

19. The display device according to claim 17, wherein a same potential as one of the plurality of monitoring light emitting elements is inputted to the voltage generating circuit.

20. The display device according to claim 17, wherein the controller detects a voltage applied to one of the plurality of monitoring light emitting elements and instructs the second connection switching means to change a connection with the voltage generating circuit from one of the plurality of monitoring light emitting elements to another one of the plurality of monitoring light emitting elements.

21. The display device according to claim 17, wherein the controller detects an accumulated driving time of one of the plurality of monitoring light emitting elements and instructs the second connection switching means to change a connection with the voltage generating circuit from one of the plurality of monitoring light emitting elements to another one of the plurality of monitoring light emitting elements.

22. The display device according to claim 17, wherein the voltage generating circuit comprises a voltage follower circuit.

23. The display device according to claim 17, wherein the plurality of monitoring light emitting elements and the light emitting element are formed over the same substrate.

24. The display device according to claim 17, wherein each of the plurality of monitoring light emitting elements and the light emitting element comprises an EL layer between a pair of electrodes.

* * * * *